US010762908B2

(12) United States Patent
Tsutsumi et al.

(10) Patent No.: US 10,762,908 B2
(45) **Date of Patent: *Sep. 1, 2020**

(54) AUDIO ENCODING DEVICE, METHOD AND PROGRAM, AND AUDIO DECODING DEVICE, METHOD AND PROGRAM

(71) Applicant: NTT DOCOMO, INC., Chiyoda-ku, Tokyo (JP)

(72) Inventors: Kimitaka Tsutsumi, Yokohama (JP); Kei Kikuiri, Yokosuka (JP)

(73) Assignee: NTT DOCOMO, INC., Tokyo (JP)

( * ) Notice: Subject to any disclaimer, the term of this patent is extended or adjusted under 35 U.S.C. 154(b) by 65 days.

This patent is subject to a terminal disclaimer.

(21) Appl. No.: 16/136,978

(22) Filed: Sep. 20, 2018

(65) Prior Publication Data

US 2019/0019519 A1 Jan. 17, 2019

Related U.S. Application Data

(63) Continuation of application No. 15/298,979, filed on Oct. 20, 2016, now Pat. No. 10,115,402, which is a (Continued)

(30) Foreign Application Priority Data

Nov. 22, 2010 (JP) ..... 2010-260447
Feb. 18, 2011 (JP) ..... 2011-033915

(51) Int. Cl.
*G10L 19/00* (2013.01)
*G10L 19/005* (2013.01)

(Continued)

(52) U.S. Cl.
CPC ..... *G10L 19/005* (2013.01); *G10L 19/025* (2013.01); *G10L 25/21* (2013.01)

(58) Field of Classification Search
CPC ..... G10L 19/24; G10L 19/04; G10L 19/002; G10L 19/005; G10L 19/038;

(Continued)

(56) References Cited

U.S. PATENT DOCUMENTS 4,802,171 A 1/1989 Rasky
6,418,408 B1 * 7/2002 Udaya Bhaskar .. G10L 19/0204 704/219

(Continued)

FOREIGN PATENT DOCUMENTS

CN 1906663 A 1/2007
JP 07-336310 12/1995

(Continued)

OTHER PUBLICATIONS

European Office Action, dated Jun. 12, 2017, pp. 1-6, issued in European Patent Application No. 15 184 203.6, European Patent Office, Munich, Germany.

(Continued)

*Primary Examiner* — Abdelali Serrou
(74) *Attorney, Agent, or Firm* — Brinks Gilson & Lione

(57) ABSTRACT

An audio packet error concealment system includes an encoding unit for encoding an audio signal consisting of a plurality of frames, and an auxiliary information encoding unit for estimating and encoding auxiliary information about a temporal change of power of the audio signal. The auxiliary information is used in packet loss concealment in decoding of the audio signal. The auxiliary information about the temporal change of power may contain a parameter that functionally approximates a plurality of powers of subframes shorter than one frame, or may contain information about a vector obtained by vector quantization of a plurality of powers of subframes shorter than one frame.

2 Claims, 50 Drawing Sheets

Related U.S. Application Data continuation of application No. 13/899,233, filed on May 21, 2013, now Pat. No. 9,508,350, which is a continuation of application No. PCT/JP2011/075489, filed on Nov. 4, 2011.

(51) Int. Cl.
*G10L 25/21* (2013.01)
*G10L 19/025* (2013.01)

(58) Field of Classification Search
CPC . G10L 19/167; G10L 19/0208; G10L 19/025; G10L 21/038; G10L 19/0204; G10L 19/12; G10L 19/265; G10L 19/0017; G10L 19/03; G10L 19/083; G10L 19/20; G10L 19/02; G10L 19/22; G10L 25/21
See application file for complete search history.

(56) References Cited

U.S. PATENT DOCUMENTS

| | | | | |
|---|---|---|---|---|
| 6,693,963 | B1 * | 2/2004 | Taniguchi | G10L 19/0208 375/240.11 |
| 7,181,022 | B2 * | 2/2007 | Rhoads | G11B 20/10037 381/73.1 |
| 8,010,353 | B2 | 8/2011 | Kawashima et al. | |
| 8,150,684 | B2 | 4/2012 | Kawashima et al. | |
| 8,320,391 | B2 | 11/2012 | Ohmuro et al. | |
| 8,452,606 | B2 | 5/2013 | Vos et al. | |
| 8,620,644 | B2 | 12/2013 | Ryu et al. | |
| 2002/0138795 | A1 * | 9/2002 | Wang | G10H 1/0058 714/707 |
| 2003/0002588 | A1 | 1/2003 | Faller | |
| 2004/0083110 | A1 | 4/2004 | Wang | |
| 2004/0138886 | A1 | 7/2004 | Absar et al. | |
| 2005/0154584 | A1 | 7/2005 | Jelinek et al. | |
| 2005/0177364 | A1 * | 8/2005 | Jelinek | G10L 19/20 704/214 |
| 2005/0216262 | A1 | 9/2005 | Fejzo | |
| 2005/0228651 | A1 * | 10/2005 | Wang | G10L 19/08 704/207 |
| 2005/0267746 | A1 * | 12/2005 | Jelinek | G10L 19/173 704/226 |
| 2006/0087464 | A1 * | 4/2006 | Moriya | G10L 19/04 341/144 |
| 2007/0094009 | A1 | 4/2007 | Ryu et al. | |
| 2007/0198254 | A1 * | 8/2007 | Goto | G10L 19/005 704/226 |
| 2007/0225971 | A1 | 9/2007 | Bessette | |
| 2008/0126904 | A1 | 5/2008 | Sung et al. | |
| 2008/0262845 | A1 | 10/2008 | Keohane et al. | |
| 2009/0030677 | A1 * | 1/2009 | Yoshida | G10L 19/005 704/219 |
| 2009/0063165 | A1 * | 3/2009 | Ojala | G10L 19/012 704/500 |
| 2009/0070105 | A1 * | 3/2009 | Ikegami | G10L 19/005 704/225 |
| 2009/0177478 | A1 | 7/2009 | Jax et al. | |
| 2009/0210235 | A1 | 8/2009 | Shirakawa et al. | |
| 2009/0288546 | A1 | 11/2009 | Takeda | |
| 2010/0036656 | A1 | 2/2010 | Kawashima et al. | |
| 2010/0049509 | A1 | 2/2010 | Kawashima et al. | |
| 2010/0063812 | A1 * | 3/2010 | Gao | G10L 19/0204 704/230 |
| 2010/0070285 | A1 * | 3/2010 | Kim | G10L 19/20 704/500 |
| 2010/0094642 | A1 | 4/2010 | Zhan et al. | |
| 2010/0106490 | A1 * | 4/2010 | Svedberg | G10L 19/012 704/215 |
| 2010/0106511 | A1 * | 4/2010 | Shirakawa | G10L 19/02 704/500 |
| 2010/0115370 | A1 * | 5/2010 | Laaksonen | G10L 19/005 714/752 |
| 2011/0077940 | A1 | 3/2011 | Vos et al. | |
| 2011/0238426 | A1 | 9/2011 | Fuchs et al. | |
| 2013/0253939 | A1 | 9/2013 | Tsutsumi et al. | |

FOREIGN PATENT DOCUMENTS

| | | |
|---|---|---|
| JP | 2007-336310 | 12/1995 |
| JP | 2003-316670 | 11/2003 |
| JP | 2008-111991 | 5/2008 |
| JP | 2008-261904 | 10/2008 |
| JP | 2010-511201 | 4/2010 |
| JP | 2017-142542 A | 8/2017 |
| WO | WO 2005/109401 | 11/2005 |
| WO | WO 2007/000988 A1 | 1/2007 |

OTHER PUBLICATIONS

Digital Transmission Systems-Terminal Equipments-Coding of Analogue Signals by Pulse Code Modulation Series G. Pulse Code Modulation (PCM) of Voice Frequencies, Intl. Telecommunication Union (ITU-T) Recommendation G.711, Appendix 1 (09/99) 26 Pgs.

3rd Generation Partnership Project: Technical Specification Group Services and System Aspects; General audio codec audio processing functions; Enhanced aacPlus General Audio Codec; General Description (Release 6) 3GPP TS 26.401 V0.0.1 (May 2004) 12 Pgs. (GSM).

Digital Terminal Equipments-Coding of Voice and Audio Signals Series G. Frame error robust narrow-band and wideband embedded variable bit-rate coding of speech and audio from 8-32 kbits/s. Intl Telecommunication Union (ITU-T) Recommendation G.718 (Jun. 2008) 257 Pgs.

3rd Generation Partnership Project: Technical Specification Group Services and System Aspects; General audio codec audio processing functions; Enhanced aacPlus general audio codec; Enhanced aacPlus encoder SBR part (Release 8) 3GPP TS 26.404 V8.0.1 (Dec. 2008) 12 Pgs. (LTE).

PCT International Search Report dated Nov. 17, 2011, PCT/JP2011/075489, 2Pgs.

Noriko Komaki et al., "A Packet Loss Concealment Technique for VoIP Using Steganography," dated Aug. 1, 2003, vol. E86-A No. 8, pp. 2069-2072, Institute of Electronics, Information and Communication Engineers Transactions on Fundamentals of Electronics, Communications and Computer Sciences, Engineering Sciences Society, Tokyo, Japan.

"G.729-based Embedded Variable Bit-rate Coder: An 8-32 kbit/s Scalable Wideband Coder Bitstream Interoperable with G.729," dated May 29, 2006, pp. 1100, ITU-T Standard, International Telecommunication Union, Geneva, Switzerland.

Angel M. Gómez et al., "A Multipulse-Based Forward Error Correction Technique for Robust CELP-Coded Speech Transmission Over Erasure Channels," dated Aug. 1, 2010, vol. 18 No. 6, pp. 1258-1268, Institute of Electrical and Electronics Engineers Transactions on Audio, Speech and Language Processing, Institute of Electrical and Electronics Engineers Service Center, New York, New York.

Extended European Search Report, dated Apr. 7, 2014, pp. 1-11, Issued in International Application No. PCT/JP2011075489, European Patent Office, Munich, Germany.

Tian, W., et al., "Low-Delay Subband Celp Coding for Wideband Speech," Nov. 26, 1996, Proceedings, 1996 IEEE Tencon. Digital Signal Processing Applications, Perth, WA, Australia Nov. 26-29, 1996, New York, NY, USA, IEEE, US, vol. 1, pp. 198-194, DOI: 11.1109/TENCON. 1996.608783, ISBN: 978-0-78803-3679-7.

European Office Action, dated Jun. 17, 2015, pp. 1-7, issued in European Patent Application No. 11842953.9, European Patent Office, Munich, Germany.

Japanese Office Action with English translation, dated Sep. 29, 2015, pp. 1-7, issued in Japanese Patent Application No. P2012-545668, Japanese Patent Office, Tokyo, Japan.

(56) References Cited

OTHER PUBLICATIONS

Geiser, B., et al., "Joint Pre-Echo Control and Frame Erasure Concealment for VOIP Audio Codecs," dated Aug. 24, 2009, pp. 1259-1263, IEEE, 17$^{th}$ European Signal Processing Conference (EUSIPCO 2009), Glasgow, Scotland, Aug. 24-28, 2009, XP032758754.
Geiser, B., et al., "Candidate Proposal for ITU-T Super-Wideband Speech and Audio Coding," dated Apr. 19, 2009, pp. 4121-4124, IEEE International Conference on Acoustics, Speech and Signal Processing, 2009 (ICASSP 2009), Piscataway, NJ, USA, XP031460181.
Chibani, M., et al., "Fast Recovery for a CELP-Like Speech Codec After a Frame Erasure," Nov. 1, 2007, pp. 2485-2495, IEEE Transactions on Audio, Speech and Language Processing, vol. 15 No. 8, Nov. 2007, IEEE Service Center, New York, NY, USA, XP011192967, ISSN: 1558-7916, DOI: 10.1109/TASL.2007.907332.
Extended European Search Report, dated Dec. 4, 2015, pp. 1-16, issued in European Patent Application No. 15184203.6, European Patent Office, Munich, Germany.
Japanese Office Action with English translation, dated Apr. 12, 2016, pp. 1-6, issued in Japanese Patent Application No. P2012-545668, Japanese Patent Office, Tokyo, Japan.
European Office Action, dated Sep. 22, 2016, pp. 1-6, issued in European Patent Application No. 15 184 203.6, European Patent Office, Munich, Germany.
Chinese Office Action with translation, dated Dec. 5, 2017, pp. 1-12, issued in Chinese Patent Application No. 201510317625.5, The State Intellectual Property Office of People's Republic of China, Beijing, PRC.
Extended European Search Report, dated Jun. 19, 2019, pp. 1-8, issued in European Patent Application No. 19161209.2, European Patent Office, Munich, Germany.
Japanese Office Action with English translation, dated Oct. 1, 2019, pp. 1-8, issued in Japanese Patent Application No. 2018-230792, Japanese Patent Office, Tokyo, Japan.
European Office Action, dated Jun. 12, 2020, pp. 1-5, issued in European Patent Application No. 19161209.2, European Patent Office, Munich, Germany.

* cited by examiner (a)

BINARY CODING

| $I_{tran}$ | QUANTIZED POSITION INFORMATION |
|---|---|
| 0 | 000 |
| 1 | 001 |
| 2 | 010 |
| 3 | 011 |
| 4 | 100 |
| 5 | 101 |
| 6 | 110 |
| 7 | 111 |

(b)

AUDIO ENCODING DEVICE, METHOD AND PROGRAM, AND AUDIO DECODING DEVICE, METHOD AND PROGRAM

This application is a continuation of U.S. patent application Ser. No. 15/298,979, filed Oct. 20, 2016, which is a continuation of U.S. patent application Ser. No. 13/899,233, filed May 21, 2013, which is a continuation of PCT/JP2011/075489, filed Nov. 4, 2011, and which claims the benefit of the filing date pursuant to 35 U.S.C. § 119(e) of JP2010-260447, filed Nov. 22, 2010, and JP2011-033915, filed Feb. 18, 2011, all of which are incorporated herein by reference.

TECHNICAL FIELD

The present invention relates to error concealment in transmission of audio packets containing audio code obtained by encoding an audio signal consisting of a plurality of frames, via a network, such as an IP network or a mobile communication network and, more particularly, to an audio encoding device, audio encoding method and audio encoding program and an audio decoding device, audio decoding method and audio decoding program to implement error concealment.

BACKGROUND ART

In transmitting an audio or acoustic signal (which will be generally referred to as an "audio signal") via an IP network or mobile communication, the audio signal is encoded to be expressed by a small bit count, the encoded data is divided into audio packets, and the audio packets are transmitted via the communication network. The audio packets received through the communication network are decoded by a receiver-side server, MCU, or terminal to obtain a decoded audio signal.

During the transmission of the audio packets via the communication network, a phenomenon can occur (so called packet losses) in which some audio packets are lost or errors are made in part of the information written in the audio packets. Such packet losses may occur because of a congestion condition of the communication network or the like. In such cases, the receiver side cannot correctly decode the audio packets and thus fails to obtain the desired decoded audio signal. Since the decoded audio signal corresponding to the audio packets subject to packet losses is perceived as noise, it significantly damages subjective quality for a human listener.

SUMMARY OF INVENTION

An aspect of an audio packet error concealment system relates to audio decoding and can include an audio decoding device, an audio decoding method, and an audio decoding program described below.

An audio decoding device according to an aspect of the audio packet error concealment system is an audio decoding device for decoding audio code from an audio packet containing the audio code and, auxiliary information code about a temporal change of power of an audio signal, which is used in packet loss concealment in decoding of the audio code. The audio decoding device includes: an error/loss detection unit for detecting a packet error or packet loss in the audio packet and outputting an error flag indicative of the result of the detection; an audio decoding unit for decoding the audio code contained in the audio packet, to obtain a decoded signal; an auxiliary information decoding unit for decoding the auxiliary information code contained in the audio packet, to obtain auxiliary information; a first concealment signal generation unit for generating, when the error flag indicates an abnormality of the audio packet, a first concealment signal for concealment of the packet loss, based on a previously-obtained decoded signal; and a concealment signal correction unit for correcting the first concealment signal, based on the auxiliary information.

An audio decoding method according to an aspect of the audio packet error concealment system is an audio decoding method executed by an audio decoding device for decoding an audio code from an audio packet containing the audio code and, an auxiliary information code about a temporal change of power of an audio signal, which is used in packet loss concealment in decoding of the audio code, the audio decoding method including: an error/loss detection step of detecting a packet error or packet loss in the audio packet and outputting an error flag indicative of the result of the detection; an audio decoding step of decoding the audio code contained in the audio packet, to obtain a decoded signal; an auxiliary information decoding step of decoding the auxiliary information code contained in the audio packet, to obtain auxiliary information; a first concealment signal generation step of generating, when the error flag indicates an abnormality of the audio packet, a first concealment signal for concealment of the packet loss, based on a previously-obtained decoded signal; and a concealment signal correction step of correcting the first concealment signal, based on the auxiliary information.

An audio decoding program according to an aspect of the audio packet error concealment system is executable with a computer. The audio packet error concealment system including: an error/loss detection unit for detecting a packet error or packet loss in an audio packet containing an audio code and, an auxiliary information code about a temporal change of power of an audio signal, which is used in packet loss concealment in decoding of the audio code, and outputting an error flag indicative of the result of the detection; an audio decoding unit for decoding the audio code contained in the audio packet, to obtain a decoded signal; an auxiliary information decoding unit for decoding the auxiliary information code contained in the audio packet, to obtain auxiliary information; a first concealment signal generation unit for generating, based on a previously-obtained decoded signal, a first concealment signal for concealment of the packet loss when the error flag indicates an abnormality of the audio packet; and a concealment signal correction unit for correcting the first concealment signal, based on the auxiliary information.

In an embodiment, the auxiliary information code about the temporal change of power of the audio signal may contain a parameter which functionally approximates powers of each of a plurality of subframes that are shorter than one frame. For example, the auxiliary information about the temporal change of power may be a prediction coefficient which realizes an optimum straight-line approximation of the powers calculated in respective subframes resulting from division of an encoding target frame into the subframes. In another example, the auxiliary information about the temporal change of power of the audio signal may be the prediction coefficient and an intercept in the straight-line approximation of the powers calculated in the respective subframes. In yet another example, the auxiliary information about the temporal change of power of the audio signal may be a parameter in an approximation using a certain function. In still another example, the auxiliary information about the temporal change of power of the audio signal may be an index of a candidate vector realizing an optimum approximation of the powers calculated in the respective subframes, out of candidate vectors stored in a predetermined codebook. In another example, the auxiliary information about the temporal change of power of the audio signal may be a parameter determined for a model assumed in advance. Furthermore, the auxiliary information about the temporal change of power of an audio signal may be encoded data of a prediction coefficient and a prediction error sequence in execution of a prediction using powers calculated for respective subframes resulting from division of the encoding target frame into one or more subframes. There are no particular restrictions on a method of encoding of the auxiliary information.

In an embodiment, the auxiliary information code about the temporal change of power of the audio signal may contain information about a vector obtained by vector quantization of powers of subframes shorter than one frame.

In an embodiment, the auxiliary information decoding unit may decode the auxiliary information code about an audio signal included in a time interval, corresponding to a frame, that is earlier or later by one or more frames than a frame corresponding to the audio code to be decoded by the audio decoding unit.

Incidentally, the auxiliary information about the temporal change of power may be calculated for each of a number of subbands in the frequency domain.

Namely, in an embodiment, the auxiliary information about the temporal change of power may contain parameters which are functionally approximate, for respective subbands, of a plurality of powers for subframes shorter than one frame, where the one frame is calculated for the respective subbands, and the subbands are obtained by dividing the entire frequency band into the subbands.

In an embodiment, the auxiliary information about the temporal change of power may contain information about vectors obtained, for respective subbands, by vector quantization of a plurality of powers of subframes shorter than one frame, where the one frame is calculated for the respective subbands, and the subbands are obtained by dividing the entire frequency band into the subbands.

In an embodiment, the concealment signal correction unit may correct the first concealment signal, in each of subbands resulting from division of an entire frequency band into the subbands.

In the case of use of the auxiliary information in each of the subbands as described, the auxiliary information decoding unit may also decode the auxiliary information code about an audio signal included in a time interval corresponding to a frame, where the frame is earlier or later by one or more frames than a frame corresponding to the audio code being decoded by the audio decoding unit.

The signal obtained by decoding the audio code may be a signal transformed into the frequency domain by MDCT (Modified Discrete Cosine Transform) or by QMF (Quadrature Mirror Filter), and the first concealment signal generated for the packet loss concealment from the past decoded signal may be a signal transformed into the frequency domain by the foregoing transform. The first concealment signal may be a signal obtained by repetition of a decoded signal which is obtained by decoding audio code received in the past, or may be a signal obtained by repetition in pitch units, or may be generated by a prediction.

In an embodiment according to the aspect regarding audio decoding, the auxiliary information about the temporal change of power may contain indication information to indicate the presence/absence of a sudden change of power.

In an embodiment, the auxiliary information about the temporal change of power may contain: a position where power changes suddenly; and a power of a subframe where power changes suddenly, or a quantized value of the power of the subframe where power changes suddenly.

In an embodiment, the auxiliary information about the temporal change of power may contain: a power of a subframe where power changes suddenly, or a quantized value of the power of the subframe where power changes suddenly.

In an embodiment, the auxiliary information about the temporal change of power may contain: indication information to indicate the presence/absence of a sudden change of power; and a power of a subframe where power changes suddenly, or a quantized value of the power of the subframe where power changes suddenly.

In an embodiment, the auxiliary information about the temporal change of power may contain: indication information to indicate the presence/absence of a sudden change of power; a position where power changes suddenly; and a power of a subframe where power changes suddenly, or a quantized value of the power of the subframe where power changes suddenly. In this case, the auxiliary information about the temporal change of power may further contain information resulting from vector quantization of the power change.

In an embodiment, the auxiliary information about the temporal change of power may contain: a power of at least one subband included in a subframe where power changes suddenly, or a quantized value of the power of the at least one subband included in the subframe where power changes suddenly.

In an embodiment, the auxiliary information about the temporal change of power may contain: indication information to indicate the presence/absence of a sudden change of power; and a power of at least one subband included in a subframe where power changes suddenly, or a quantized value of the power of the at least one subband included in the subframe where power changes suddenly.

In an embodiment, the auxiliary information about the temporal change of power may contain: a position where power changes suddenly; and a power of at least one subband included in a subframe where power changes suddenly, or a quantized value of the power of the at least one subband included in the subframe where power changes suddenly.

In an embodiment, the auxiliary information about the temporal change of power may contain: indication information to indicate the presence/absence of a sudden change of power; a position where power changes suddenly; and a power of at least one subband included in a subframe where power changes suddenly, or a quantized value of the power of the at least one subband included in the subframe where power changes suddenly. In this case, the auxiliary information about the temporal change of power may further contain information resulting from vector quantization of the power change of the at least one subband included in the subframe where power changes suddenly.

In an embodiment, the auxiliary information decoding unit may decode the auxiliary information including two or more sets of auxiliary information by decoding each of the sets separately.

In an embodiment, the auxiliary information about the temporal change of power may contain information about powers of subframes shorter than one frame, calculated for some of subbands resulting from division of an entire frequency band into the subbands.

In an embodiment, the auxiliary information decoding unit may decode the auxiliary information containing quantized information. The quantized information may be obtained, in a quantization process of a power about at least one subband included in the subframe where power changes suddenly, by quantization of: a power of a core subband included in said at least one subband, the core subband consisting of at least one subband, and a difference between the power of the core subband and a power of a subband except, or other than, for the core subband. In this case, the auxiliary information about the temporal change of power may contain: information resulting from quantization of a change of power following the subframe where power changes suddenly.

In an embodiment, the auxiliary information decoding unit may decode the auxiliary information encoded in a length that differs depending upon the indication information indicative of the presence/absence of the sudden change of power.

The first concealment signal generated for the packet loss concealment from the past decoded signal may be generated, as another embodiment, by an existing standard technology, for example, as described in Section 5.2 in TS26.402, or may be generated by another concealment signal generation technology which is not a standard technology.

Another aspect of the audio packet error concealment system relates to audio encoding and can include an audio encoding device, an audio encoding method, and an audio encoding program described below.

An audio encoding device according to an aspect of the audio packet error concealment system is an audio encoding device for encoding an audio signal consisting of a plurality of frames. The audio encoding device may include: an audio encoding unit for encoding the audio signal; and an auxiliary information encoding unit for estimating and encoding auxiliary information about a temporal change of power of the audio signal, which is used in packet loss concealment in decoding of the audio signal.

An audio encoding method according to another aspect of the audio packet error concealment system is executed by an audio encoding device for encoding an audio signal consisting of a plurality of frames. The audio encoding method of the audio packet error concealment system may include: an audio encoding step of encoding the audio signal; and an auxiliary information encoding step of estimating and encoding auxiliary information about a temporal change of power of the audio signal, which is used in packet loss concealment in decoding of the audio signal.

An audio encoding program according to another aspect of the audio packet error concealment system is executable with a computer. The audio packet error concealment system including: an audio encoding unit for encoding an audio signal consisting of a plurality of frames; and an auxiliary information encoding unit for estimating and encoding auxiliary information about a temporal change of power of the audio signal, which is used in packet loss concealment in decoding of the audio signal.

In an embodiment, the auxiliary information about the temporal change of power may contain a parameter obtained by a functional approximation of powers of subframes shorter than one frame.

In an embodiment, the auxiliary information about the temporal change of power may contain information about a vector obtained by vector quantization of powers of subframes shorter than one frame.

In an embodiment, the auxiliary information encoding unit may estimate and encode the auxiliary information, for an audio signal included in a time interval corresponding to a frame that is earlier or later by one or more frames than a frame being encoded by the audio encoding unit.

In an embodiment, the auxiliary information about the temporal change of power may contain parameters which functionally approximate, for respective subbands, a plurality of powers of subframes shorter than one frame, calculated in the respective subbands, the subbands resulting from division of an entire frequency band into the subbands.

In an embodiment, the auxiliary information about the temporal change of power may contain information about vectors obtained by vector quantization of powers of subframes shorter than one frame, calculated in respective subbands, the subbands resulting from division of an entire frequency band into the subbands.

In the case of use of the auxiliary information for each of the subbands as described above, the auxiliary information encoding unit may also estimate and encode the auxiliary information, for an audio signal included in a time interval corresponding to a frame that is earlier or later by one or more frames than a frame being encoded by the audio encoding unit.

In an embodiment, the auxiliary information encoding unit may encode the auxiliary information including two or more sets of auxiliary information by encoding each of the sets separately.

As an example, the auxiliary information encoding unit may encode the auxiliary information after scalar quantization thereof, may encode the auxiliary information after vector quantization thereof, or may directly encode the auxiliary information by use of a codebook prepared in advance. There are no particular restrictions on a method of encoding herein. The auxiliary information encoding unit may use as the auxiliary information, powers calculated in such a manner that audio signals are accumulated by a necessary number of samples and then powers are calculated in respective subframes obtained by dividing one frame into the plurality of subframes. The auxiliary information may be a prediction coefficient which realizes an optimum straight-line approximation of the powers calculated in the respective subframes, may be the prediction coefficient and an intercept in the straight-line approximation of the powers calculated in the respective subframes, may be a parameter in an approximation using a certain function, may be an index of a candidate vector realizing an optimum approximation of the powers calculated in the respective subframes, out of candidate vectors stored in a predetermined codebook, or may be a parameter determined for a model assumed in advance. The method of encoding to be used is an encoding method corresponding to the method used in the aforementioned auxiliary information decoding unit.

In an embodiment according to the aspect about audio encoding, the auxiliary information about the temporal change of power may contain indication information to indicate the presence/absence of a sudden change of power.

In an embodiment, the auxiliary information about the temporal change of power may contain: a position where power changes suddenly; and a power of a subframe where power changes suddenly, or a quantized value of the power of the subframe where power changes suddenly.

In an embodiment, the auxiliary information about the temporal change of power may contain: a power of a subframe where power changes suddenly, or a quantized value of the power of the subframe where power changes suddenly.

In an embodiment, the auxiliary information about the temporal change of power may contain: indication information to indicate the presence/absence of a sudden change of power; and a power of a subframe where power changes suddenly, or a quantized value of the power of the subframe where power changes suddenly.

In an embodiment, the auxiliary information about the temporal change of power may contain: indication information to indicate the presence/absence of a sudden change of power; a position where power changes suddenly; and a power of a subframe where power changes suddenly, or a quantized value of the power of the subframe where power changes suddenly. In this case, the auxiliary information about the temporal change of power may further contain information resulting from vector quantization of the power change.

In an embodiment, the auxiliary information about the temporal change of power may contain: a power of at least one subband included in a subframe where power changes suddenly, or a quantized value of the power of the at least one subband included in the subframe where power changes suddenly.

In an embodiment, the auxiliary information about the temporal change of power may contain: indication information to indicate the presence/absence of a sudden change of power; and a power of at least one subband included in a subframe where power changes suddenly, or a quantized value of the power of the at least one subband included in the subframe where power changes suddenly.

In an embodiment, the auxiliary information about the temporal change of power may contain: a position where power changes suddenly; and a power of at least one subband included in a subframe where power changes suddenly, or a quantized value of the power of the at least one subband included in the subframe where power changes suddenly.

In an embodiment, the auxiliary information about the temporal change of power may contain: indication information to indicate the presence/absence of a sudden change of power; a position where power changes suddenly; and a power of at least one subband included in a subframe where power changes suddenly, or a quantized value of the power of the at least one subband included in the subframe where power changes suddenly. In this case, the auxiliary information about the temporal change of power may further contain information resulting from vector quantization of the power change of the at least one subband included in the subframe where power changes suddenly.

In an embodiment, the auxiliary information may contain information about powers of subframes shorter than one frame, that are obtained for at least one subband out of subbands resulting from division of an entire frequency band into the subbands.

In an embodiment, these pieces of auxiliary information may be information about at least one subband out of the subbands resulting from division of the entire frequency band into the subbands. The method of encoding to be used is an encoding method corresponding to the method used in the aforementioned auxiliary information decoding unit.

In an embodiment, in a quantization process of a power about at least one subband included in the subframe where power changes suddenly, the auxiliary information encoding unit performs quantization of: a power of a core subband included in said at least one subband, the core subband consisting of at least one subband, and a difference between the power of the core subband and a power of a subband other than the core subband. In this case, the auxiliary information about the temporal change of power may further contain: information resulting from quantization of a change of power after the subframe where power changes suddenly.

In an embodiment, the auxiliary information encoding unit may encode the auxiliary information in a length that is different depending upon the indication information indicative of the presence/absence of a sudden change of power.

Since the audio packet error concealment system enables transmission of the information about a sudden power-changing part of a signal using the methods described above, it realizes high-accuracy packet loss concealment of a signal upon occurrence of a sudden temporal change of power (transient signal), which by conventional technologies such packet loss concealment was difficult.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DESCRIPTION OF EMBODIMENTS

Figure 1:
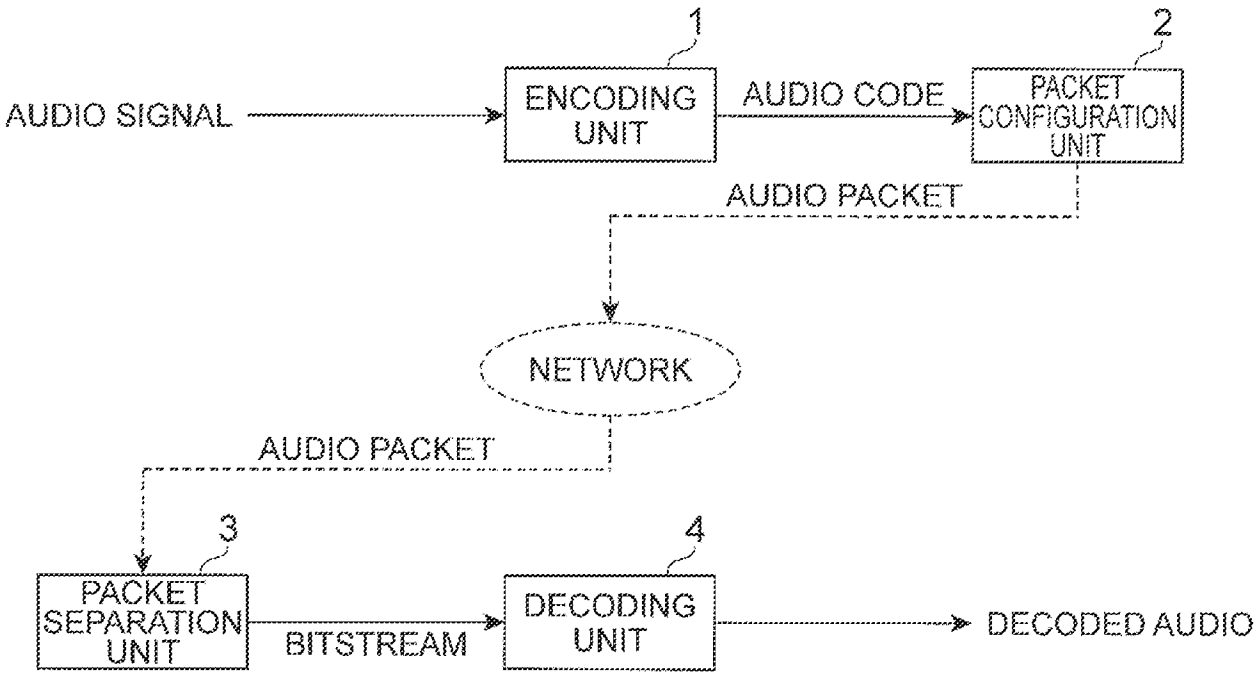
FIG. 1 is a drawing showing an example of an audio packet error concealment system.

"Concealment technologies on the receiver side" and "concealment technologies on the transmitter side," may be described as packet loss concealment technologies to interpolate the audio or acoustic signal in the lost portions due to the packet losses.

The "concealment technologies on the receiver side" can duplicate a decoded audio signal included in a packet normally received in the past, in pitch units, and multiply the duplication by a predetermined attenuation coefficient to generate an audio signal corresponding to a packet loss part. "Concealment technology on the receiver side" can be, for example, similar to the technology described in ITU-T G.711 Appendix I. However, the "concealment technologies on the receiver side" are based on the premise that the property of audio of the packet loss part resembles that of audio immediately before the packet loss, and therefore cannot demonstrate a sufficient concealment effect if the packet loss part has a property different from that of the audio immediately before the loss, or if the power, or the energy of the audio, changes suddenly.

Furthermore, the "concealment technologies on the receiver side" may also include a more advanced technology such as, for example, similar to that of PCT publication WO2007/000988. More advanced technology, such as that of PCT publication WO2007/000988, can be different from the aforementioned technology of ITU-T G.711. For example, while the concealment signal may be generated by duplicating the decoded audio contained in the packet normally received in the past, the duplication may be multiplied by an attenuation coefficient that varies depending upon the property of the duplication source audio (shape of a power spectrum thereof), so as to implement high-quality shaping of the concealment signal with little abnormal sound.

On the other hand, the "concealment technologies on the transmitter side" can, for example, include the technology of Japanese Patent Application Laid-open No. 2003-316670 and the technology of Japanese Patent Application Laid-open No. 2008-111991.

Similar to Japanese Patent Application Laid-open No. 2003-316670, in an example, audio signals contained in packets received in the past without packet loss can be saved in a buffer, and, with a packet loss, encode and transmit as auxiliary information, position information to indicate from which position in the buffer an audio signal should be duplicated. In addition to the position information, amplitude information to indicate whether the packet loss part is a silent interval can also be contained in the auxiliary information, thereby preventing unwanted audio from being mixed in the case where the packet loss part is originally a silent interval.

Similar to Japanese Patent Application Laid-open No. 2008-111991, in an example, a decoding device can include a first concealment device to conceal a packet loss, a second concealment device to correct a first concealment signal output from the first concealment device, based on auxiliary information, and an auxiliary information decoding device to decode the auxiliary information. When the first concealment device fails to demonstrate a satisfactory concealment effect, the second concealment device can correct the first concealment signal, using the auxiliary information generated by the auxiliary information decoding device, to generate a second concealment signal. The auxiliary information to be used may be a power spectrum envelope, or an encoded value of an error between an estimated value from a power spectrum envelope of an adjacent frame and an input power spectrum envelope. The second concealment device can multiply the first concealment signal by a gain in the frequency domain so as to provide the second concealment signal with the power spectrum envelope that can be used as the auxiliary information, to generate the second concealment signal with accuracy higher than the first concealment signal.

When a concealment signal is generated by prediction from a decoded signal normally received in the past, such as similar to Japanese Patent Application Laid-open No. 2003-316670, it is difficult to highly accurately generate the concealment signal with a power change of the audio signal that is significantly different than the prediction result, such as, like generation of "clacks" of castanets as the concealment signal, from a past audio signal that does not include such "clacks."

If the amplitude information about the silent interval on the transmitter side is generated so as to prevent the concealment signal from being generated in the case of the packet loss part being the silent interval, such as similar to Japanese Patent Application Laid-open No. 2003-316670, but fails to demonstrate a satisfactory concealment effect on sound with a sudden power change like the "clacks" of castanets as discussed above.

In an example of a method to perform the processing in the frequency domain after the time-frequency transform into frame units, such as similar to Japanese Patent Application Laid-open No. 2008-111991, the units of processing are the frame units and it is thus difficult to handle a sudden power change within a frame. Since the decoded audio of the packet loss part is recovered with high accuracy on the premise that there is a high correlation between the past signal and the packet loss signal, the correlation of signals becomes lower if the packet loss occurs in a part of the signal where the power changes suddenly. When the power changes suddenly, an increase in a prediction error of the power spectrum envelope results, and it becomes difficult to encode the signal by a small bit count, and to generate the decoded audio with high accuracy.

As described by the above examples, a satisfactory error concealment effect is difficult to achieve on a signal with a temporally quick power change (which will be referred to hereinafter as "transient signal") like hand claps and "clacks" of castanets. Namely, it is extremely difficult for the receiver side to accurately estimate at what timing the transient signal appears in the audio signal, based on the decoded signal obtained by decoding the audio packets normally received immediately before.

An audio packet error concealment system, as described herein, enables high-accuracy concealment of a packet loss in a transient signal, where the prediction from a preceding or following signal is difficult.

Various embodiments of the audio packet error concealment system will be described below using the drawings.

First Embodiment

First, an audio packet error concealment system will be described using FIG. 1. As shown in FIG. 1, an audio signal acquired through a sensor such as a microphone is expressed in digital format and fed to an encoding unit 1.

The encoding unit 1 encodes digital signals in a buffer every time a predetermined amount of audio signals consisting of a predetermined number of samples are saved in a built-in buffer. The foregoing predetermined amount, i.e., the number of samples to be saved is called a frame length and an aggregate of digital signals saved in the buffer is called a frame. For example, in a case where audio is collected at the sampling frequency of 32 kHz and where the frame length is 20 ms, digital signals of 640 samples shall be saved in the buffer. The length of the buffer may be longer than one frame. For example, when the length of the buffer is set to that of two frames, encoding at the beginning is started only after digital signals of two frames have been saved in the buffer, whereby the digital signal of the next frame to the frame as an encoding target can be used for estimation of auxiliary information. The timing of execution of encoding may be determined so as to execute encoding in units of the frame length, or so as to execute encoding with an overlap of a certain length between frames. The encoding is performed using audio encoding such as 3GPP enhanced aacPlus and G718. It should be noted that any method may be applicable as to the method of audio encoding. The auxiliary information is calculated using an audio or acoustic signal saved in the buffer for calculation of auxiliary information, and then is encoded and transmitted (auxiliary information code). The auxiliary information code may be transmitted in the same packet as an audio code, or may be transmitted in another packet different from a packet containing the audio code. The details of the operation of the encoding unit 1 will be described later.

A packet configuration unit 2 adds information necessary for communication such as an RTP header to the audio code acquired by the encoding unit 1, to generate an audio packet. The audio packet thus generated is sent through a network to a receiver.

A packet separation unit 3 separates the audio packet received through the network, into the packet header information and the other part (the audio code and auxiliary information code, which will be referred to hereinafter as "bitstream") and outputs the bitstream to a decoding unit 4.

The decoding unit 4 performs decoding of the audio code contained in the audio packet received normally, and, if it detects an abnormality (a packet error or a packet loss) in the received audio packet, it performs packet loss concealment. The detailed operation of the decoding unit 4 will be described in the below embodiment. The decoded audio output from the decoding unit 4 is sent to a buffer of audio or the like to be reproduced through a speaker or the like, or stored in a recording medium such as a memory or a hard disk.

Each unit described herein, such as the encoding unit 1, the packet configuration unit 2, the packet separation unit 3, and the decoding unit 4 is hardware, or a combination of hardware and software. For example, each unit may include and/or initiate execution of an application specific integrated circuit (ASIC), a Field Programmable Gate Array (FPGA), a circuit, a digital logic circuit, an analog circuit, a combination of discrete circuits, gates, or any other type of hardware, or combination thereof. Alternatively or in addition, each unit can include memory hardware, such as at least a portion of a memory, for example, that includes instructions executable with a processor to implement one or more of the features of the unit. When any one of the units includes instructions stored in memory and executable with the processor, the unit may or may not include the processor. In some examples, each unit may include only memory storing instructions executable with a processor to implement the features of the corresponding unit without the unit including any other hardware. Because each unit includes at least some hardware, even when the included hardware includes software, each unit may be interchangeably referred to as a hardware unit, such as the encoding hardware unit, the packet configuration hardware unit, the packet separation hardware unit, and the decoding hardware unit. Since the overall configuration in FIG. 1 described above is also applied similarly to the second to sixth embodiments described below, redundant description of the overall configuration will be omitted in the second to sixth embodiments.

Now, the encoding unit 1 and the decoding unit 4 will be described below in detail as characteristic portions of the first embodiment. The first embodiment will describe an example in which a parameter obtained by a functional approximation of powers of subframes shorter than one frame is used as auxiliary information about a temporal change of power.

(Configuration and Operation of Encoding Unit 1)

Figure 2:
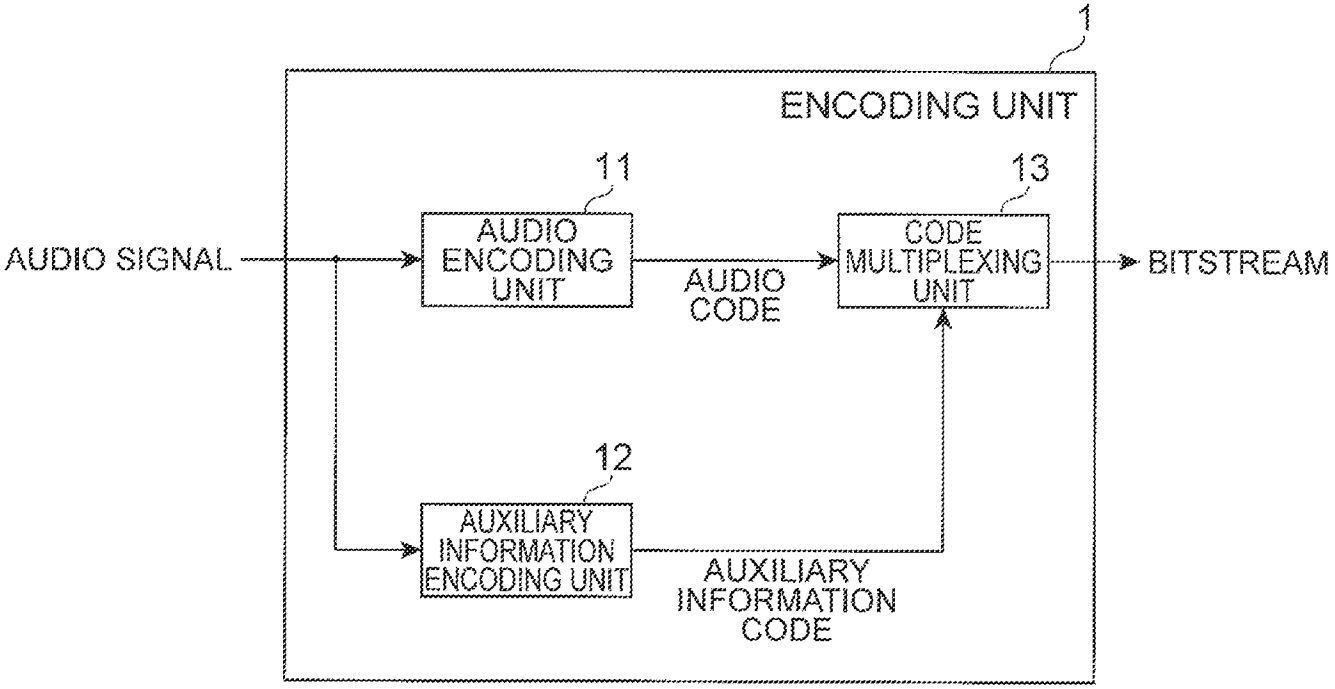
FIG. 2 is a configuration diagram of an example of an encoding unit in the first, second, third, and sixth embodiments.

As shown in FIG. 2, the encoding unit 1 is provided with an audio encoding unit 11 to encode an audio signal, an auxiliary information encoding unit 12 to estimate and encode auxiliary information about a temporal change of power of the audio signal, which is used in packet loss concealment in decoding of the audio signal, and a code multiplexing unit 13 to multiplex an auxiliary information code obtained in encoding by the auxiliary information encoding unit 12 and an audio code obtained in encoding by the audio encoding unit 11, and output a bitstream of multiplex data.

Figure 4:
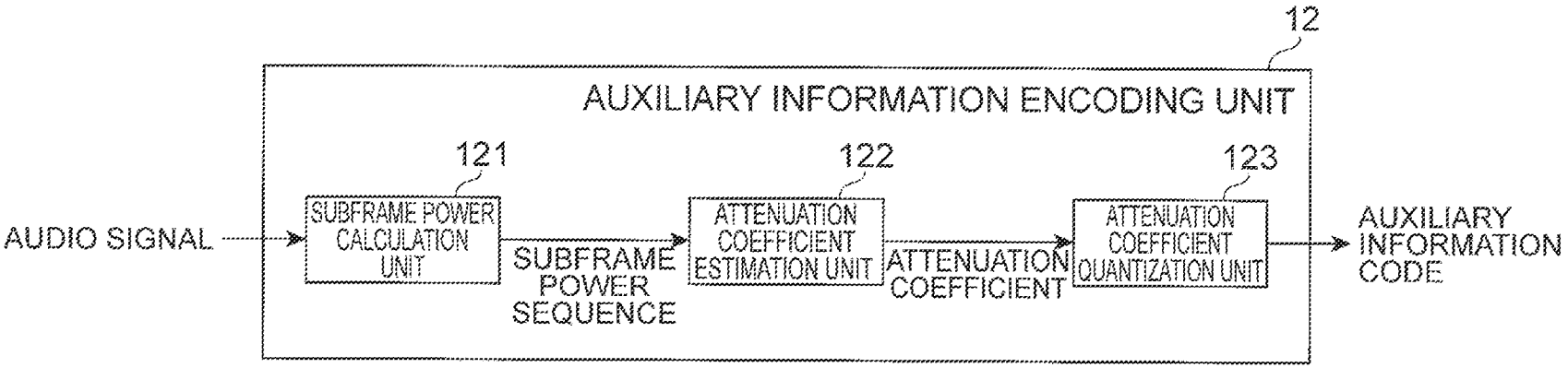
FIG. 4 is a configuration diagram of an example of an auxiliary information encoding unit in the first embodiment and others.

The auxiliary information encoding unit 12 of these units, as shown in FIG. 4, is provided with a subframe power calculation unit 121, an attenuation coefficient estimation unit 122, and an attenuation coefficient quantization unit 123 which will be described later.

Example operation of the encoding unit 1 will be described below using FIG. 3.

Figure 3:
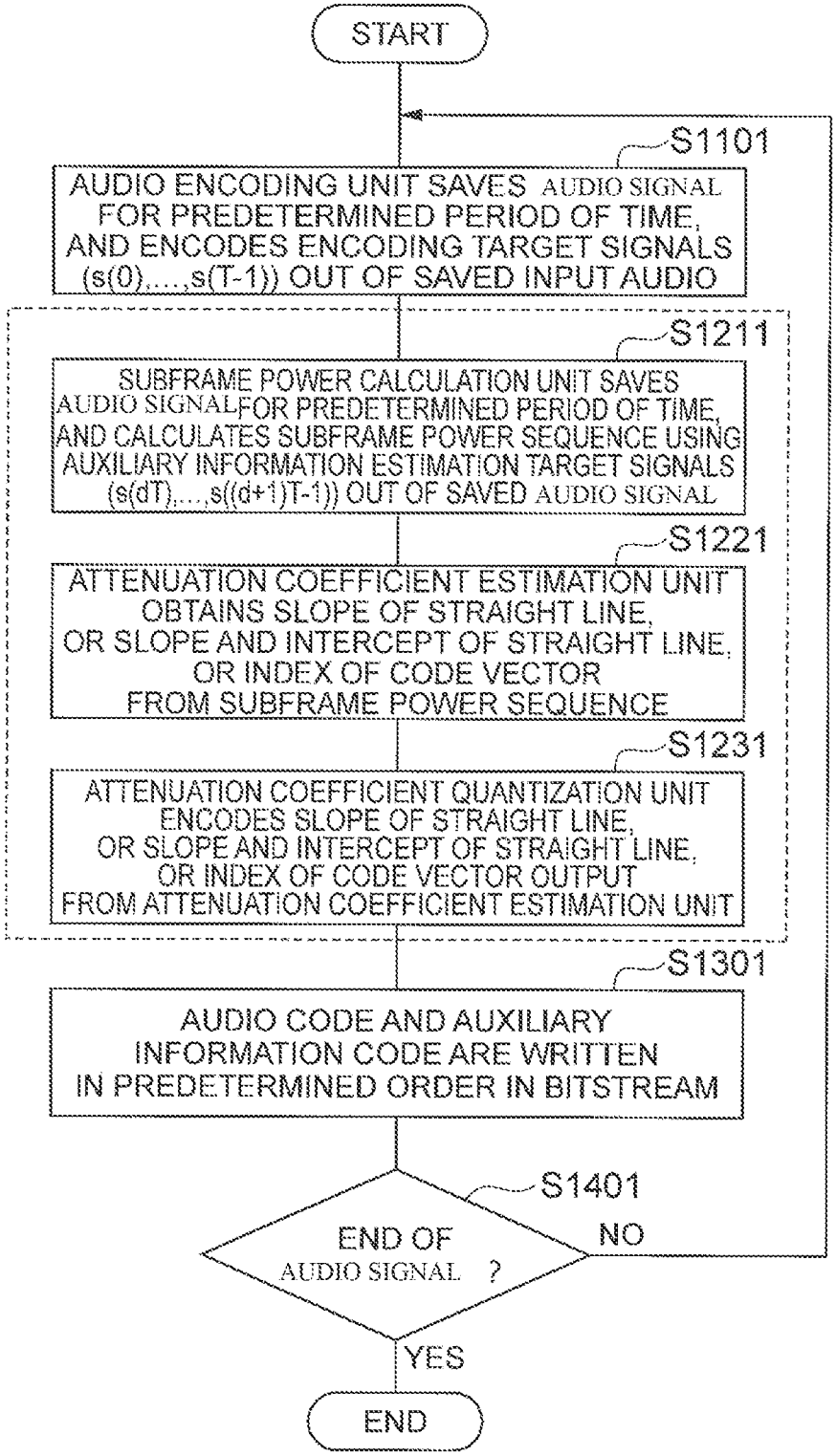
FIG. 3 is a flowchart of example processing by the encoding unit in FIG. 2.

The audio encoding unit 11 saves audio signal for a predetermined period of time and encodes a signal of an encoding target out of the saved audio signal (step S1101 in FIG. 3). The encoding may be performed, for example, using the audio encoding such as 3GPP enhanced aacPlus defined in Literature "3GPP TS26.401 'Enhanced aacPlus general audio codec General description'" and G.718 defined in Literature "Recommendation ITU-T G.718 'Frame error robust narrow-band and wideband embedded variable bit-rate coding of speech and audio from 8-32 kbit/s'", or using any other encoding method.

The subframe power calculation unit 121 in the auxiliary information encoding unit 12 saves the audio signal for a predetermined period of time and later calculates a subframe power sequence for audio signals s(dT), s(1+dT), . . . , s((d+1)T−1) out of the saved audio signal. The calculation may occur later than encoding of target signals s(0), s(1), . . . , s(T−1) by a predetermined number of frames (d frames in the present embodiment) (step S1211 in FIG. 3). The number of samples contained in one frame is defined as T herein. When a prediction target signal is defined by the following formula:

$$v(K\cdot l+k)=s(K\cdot l+k+dT),$$

a power P(l) of a subframe 1 (0≤l≤L−1) is obtained by the formula below. The letter k represents an index of a sample in each subframe (0≤k≤K−1). It is assumed herein that the number of samples in a digital signal in each subframe is K.

$$P(l) = 10\log_{10}\left(\frac{1}{K}\sum_{k=0}^{K-1} v^2(K\cdot l+k)\right)$$

Although it is assumed in this first embodiment that the length of subframes is K, it is also possible to use different lengths determined in advance for the respective subframes. The subframe power sequence may be calculated according to the following formula, where $k^l_{start}$ represents an index of a start of the lth subframe and $k^l_{end}$ represents an index of an end thereof.

$$P(l) = 10\log_{10}\left(\frac{1}{k^l_{end}-k^l_{start}}\sum_{k=k^l_{start}}^{k^l_{end}} v^2(k^{l-1}_{end}+k)\right)$$

The attenuation coefficient estimation unit 122 acquires from the subframe power sequence a slope $\gamma_{opt}$ of a straight line representing a temporal change of power for example, by the least square method or the like (step S1221 in FIG. 3). More simply, the slope may be calculated from P(0) and P(L−1). In this example, the letter L represents the number of subframes contained in one frame. In other examples, the letter L may represent the number of subframes in a part of a frame, such as two subframes in half of a frame. In addition to the slope $\gamma_{opt}$ of the straight line, an intercept $P_{opt}$ may be calculated by a straight-line approximation of the subframe power sequence P(l).

The power of subframe m is expressed herein by the following formula.

$$\hat{P}(m)=\gamma_{opt}\cdot m+P_{opt}$$

At this time, the slope $\gamma_{opt}$ and intercept $P_{opt}$ of the straight line are acquired in accordance with the following formulas (the least square method).

$$\gamma_{opt} = \frac{L\sum_{m=0}^{L-1} m\cdot P(m) - \sum_{m=0}^{L-1} m\sum_{m=0}^{L-1} P(m)}{L\sum_{m=0}^{L-1} m^2 - \left(\sum_{m=0}^{L-1} m\right)^2}$$

$$P_{opt} = \frac{\sum_{m=0}^{L-1} m^2\sum_{m=0}^{L-1} P(m) - \sum_{m=0}^{L-1} m\cdot P(m)\sum_{m=0}^{L-1} P(m)}{L\sum_{m=0}^{L-1} m^2 - \left(\sum_{m=0}^{L-1} m\right)^2}$$

The attenuation coefficient quantization unit 123 performs scalar quantization of the slope $\gamma_{opt}$ of the straight line, then encodes the quantized data, and outputs the auxiliary information code (step S1231 in FIG. 3). It may use a scalar quantization codebook prepared in advance. In the case of the straight-line approximation of subframe powers P(l), the intercept $P_{opt}$ may also be encoded in addition to the slope $\gamma_{opt}$ of the straight line.

Figure 5:
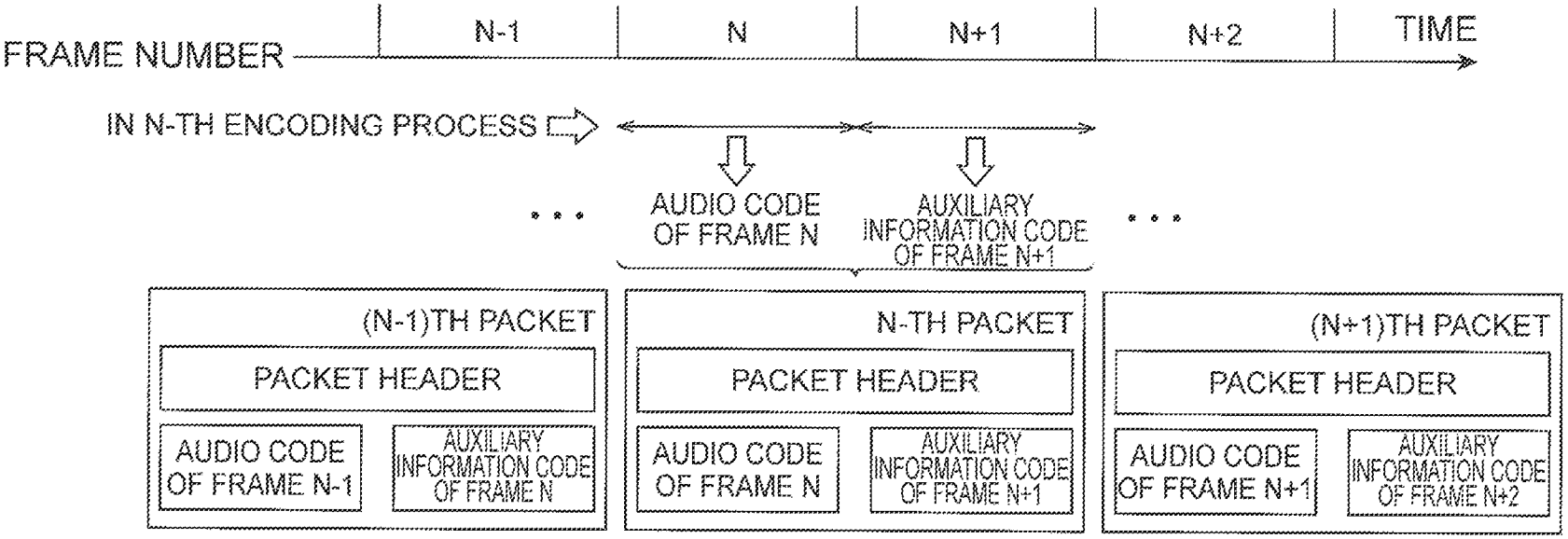
FIG. 5 is a drawing showing an example of a temporal relation between signals as audio encoding targets and signals as auxiliary information encoding targets, and a configuration example of bitstreams.

The code multiplexing unit 13 writes the audio code and the auxiliary information code in a predetermined order in a bitstream and outputs the bitstream (step S1301 in FIG. 3). FIG. 5 shows an example of the temporal relationship between signals as audio encoding targets and signals as auxiliary information encoding targets, and a configuration of bitstreams (in the case of d=1). For example, as shown in FIG. 5, the auxiliary information code of frame (N+1), for example, is added to the audio code of frame N to obtain a bitstream, which is output from the code multiplexing unit 13. Furthermore, the packet configuration unit 2 adds the packet header information to the bitstream to obtain an audio packet to be transmitted as the N-th packet.

The above processing of steps S1101 to S1301 is repeated to an end of the audio signal (step S1401).

(Configuration and Operation of Decoding Unit 4)

Figure 6:
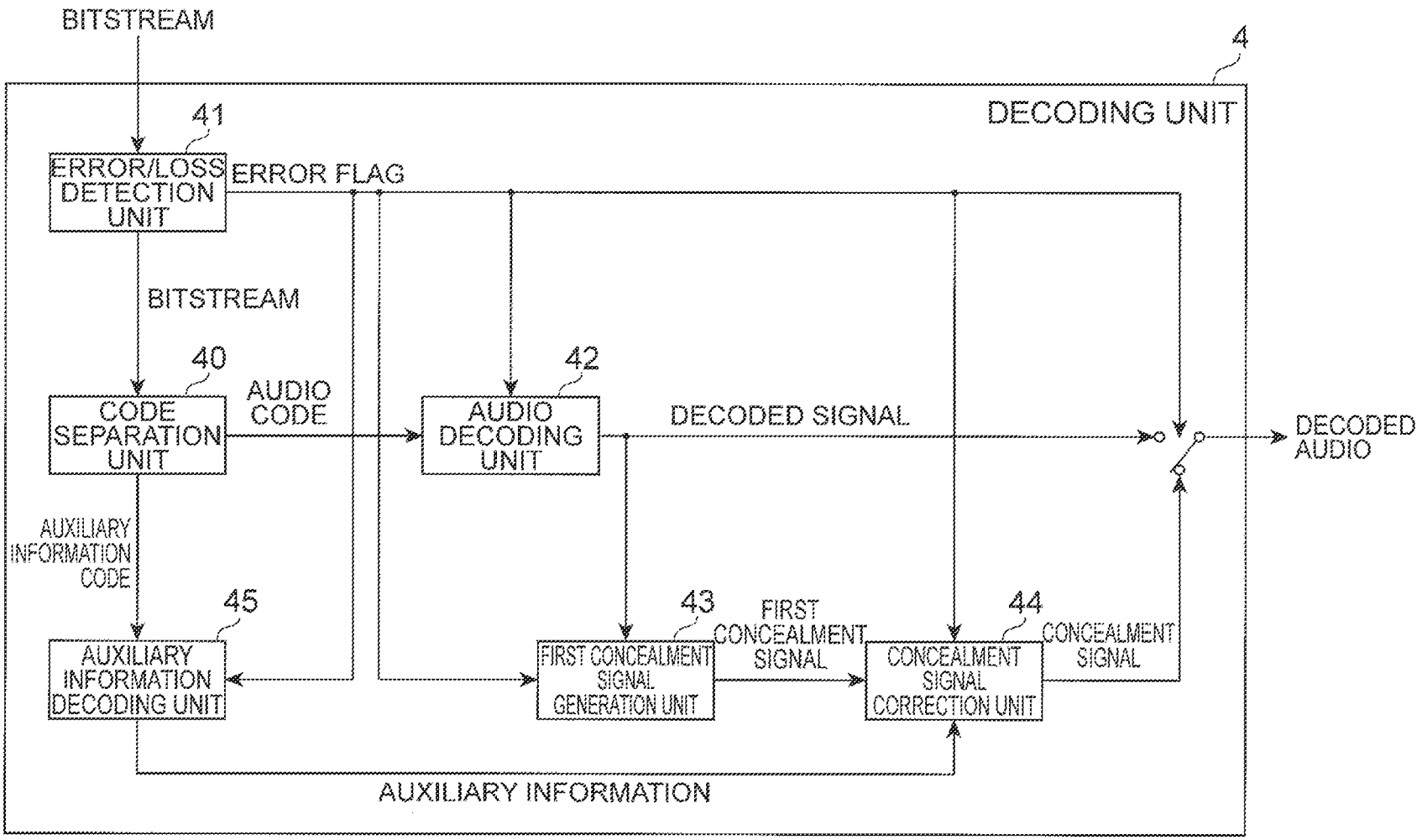
FIG. 6 is a configuration diagram of an example of a decoding unit in the first, second, third, fifth, and sixth embodiments.
Figure 11:
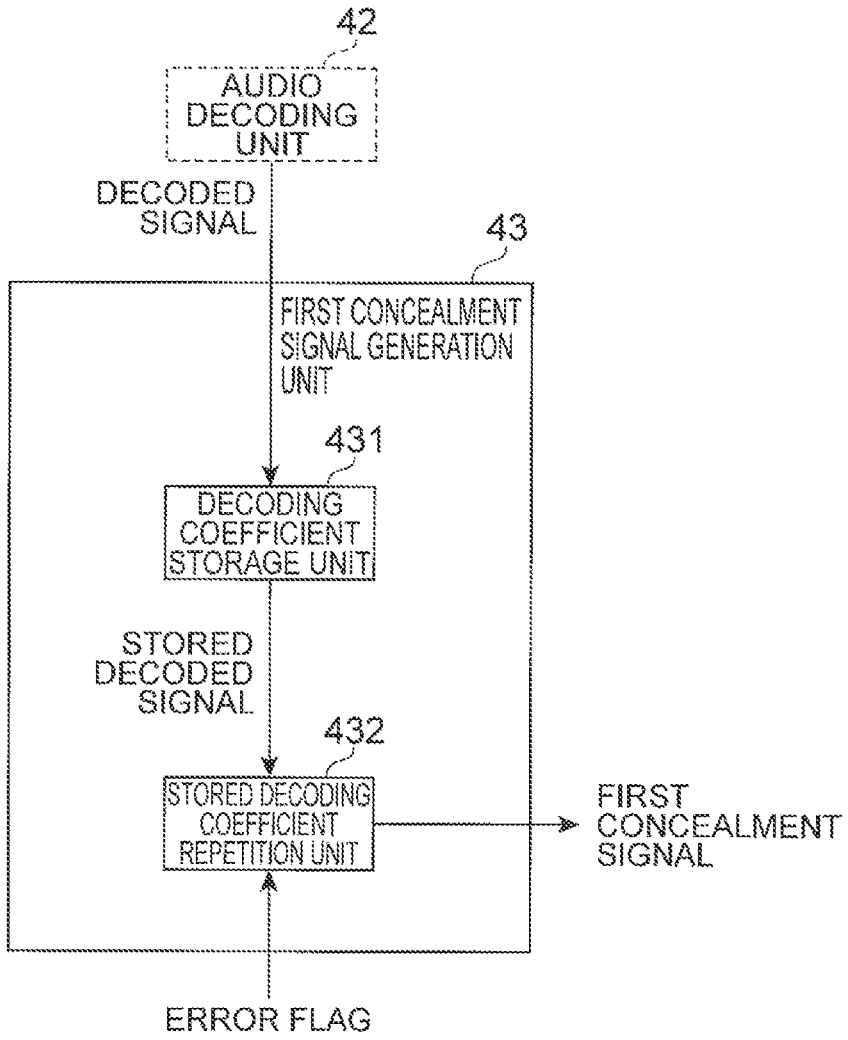
FIG. 11 is a drawing showing an example of a configuration of a first concealment signal generation unit.
Figure 12:
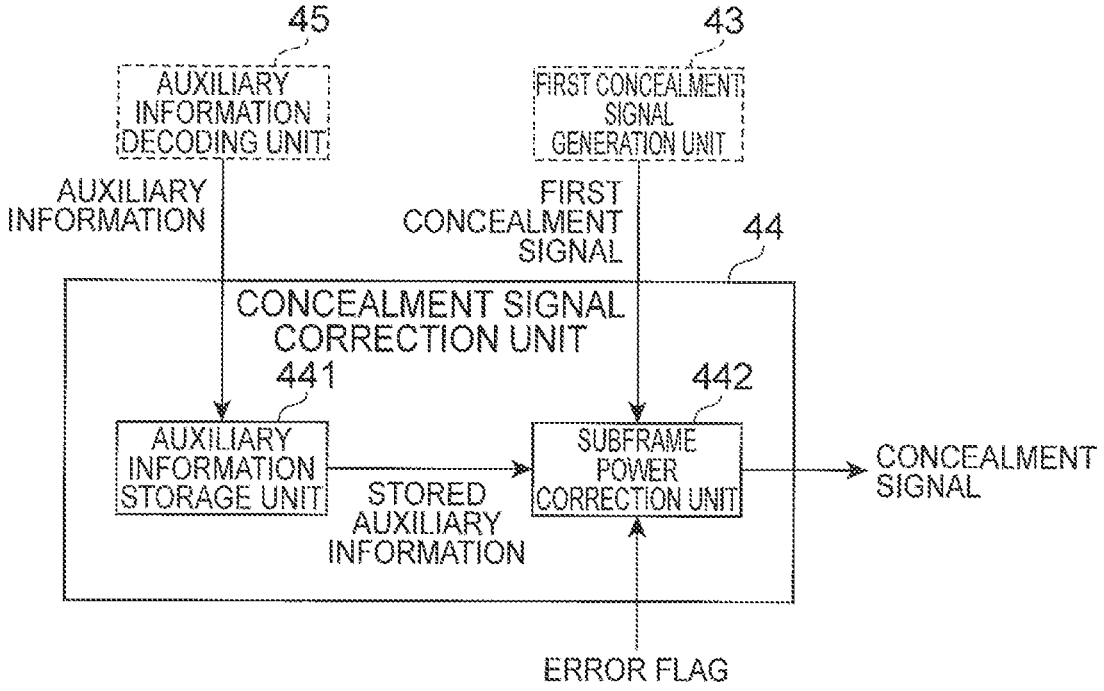
FIG. 12 is a drawing showing an example of a configuration of the concealment signal correction unit.

As shown in FIG. 6, the decoding unit 4 is provided with an error/loss detection unit 41, a code separation unit 40, an audio decoding unit 42, an auxiliary information decoding unit 45, a first concealment signal generation unit 43, and a concealment signal correction unit 44. The first concealment signal generation unit 43 of these units, as shown in FIG. 11, is provided with a decoding coefficient storage unit 431 and a stored decoding coefficient repetition unit 432. The concealment signal correction unit 44, as shown in FIG. 12, is provided with an auxiliary information storage unit 441 and a subframe power correction unit 442.

Example operation of the decoding unit 4 will be described below using FIGS. 6 and 7.

Figure 7:
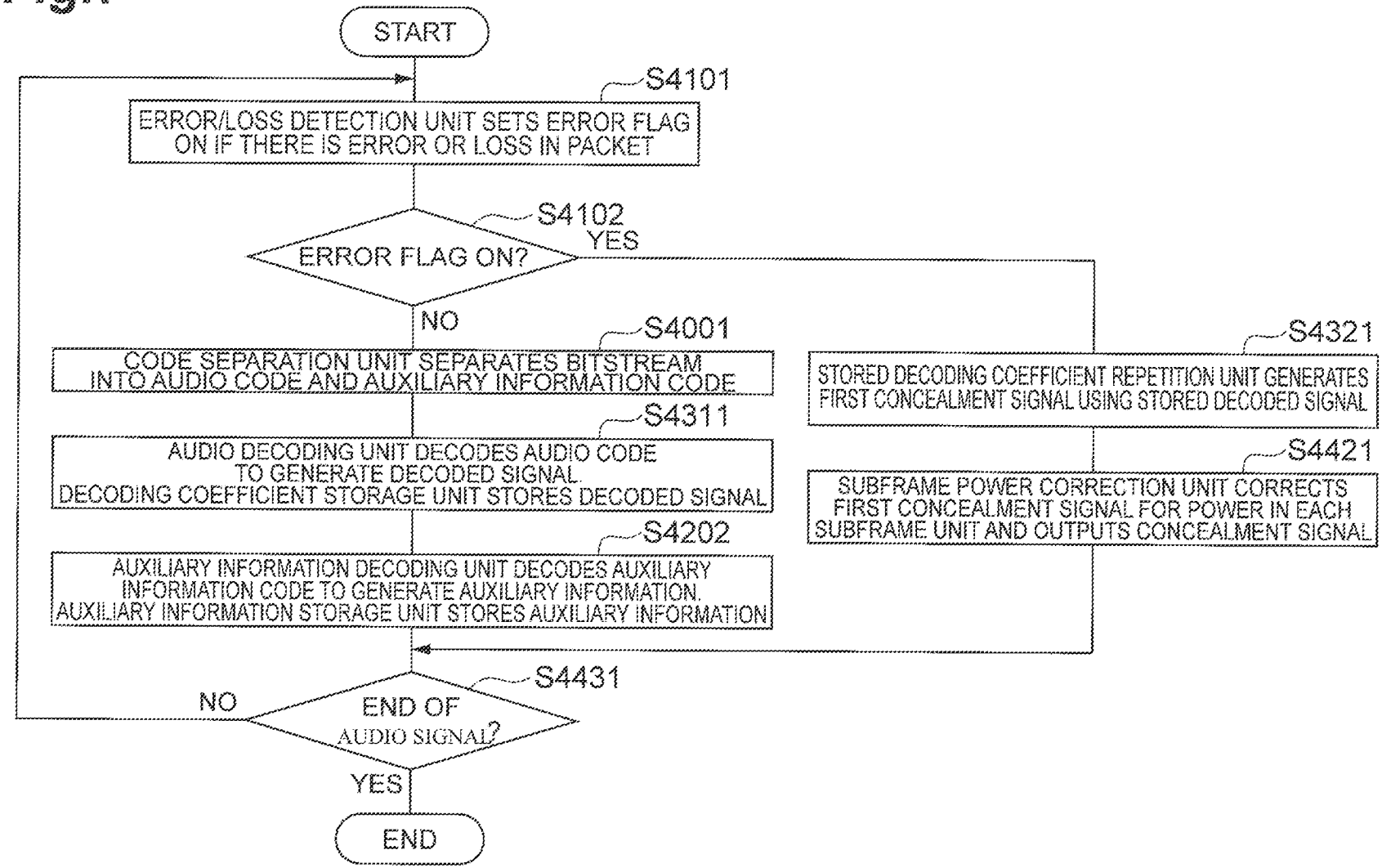
FIG. 7 is a flowchart of example processing by the decoding unit in FIG. 6.

The error/loss detection unit 41 detects an abnormality (a packet error or a packet loss) in a received audio packet and outputs an error flag indicative of the result of the detection (step S4101 in FIG. 7). The error flag is set off to indicate the normality of packet by default and, when the error/loss detection unit 41 detects an abnormality in the received audio packet, it sets the error flag on (to indicate the packet abnormality). For example, the error/loss detection unit 41 is provided with a counter that increases one for every reception of a new packet, and, when packets are assumed to be numbered in an order of transmission from the encoder, the error/loss detection unit 41 can compare a counter value with a number given to a packet to detect a packet loss if these values are different. It should be, however, noted that the packet loss detection method in the error/loss detection unit 41 described herein is just an example and the packet loss may be detected by any other method.

The example operation will be described below in each of the case of the error flag being on (packet abnormality) and the case of the error flag being off (packet normality).

(Case of Error Flag Being Off (Case of NO in Step S4102 in FIG. 7))

The error/loss detection unit 41 sends the error flag to the audio decoding unit 42, the first concealment signal generation unit 43, the concealment signal correction unit 44, and the auxiliary information decoding unit 45 and sends the bitstream to the code separation unit 40.

The code separation unit 40 receives the bitstream from the error/loss detection unit 41, separates the bitstream into the audio code and the auxiliary information code, and sends the audio code to the audio decoding unit 42 and the auxiliary information code to the auxiliary information decoding unit 45 (step S4001 in FIG. 7).

The audio decoding unit 42 decodes the audio code to generate a decoded signal and outputs it as decoded audio. The decoding of audio code is performed using a decoding method corresponding to the aforementioned audio encoding unit 11. At this time, the audio decoding unit 42 also sends the decoded signal to the first concealment signal generation unit 43 (step S4311 in FIG. 7). At this time, the first concealment signal generation unit 43 stores the sent decoded signal into the decoding coefficient storage unit 431 shown in FIG. 11. The stored decoded signal in storage therein is denoted by b(k, l). The stored signal may be at least d or more past frames. The letter k herein represents an index of a sample in a subframe (provided that $0 \le k \le K-1$) and the letter l an index of a subframe stored in the decoding coefficient storage unit 431 (provided that $0 \le l \le dL-1$).

The auxiliary information decoding unit 45 decodes the auxiliary information code output from the code separation unit 40, to generate the auxiliary information, and then sends the auxiliary information to the concealment signal correction unit 44 (step S4202 in FIG. 7). At this time, the concealment signal correction unit 44 stores the auxiliary information into the auxiliary information storage unit 441 shown in FIG. 12. The auxiliary information stored at this time is preferably that of several past frames (that of at least d frames or more).

In above step S4202 the auxiliary information decoding unit 45 decodes the auxiliary information code output from the code separation unit 40, to generate an index, and obtains a slope $\gamma_J$ of a straight line corresponding to the index from a codebook. Here, P(−1) represents a power of the last subframe in a signal received normally immediately before a frame loss.

$$\hat{P}(m)=\gamma_J \cdot m+P(-1)$$

In the case where an intercept of the straight line is simultaneously encoded by a straight-line approximation of powers of subframes, the subframe power is obtained by the following formula using the intercept $P_J$.

$$\hat{P}(m)=\gamma_J \cdot m+P_J$$

(Case of Error Flag Being On (Case of YES in Step S4102 in FIG. 7))

The error/loss detection unit 41 sends the error flag to the audio decoding unit 42, the first concealment signal generation unit 43, the concealment signal correction unit 44, and the auxiliary information decoding unit 45.

The stored decoding coefficient repetition unit 432 in the first concealment signal generation unit 43 obtains a first concealment signal z(k) using a stored decoding signal stored in the decoding coefficient storage unit 431 (step S4321 in FIG. 7). Specifically, it calculates the first concealment signal by repetition of the last subframe, for example, as expressed by the following formula.

$$z(K \cdot l+k)=b(k,dL-1)$$

(provided that $0 \le l \le dL-1$ and $0 \le k \le K-1$)

It should be noted herein that the unit of repetition does not have to be limited to the last subframe but instead any part of b(k, l) may be extracted and repeated. Generation of the first concealment signal is not limited to the repetition as described above, and instead the first concealment signal may be calculated by extracting and repeating a waveform in a pitch unit from the decoding coefficient storage unit 431 or the first concealment signal may be generated by a prediction, for example, using the linear prediction. Alternatively, the first concealment signal may be generated in accordance with a model determined in advance, for example, as shown below.

$$[z(K\cdot(L-1)), \ldots, z(K\cdot L-1)]=f(b(0,0),b(1,0) \ldots ,b(K-1,dL-1))$$

The subframe power correction unit 442 corrects the first concealment signal for a value of power of the first concealment signal in each of the subframes in accordance with the formula below to acquire a concealment signal y(K·l+k). Specifically, it performs the correction according to the below formula (provided that 0≤l≤L−1 and 0≤k≤K−1). In the formula, $P^{-d}(m)$ represents a power about a subframe contained in the auxiliary information code transmitted in the d-th packet before the packet (packet as a first concealment signal generation target) (step S4421 in FIG. 7).

$$\hat{P}(m) = P^{-d}(m)$$

$$z'(K\cdot l+k) = \frac{z(K\cdot l+k)}{\sqrt{\frac{1}{K}\sum_{k=0}^{K-1} z^2(K\cdot l+k)}}$$

$$y(K\cdot l+k) = 10^{\hat{P}(m)/20}\cdot z'(K\cdot l+k)$$

Figure 8:
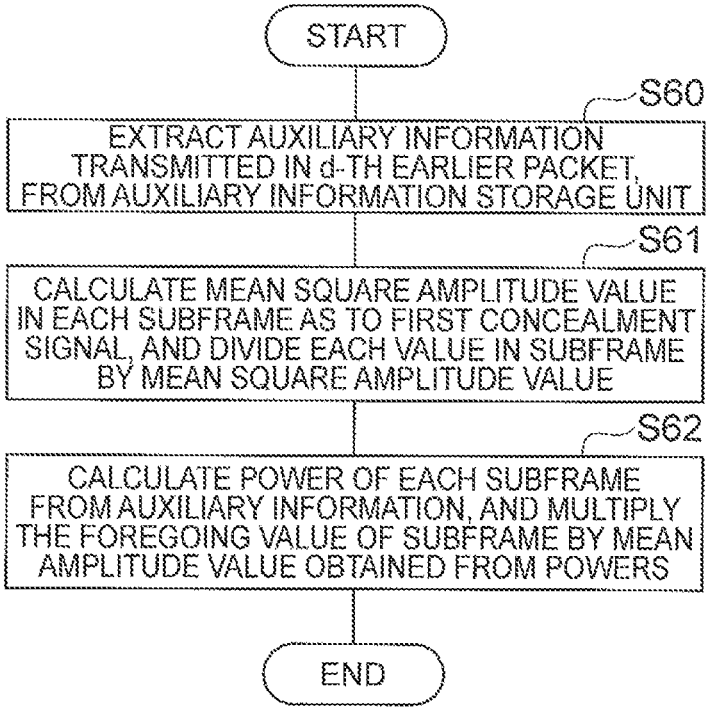
FIG. 8 is a flowchart showing an example of processing by a concealment signal correction unit.

For example, the subframe power correction unit 442, as shown in FIG. 8, extracts the auxiliary information previously transmitted in the d-th packet, from the auxiliary information storage unit 441 (step S60 in FIG. 8), calculates a mean square amplitude value for each subframe as to the first concealment signal, and divides a value contained in each subframe, by the mean square amplitude value (step S61 in FIG. 8). This operation results in obtaining z'(K·l+k). Then it calculates a power of each subframe from the auxiliary information and multiplies the foregoing value of the subframe by a mean amplitude value obtained from the power (step S62 in FIG. 8). This multiplication results in obtaining the concealment signal y(K·l+k).

The above processing of steps S4101 to S4421 in FIG. 7 is repeated to the end of the audio signal (step S4431 in FIG. 7).

As described above, the first embodiment can use the parameter obtained by the functional approximation of powers of subframes shorter than one frame, as the auxiliary information about the temporal change of power.

Second Embodiment

The auxiliary information may be auxiliary information obtained by encoding a subframe power sequence by vector quantization using preliminarily-learned or empirically-determined vectors $c_i(l)$. The second embodiment will describe an example of encoding or decoding, using as the auxiliary information, information about a vector obtained by vector quantization of powers of subframes, in the auxiliary information encoding unit 12 or in the auxiliary information decoding unit 45 in the first embodiment.

Since the second embodiment is different only in the auxiliary information encoding unit 12 and the auxiliary information decoding unit 45 from the first embodiment, these two elements will be described below.

Figure 9:
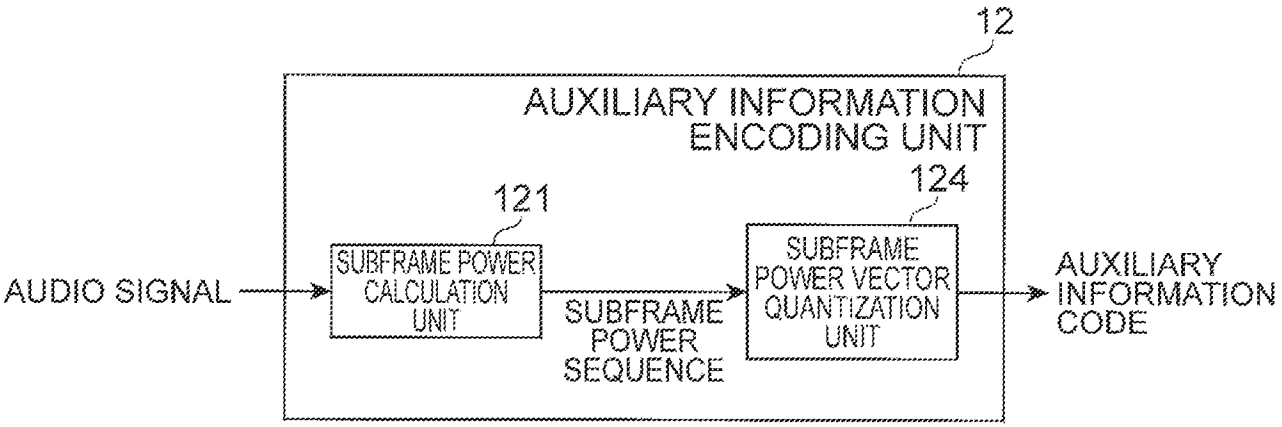
FIG. 9 is a drawing showing an example of a configuration of the auxiliary information encoding unit.

The auxiliary information encoding unit 12, as shown in FIG. 9, is provided with the subframe power calculation unit 121 and a subframe power vector quantization unit 124. The function and operation of the subframe power calculation unit 121 is the same as in the first embodiment.

The subframe power vector quantization unit 124 performs vector quantization of powers P(l) of subframes 1 (provided that 0≤l≤L−1), encodes the result, and outputs the auxiliary information code. The letter I represents the number of entries of straight lines or vectors in a codebook and the letter J represents an index of a straight line or a vector selected. $c_i(l)$ represents the lth element of the ith code vector in the codebook.

$$J = \underset{i=0,\ldots,I-1}{\operatorname{argmin}} \sum_{l=0}^{L-1} (c_i(l) - P(l))^2$$

Selected J is encoded by binary encoding to obtain the auxiliary information code.

On the other hand, the auxiliary information decoding unit 45 decodes the auxiliary information code output from the code separation unit 40, to generate the index J, obtains a vector $c_J(l)$ corresponding to the index J from the codebook, and outputs it.

$$\hat{P}(m)=c_J(l)$$

As described above, the second embodiment involves the encoding of the subframe power sequence by vector quantization using the preliminarily-learned or empirically-determined vectors, and uses the result as the auxiliary information.

Third Embodiment

The calculation of the auxiliary information in above-described first and second embodiments used a signal that is later by d or more frames than the signal encoded by the audio encoding unit 11, whereas the below third embodiment will describe an example in which a signal that is earlier by d frames than the signal encoded by the audio encoding unit 11 is used in the calculation of the auxiliary information.

Since the following third embodiment is different from the first embodiment only in the subframe power calculation unit 121 included in the auxiliary information encoding unit 12, and the subframe power correction unit 442 included in the concealment signal correction unit 44, the subframe power calculation unit 121 and subframe power correction unit 442 will be described below.

The subframe power calculation unit 121 saves audio signal for a predetermined period of time and the subframe power sequence for audio signals s(−dT), s(1−dT), . . . , s(−1) is calculated earlier by a predetermined number of frames (d frames in the present embodiment) than the encoding of target signals s(0), s(1), . . . , s(T−1) out of the saved audio signal. It is assumed herein that the number of samples contained in one frame is T. When a prediction target signal is expressed by the following formula:

$$v(K\cdot l+k)=s(K\cdot l+k+dT),$$

the power P(l) of subframe 1 (0≤l≤L−1) is obtained by the formula below. The letter k represents an index of a sample in a subframe (0≤k≤K−1). It is assumed herein that the number of samples of digital signals contained in each subframe is K.

$$P(l) = 10\log_{10}\left(\frac{1}{K}\sum_{k=0}^{K-1} v^2(K \cdot l + k)\right)$$

On the other hand, the subframe power correction unit 442 corrects the first concealment signal for a value of power of the first concealment signal in each subframe in accordance with the formula below to obtain the concealment signal y(K·l+k). Specifically, it performs the correction in accordance with the below formula (provided that 0≤l≤L−1 and 0≤k≤K−1). $P^d(m)$ represents the power about the subframe contained in the auxiliary information code transmitted in the d-th packet after the pertinent packet (packet of a first concealment signal generation target).

$$\hat{P}(m) = P^d(m)$$

$$z'(K \cdot l + k) = \frac{z(K \cdot l + k)}{\sqrt{\frac{1}{K}\sum_{k=0}^{K-1} z^2(K \cdot l + k)}}$$

$$y(K \cdot l + k) = 10^{\hat{P}(m)/20} \cdot z'(K \cdot l + k)$$

As described above, the third embodiment allows use of the signal earlier by several frames than the signal encoded by the audio encoding unit for the calculation of the auxiliary information.

Fourth Embodiment

The fourth embodiment will describe an example in which the processing as executed in the first and second embodiments is applied to signals resulting from time-frequency transform.

Figure 10:
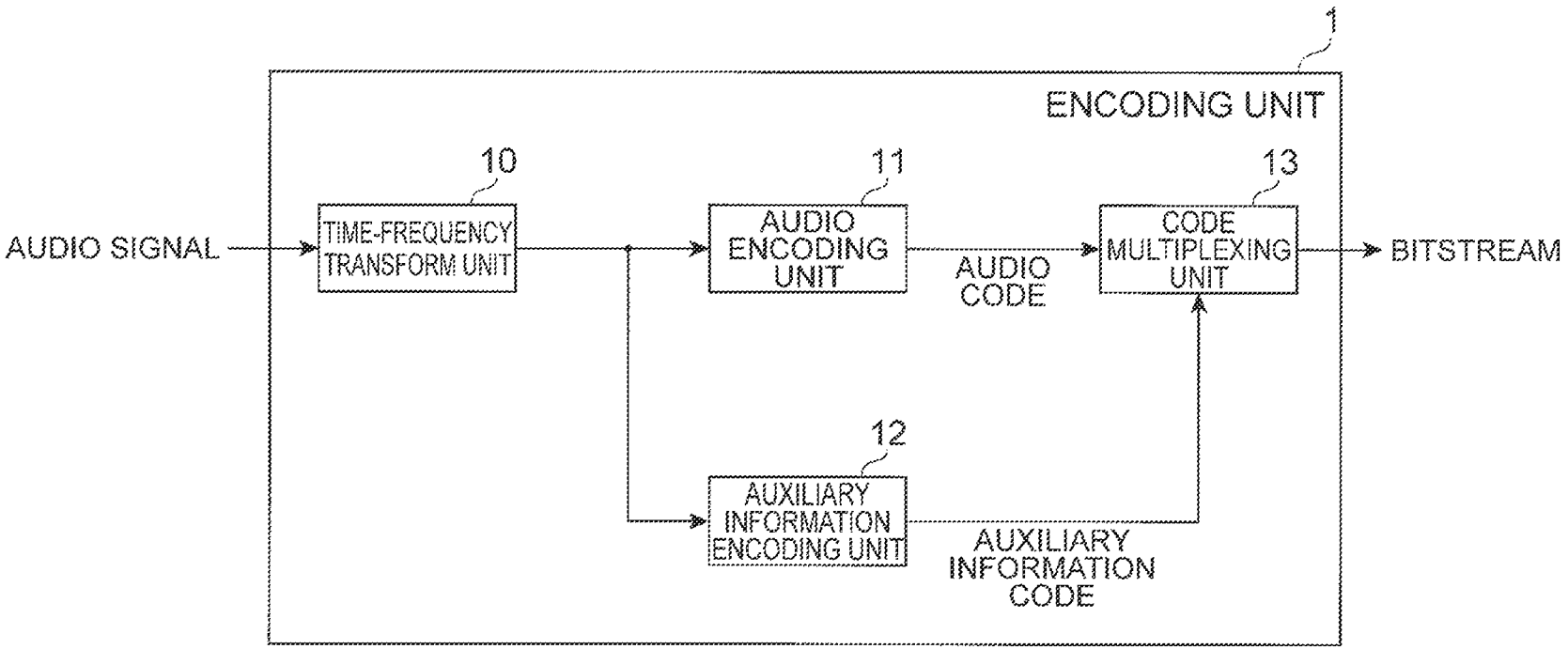
FIG. 10 is a configuration diagram of an example of the encoding unit in the fourth and fifth embodiments.

The encoding unit 1 in the fourth embodiment has a configuration, as shown in FIG. 10, in which a time-frequency transform unit 10 is added to the input side of the audio encoding unit 11 and the auxiliary information encoding unit 12, in comparison to the encoding unit 1 (FIG. 2) in the first and second embodiments.

The time-frequency transform unit 10 performs a time-frequency transform of an audio signal using an analysis QMF. Specifically, it performs the time-frequency transform by the following formula.

$$V(k, l) = \sum_{n=-E \cdot K}^{2K-1} p_A(n) \cdot x(n) \cos\left[\frac{\pi}{K}\left(n + \frac{1}{2} - \frac{K}{2}\right)\left(k + \frac{1}{2}\right)\right]$$

In this formula, the letter E represents the number of subframes in the time direction and the letter K represents the number of frequency bins. The letter k represents an index of a frequency bin (provided that 0≤k≤K−1) and the letter l represents an index of a subframe (provided that 0≤l≤L−1). As an alternative to the analysis QMF, the time-frequency transform can also be executed by MDCT (Modified Discrete Cosine Transform) or the like.

The audio encoding unit 11 encodes the audio signal resulting from the time-frequency transform. For example, it may perform the encoding by an encoding method, for example, such as SBR (Spectral Band Replication), but the encoding may be executed by any encoding method.

The auxiliary information encoding unit 12, as shown in FIG. 4, is provided with the subframe power calculation unit 121, attenuation coefficient estimation unit 122, and attenuation coefficient quantization unit 123. Since only the subframe power calculation unit 121 of these constituent elements is different from that in the first and second embodiments, the subframe power calculation unit 121 will be described below. The attenuation coefficient quantization unit 123 may employ the vector quantization as described in the second embodiment.

The subframe power calculation unit 121 saves the audio signal for a predetermined period of time, and calculates the auxiliary information out of the saved audio signal as described below, using an audio signal V(k, l+d) obtained by transforming into the time-frequency domain an audio signal that is later by a predetermined number of frames (d frames) than the encoding of the target signal V(k, l). The power P(l+d) of subframe l+d is calculated by the following formula.

$$P(l + d) = 10\log_{10}\left(\frac{1}{K}\sum_{k=0}^{K-1} V^2(k, l + d)\right)$$

The code multiplexing unit 13 writes the audio code and the auxiliary information code in a predetermined order, in the same manner as in the first and second embodiments, and outputs the resulting bitstream.

Figure 13:
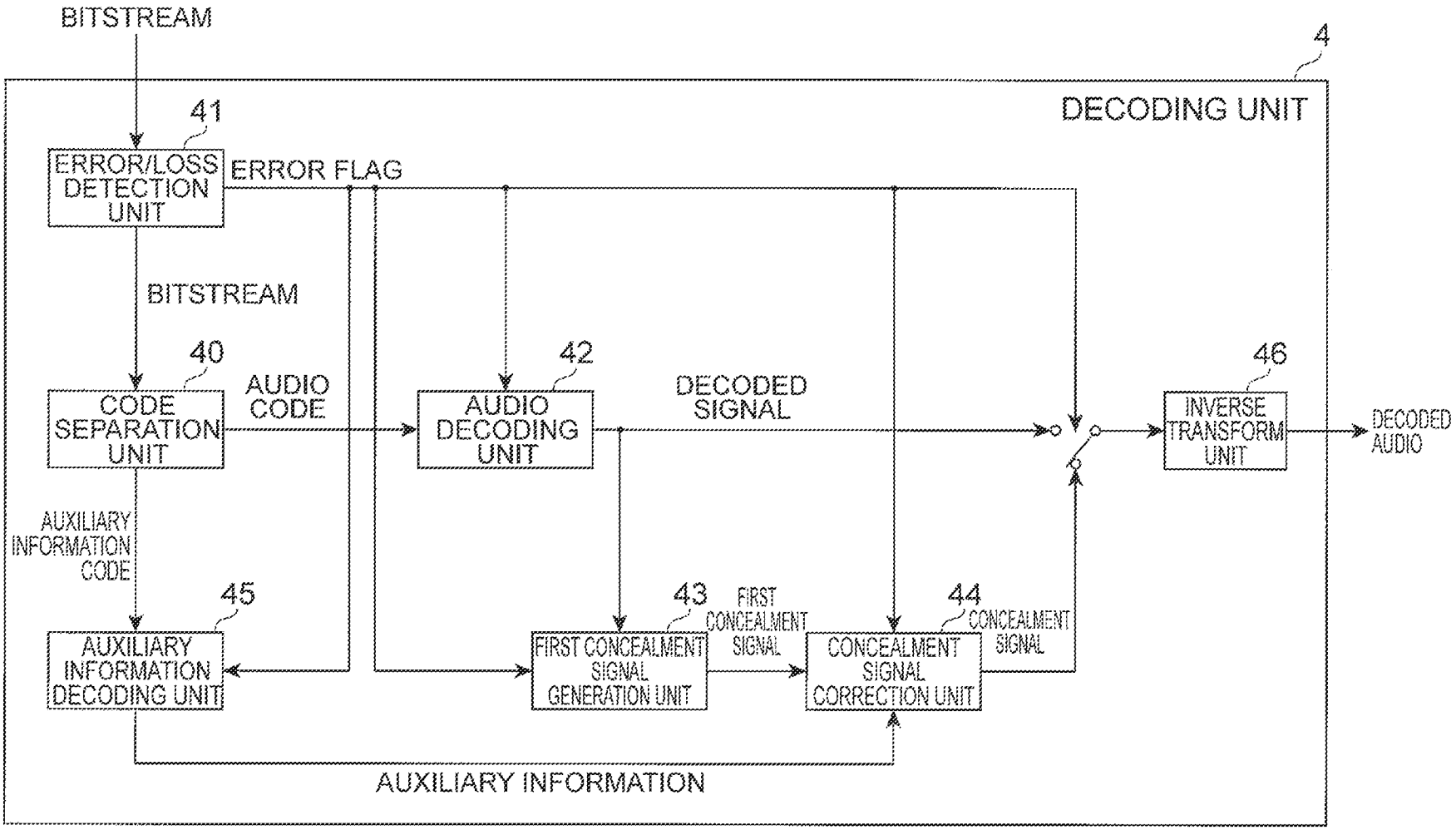
FIG. 13 is a configuration diagram of an example of the decoding unit in the fourth embodiment.

On the other hand, the decoding unit 4 in the fourth embodiment has a configuration, as shown in FIG. 13, in which an inverse transform unit 46 is added to the output side of the audio decoding unit 42 and the concealment signal correction unit 44, in comparison to the decoding unit 4 (FIG. 6) in the first and second embodiments.

In the decoding unit 4 in FIG. 13 as described above, the operations of the error/loss detection unit 41, code separation unit 40, and audio decoding unit 42 are the same as in the first and second embodiments, and thus the operations of the first concealment signal generation unit 43, auxiliary information decoding unit 45, concealment signal correction unit 44, and inverse transform unit 46 will be described below.

As shown in FIG. 11, the first concealment signal generation unit 43 is provided with the decoding coefficient storage unit 431 and the stored decoding coefficient repetition unit 432. The decoding coefficient storage unit 431 stores the decoded signal fed from the audio decoding unit 42. The stored decoded signal in storage is denoted by B(k, l). The letter k herein represents an index of a sample in a subframe (provided that 0≤k≤K−1) and l represents an index of a subframe stored in the decoding coefficient storage unit 431 (provided that 0≤l≤L−1).

When the error flag is on (to indicate a packet abnormality), the stored decoding coefficient repetition unit 432 obtains the first concealment signal z(k, l) using the stored decoded signal stored in the decoding coefficient storage unit 431. Specifically, it calculates the first concealment signal, for example, by repetition of the last subframe in accordance with the following formula.

$$z(k,l)=B(k,L-1)$$

(provided that 0≤l≤L−1 and 0≤k≤K−1)

The unit of repetition does not have to be limited to the last subframe, and any part of B(k, l) may be extracted and repeated, or the first concealment signal may be generated, for example, by prediction using the linear prediction.

Alternatively, the first concealment signal may be generated, for example, in accordance with a model determined in advance as described below.

$$[z(k,0) \ldots z(k,L-1)]=f(B(0,0),B(1,0) \ldots ,B(K-1,L-1))$$

The auxiliary information decoding unit 45 decodes the auxiliary information code output by the code separation unit 40 to generate an index, obtains a slope $\gamma_J$ of a straight line corresponding to the index from the codebook, and outputs it. Here, P(−1) represents the power of the last subframe in the signal received normally immediately before the frame loss.

$$\hat{P}(m)=\gamma_J \cdot m+P(-1)$$

In the case where the intercept of the straight line is simultaneously encoded based on the straight-line approximation of powers of subframes, the subframe powers are obtained by the following formula using the intercept $P_J$.

$$\hat{P}(m)=\gamma_J \cdot m+P_J$$

In the case where the vector quantization is used in the attenuation coefficient quantization unit 123 included in the auxiliary information encoding unit 12 as in the second embodiment, the auxiliary information decoding unit 45 in the present embodiment calculates the powers of the subframes using the codebook, as does the auxiliary information decoding unit 45 in the second embodiment.

As shown in FIG. 12, the concealment signal correction unit 44 is provided with the auxiliary information storage unit 441 and the subframe power correction unit 442. The auxiliary information storage unit 441 stores the auxiliary information fed from the auxiliary information decoding unit 45 when the error flag is off (to indicate packet normality). The auxiliary information to be stored is preferably that of several past frames. The subframe power correction unit 442 corrects the first concealment signal for a value of power of the first concealment signal in each subframe in accordance with the formula below to obtain the concealment signal Y(k, l). Specifically, it performs the correction in accordance with the below formula (provided that 0≤l≤L−1 and 0≤k≤K−1). $P^{-d}(m)$ represents the power about the subframe contained in the auxiliary information code transmitted in the d-th packet before the pertinent packet (packet of a first concealment signal generation target).

$$\hat{P}(m) = P^{-d}(m)$$

$$z'(k, l) = \frac{z(K, l)}{\sqrt{\frac{1}{K}\sum_{k=0}^{K-1} z^2(k, l)}}$$

$$Y(k, l) = 10^{\hat{P}(m)/20} \cdot z'(k, l)$$

The inverse transform unit 46 transforms the concealment signal or the decoded signal in the time-frequency domain into a signal in the time domain. For example, the transform is performed by the following formula indicating a synthesis QMF.

$$y(k, l) = \frac{1}{K}\sum_{k=0}^{K-1} p_S(n) \cdot Y(k, l)\cos\left[\frac{\pi}{K}\left(n+\frac{1}{2}-\frac{K}{2}\right)\left(k+\frac{1}{2}\right)\right]$$

In this formula, the letter l represents an index of a signal in the time domain, provided that 0≤l≤K(2+L).

As described above, the fourth embodiment allows the processing procedures as executed in the first and second embodiments to be applied to the signals resulting from the time-frequency transform.

Fifth Embodiment

The fifth embodiment will describe an example in which the technique described in the first embodiment is applied to each of subbands.

Since, in the encoding unit 1 in the fifth embodiment, the operation of the auxiliary information encoding unit 12 is different from that in the first embodiment, the operation of the auxiliary information encoding unit 12 will be described below. The auxiliary information encoding unit 12, as shown in FIG. 4, is provided with the subframe power calculation unit 121, attenuation coefficient estimation unit 122, and attenuation coefficient quantization unit 123.

The subframe power calculation unit 121 saves the audio signal for the predetermined period of time, and calculates the subframe power sequence for the audio signal v(k, l+d) that is later by the predetermined number of frames (d frames in the present embodiment) than the encoding of the target signal v(k, l) out of the saved audio signal. It is assumed herein that the number of samples contained in one frame is T. Supposing a prediction target signal is defined as v(k, l+d)=s(k, l+d), the power $P^i(l)$ of the ith subband in the subframe 1 (0≤l≤L−1) is obtained by the following formula. The letter k represents an index of a sample in a subframe (provided that 0≤k≤K−1).

$$P^i(l+d) = 10\log_{10}\left(\frac{1}{K^i_{max}-K^i_{min}}\sum_{k=K^i_{min}}^{K^i_{max}} v^2(k, l+d)\right)$$

The subbands may be determined so that the widths of the subbands are unequal intervals, or they may be set to the width of the critical band, or the subband widths may be set to 1.

The attenuation coefficient estimation unit 122 obtains a slope $\gamma^i_{opt}$ of a straight line indicative of a temporal change of power for each subframe from the subframe power sequence, for example, by the least square method or the like. More simply, the slope may be determined from $P^i(\mathbf{0})$ and $P^i(L-1)$. In addition to the slope $\gamma^i_{opt}$ of the straight line, an intercept $P^i_{opt}$ obtained by a straight-line approximation of the subframe power sequence $P^i(l)$ may be obtained. The power of subframe m is represented herein by the following formula.

$$\hat{P}^i(m)=\gamma^i_{opt} \cdot m+P^i_{opt}$$

In this case, a slope $\gamma_{opt}$ and an intercept $P_J$ of a straight line are determined according to the following formulas (the least square method).

$$\gamma_{opt} = \frac{L\sum_{m=0}^{L-1} m \cdot P(m) - \sum_{m=0}^{L-1} m \sum_{m=0}^{L-1} P(m)}{L\sum_{m=0}^{L-1} m^2 - \left(\sum_{m=0}^{L-1} m\right)^2}$$

-continued $$P_{opt} = \frac{\sum_{m=0}^{L-1} m^2 \sum_{m=0}^{L-1} P(m) - \sum_{m=0}^{L-1} m \cdot P(m) \sum_{m=0}^{L-1} P(m)}{L \sum_{m=0}^{L-1} m^2 - \left(\sum_{m=0}^{L-1} m\right)^2}$$

The attenuation coefficient quantization unit 123 performs scalar quantization of slopes $\gamma^i_{opt}$ of straight lines, encodes the result, and outputs the auxiliary information code. The scalar quantization may be performed using a scalar quantization codebook prepared in advance. In the case of the straight-line approximation of the subframe powers $P^i(l)$, the intercept $P^i_{opt}$ may be encoded in addition to the slope $\gamma^i_{opt}$ of the straight line. The vector quantization and subsequent encoding may be applied to a vector obtained by arranging $\gamma^i_{opt}$ of all the subbands, or the vector quantization and subsequent encoding may be applied to a vector obtained by arranging $\gamma^i_{opt}$ and $P^i_{opt}$.

Since in the decoding unit 4 in the fifth embodiment the operations of the stored decoding coefficient repetition unit 432, auxiliary information decoding unit 45, and subframe power correction unit 442 are different from those in the first embodiment, the operations of these elements will be described below.

When the error flag is on (to indicate a packet abnormality), the stored decoding coefficient repetition unit 432 obtains the first concealment signal Z(k, l), using the stored decoded signal stored in the decoding coefficient storage unit 431. The stored decoded signal stored in the decoding coefficient storage unit 431 is denoted by B(k, l). The letter k herein represents an index of a sample in a subframe ($0 \le k \le K-1$) and the letter l represents an index of a subframe stored in the decoding coefficient storage unit 431 ($0 \le l \le L-1$).

Specifically, the stored decoding coefficient repetition unit 432 calculates the first concealment signal by repetition of the last subframe, as represented by the following formula.

$$Z(k,l)=B(k,dL-1)$$

(provided that $0 \le l \le L-1$ and $0 \le k \le K-1$)

The unit of repetition does not have to be limited to the last subframe, and any part of B(k, l) may be extracted and repeated. Without being limited to the generation of the first concealment signal by the repetition as described above, the first concealment signal may be generated, for example, by a prediction using the linear prediction. Alternatively, the first concealment signal may be generated, for example, in accordance with a model determined in advance as described below.

$$[Z(0,0), \ldots, Z(K-1,L-1)]=f(b(0,0),b(1,0) \ldots ,b(K-1,dL-1))$$

The auxiliary information decoding unit 45 decodes the auxiliary information code output from the code separation unit 40, to generate indexes, and obtains a slope $\gamma^i_J$ of a straight line corresponding to each of the indexes from the codebook. Here, $P^i(-1)$ represents the power of the last subframe in the signal received normally immediately before the packet loss.

$$\hat{P}^i(m)=\gamma^i_J \cdot m+P^i(-1)$$

In the case where the intercepts of the straight lines are simultaneously encoded based on the straight-line approximation of subframe powers, the subframe powers are obtained by the following formula using the intercepts $P^i_J$.

$$\hat{P}^i(m)=\gamma^i_J \cdot m+P^i_J$$

The auxiliary information storage unit 441 included in the concealment signal correction unit 44 stores the auxiliary information fed from the auxiliary information decoding unit 45 when the error flag indicates the value indicative of the normal packet. The auxiliary information to be stored is preferably that of several past frames (at least d frames or more).

In the concealment signal correction unit 44 as described above, the subframe power correction unit 442 corrects the first concealment signal for a value of power of the first concealment signal in each subframe in accordance with the formula below to obtain the concealment signal Y(k, l). Specifically, it performs the correction according to the below formula (provided that $0 \le l \le L-1$ and $0 \le k \le K-1$). $P^i_{-d}(m)$ represents the power of the ith subband about the subframe contained in the auxiliary information code transmitted in the d-th packet before the pertinent packet (packet of a first concealment signal generation target).

$$\hat{P}^i(m) = P^i_{-d}(m)$$

$$Z'(k, l) = \frac{z(K, l)}{\sqrt{\frac{1}{K^i_{max} - K^i_{min}} \sum_{k=K^i_{min}}^{K^i_{max}} Z^2(k, l)}},$$

$$(K^i_{min} \le k \le K^i_{max},\ 0 \le i \le I-1)$$

$$Y(k, l) = 10^{\hat{P}^i(m)/20} \cdot Z'(k, l),\ (K^i_{min} \le k \le K^i_{max},\ 0 \le i \le I-1)$$

The above fifth embodiment showed the example in which the auxiliary information was calculated and encoded for the frame "later by d frames" than the encoding of the target signal, but the auxiliary information may be calculated and encoded for the frame "earlier by d frames" than the encoding of the target signal, as in the third embodiment.

As described above, the fifth embodiment allows the technique described in the first embodiment to be applied to each of a plurality of subbands.

Sixth Embodiment

The sixth embodiment will describe an example in which the auxiliary information encoding unit obtains two or more pieces of auxiliary information, encodes them separately, and puts the encoded data into a bitstream. The differences from the first embodiment will be mainly described below.

The encoding unit 1 in the sixth embodiment, as shown in FIG. 2, is provided with the audio encoding unit 11, auxiliary information encoding unit 12, and code multiplexing unit 13. The audio encoding unit 11 is the same as in the first embodiment. The auxiliary information encoding unit 12, as shown in FIG. 4, is provided with the subframe power calculation unit 121, attenuation coefficient estimation unit 122, and attenuation coefficient quantization unit 123.

The subframe power calculation unit 121 saves the audio signal for a predetermined period of time, and calculates a subframe power sequence $P_1(l)$ for audio signals s(dT), s(1+dT), . . . , s((d+1)T−1) that are later by a predetermined number of frames (d frames in the present embodiment) than the encoding of the target signals s(0), s(1), . . . , s(T−1) out of the saved audio signal.

Furthermore, the subframe power calculation unit 121 calculates a subframe power sequence $P_2(l)$ for audio signals s((d+1)T), s(1+(d+1)T), . . . , s((d+2)T−1) later by a predetermined number of frames ((d+1) frames in the present embodiment).

It is assumed herein that the number of samples contained in one frame is T. When a prediction target signal is expressed by the following formula:

$$v(K\cdot l+k)=s(K\cdot l+k+dT),$$

the powers $P_1(l)$, $P_2(l)$ of subframe 1 ($0\le l\le L-1$) are obtained by the following formulas. The letter k represents an index of a sample in each subframe ($0\le k\le K-1$).

$$P_1(l) = 10\log_{10}\left(\frac{1}{K}\sum_{k=0}^{K-1} v^2(K\cdot l+k)\right)$$

$$P_2(l) = 10\log_{10}\left(\frac{1}{K}\sum_{k=0}^{K-1} v^2(K\cdot l+k+T)\right)$$

The present embodiment defines K as the length of each subframe, but different lengths may be used for the respective subframes, which are determined in advance for the respective subframes. The subframe power sequence may also be calculated in accordance with the following formula where $k^l_{start}$ represents an index of a start of the lth subframe and $k^l_{end}$ represents an index of an end thereof.

$$P(l) = 10\log_{10}\left(\frac{1}{k^l_{end}-k^l_{start}}\sum_{k=k^l_{start}}^{k^l_{end}} v^2(k^{l-1}_{end}+k)\right)$$

The attenuation coefficient estimation unit 122 calculates slopes $\gamma^1_{opt}$, $\gamma^2_{opt}$ of straight lines indicative of respective temporal changes of power from the subframe power sequences $P_1(l)$, $P_2(l)$, for example, by the least square method or the like. The calculation method is the same as that performed by the attenuation coefficient estimation unit 122 in the first embodiment.

The attenuation coefficient quantization unit 123 performs the scalar quantization of each of the slopes $\gamma^1_{opt}$, $\gamma^2_{opt}$ of the straight lines, encodes the results of the scalar quantization, and outputs auxiliary information codes $C^1$, $C^2$. It may use the scalar quantization codebook prepared in advance. In the case of the straight-line approximation of subframe power P(l), intercepts $P^1_{opt}$, $P^2_{opt}$ may also be encoded in addition to the slopes $\gamma^1_{opt}$, $\gamma^2_{opt}$ of the straight lines.

Figure 14:
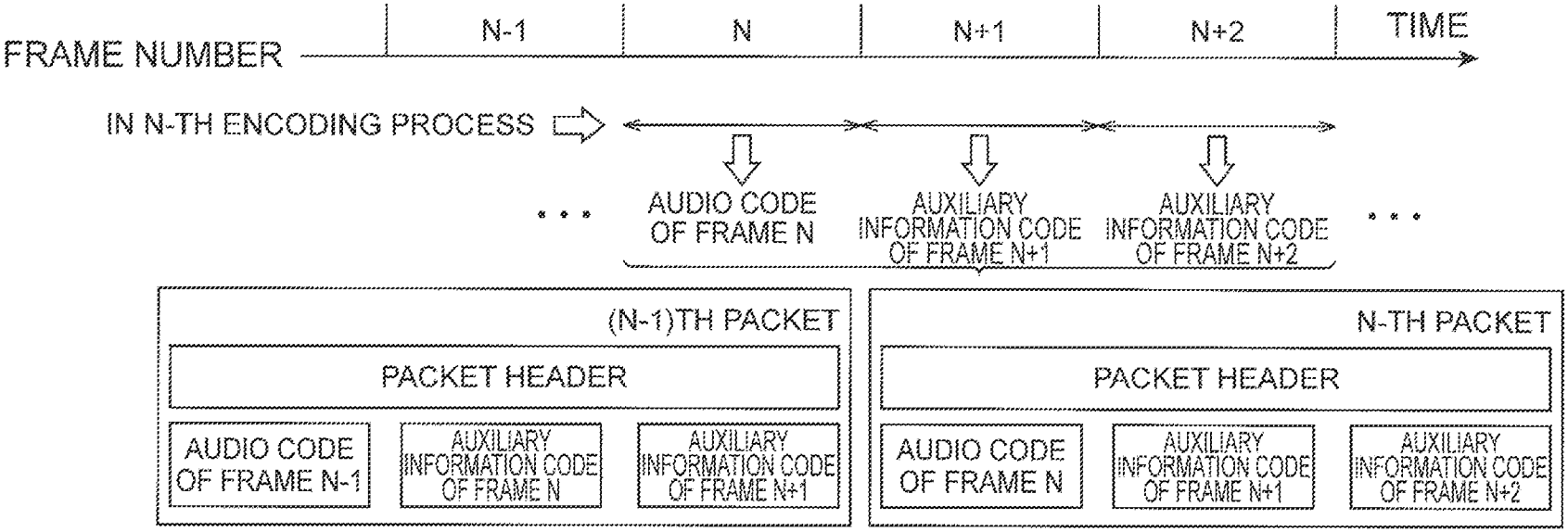
FIG. 14 is a drawing showing an example of a temporal relation between signals as audio encoding targets and signals as auxiliary information encoding targets, and a configuration example of bitstreams in the sixth embodiment.

The code multiplexing unit 13 writes the audio code and the auxiliary information codes $C^1$, $C^2$ in a predetermined order and outputs a bitstream. FIG. 14 shows an example of temporal relationship between signals as audio encoding targets and signals as auxiliary information encoding targets, and a configuration of bitstreams. As shown in FIG. 14, for example, the auxiliary information code of frame (N+1) and the auxiliary information code of frame (N+2) are added to the audio code of frame N to obtain a bitstream, which is output from the code multiplexing unit 13. Furthermore, the packet configuration unit 2 in FIG. 1 adds the packet header information to the bitstream to obtain an audio packet to be transmitted as the N-th packet. Although the present embodiment shows the generation of the two pieces of auxiliary information, the auxiliary information to be generated may be three or more pieces of auxiliary information. The auxiliary information may be calculated for a target of an audio signal that is earlier by one or more frames than the audio signal encoded by the audio encoding unit.

The decoding unit 4 in the sixth embodiment, as shown in FIG. 6, is provided with the error/loss detection unit 41, code separation unit 40, audio decoding unit 42, auxiliary information decoding unit 45, first concealment signal generation unit 43, and concealment signal correction unit 44. Since the operations of the error/loss detection unit 41, audio decoding unit 42, and first concealment signal generation unit 43 are the same as those in the first embodiment, redundant description is omitted herein.

The code separation unit 40 reads the audio code and auxiliary information codes $C^1$, $C^2$ from the bitstream, and sends the audio code to the audio decoding unit 42 and the auxiliary information codes $C^1$, $C^2$ to the auxiliary information decoding unit 45.

The auxiliary information decoding unit 45 decodes the auxiliary information codes $C^1$, $C^2$, calculates the auxiliary information, and sends the result to the concealment signal correction unit 44. For example, the auxiliary information decoding unit 45 decodes the auxiliary information codes $C^1$, $C^2$ output from the code separation unit 40, to generate indexes, and obtains slopes $\gamma_J$ of straight lines corresponding to the respective indexes from the codebook. Here, P(−1) represents the power of the last subframe in the signal received normally immediately before the frame loss.

$$\hat{P}(m)=\gamma_J\cdot m+P(-1)$$

When the intercepts of the straight lines are simultaneously encoded based on the straight-line approximation of subframe powers, the subframe powers are obtained according to the following formula using the intercepts $P_J$.

$$\hat{P}(m)=\gamma_J\cdot m+P_J$$

The concealment signal correction unit 44, as shown in FIG. 12, is provided with the auxiliary information storage unit 441 and the subframe power correction unit 442.

The auxiliary information storage unit 441 stores the auxiliary information fed from the auxiliary information decoding unit 45 when the error flag indicates the value indicative of the normal packet. The auxiliary information to be stored is preferably that of several past frames (at least d frames or more). In the present embodiment, the auxiliary information of two frames is acquired per packet.

The subframe power correction unit 442 corrects the first concealment signal for a value of power of the first concealment signal in each subframe in accordance with the formula below to obtain the concealment signal Y(K·l+k). Specifically, it performs the correction according to the below formula (provided that $0\le l\le L-1$ and $0\le k\le K-1$). $P^{-d}(m)$ represents the power about the subframe contained in the auxiliary information code $C^1$ transmitted in the d-th packet before the pertinent packet (packet of a first concealment signal generation target).

$$\hat{P}^i(m) = P^{-d}(m)$$

$$z'(k\cdot l+k) = \frac{z(K\cdot l+k)}{\sqrt{\frac{1}{K}\sum_{k=0}^{K-1} z^2(K\cdot l+k)}},$$

$$Y(K\cdot l+k) = 10^{\hat{P}(m)/20}\cdot z'(K\cdot l+k)$$

For example, the subframe power correction unit 442, as shown in FIG. 8, earlier extracts the auxiliary information transmitted in the d-th packet, from the auxiliary information storage unit 441 (step S60 in FIG. 8), calculates the mean square amplitude value for each subframe as to the first concealment signal, and divides the value contained in the subframe, by the mean square amplitude value (step S61). This calculation results in obtaining z'(K·l+k). Then powers of respective subframes are calculated from the auxiliary information and the value of the subframe is multiplied by a mean amplitude value obtained from the powers (step S62). This multiplication results in obtaining the concealment signal Y(K·l+k). The above processing of steps S4101 to S4421 (FIG. 7) is repeated to the end of the audio signal (step S4431).

When a consecutive packet loss further occurs, the packet loss can also be concealed in the case of occurrence of the consecutive packet loss by carrying out the same processing, using the power about the subframe contained in the auxiliary information code $C^2$ transmitted in the d-th packet before the pertinent packet (packet of a first concealment signal generation target).

As described above, the sixth embodiment allows the auxiliary information encoding unit to obtain two or more pieces of auxiliary information, encode them separately, and put them into the bitstream.

Figure 19:
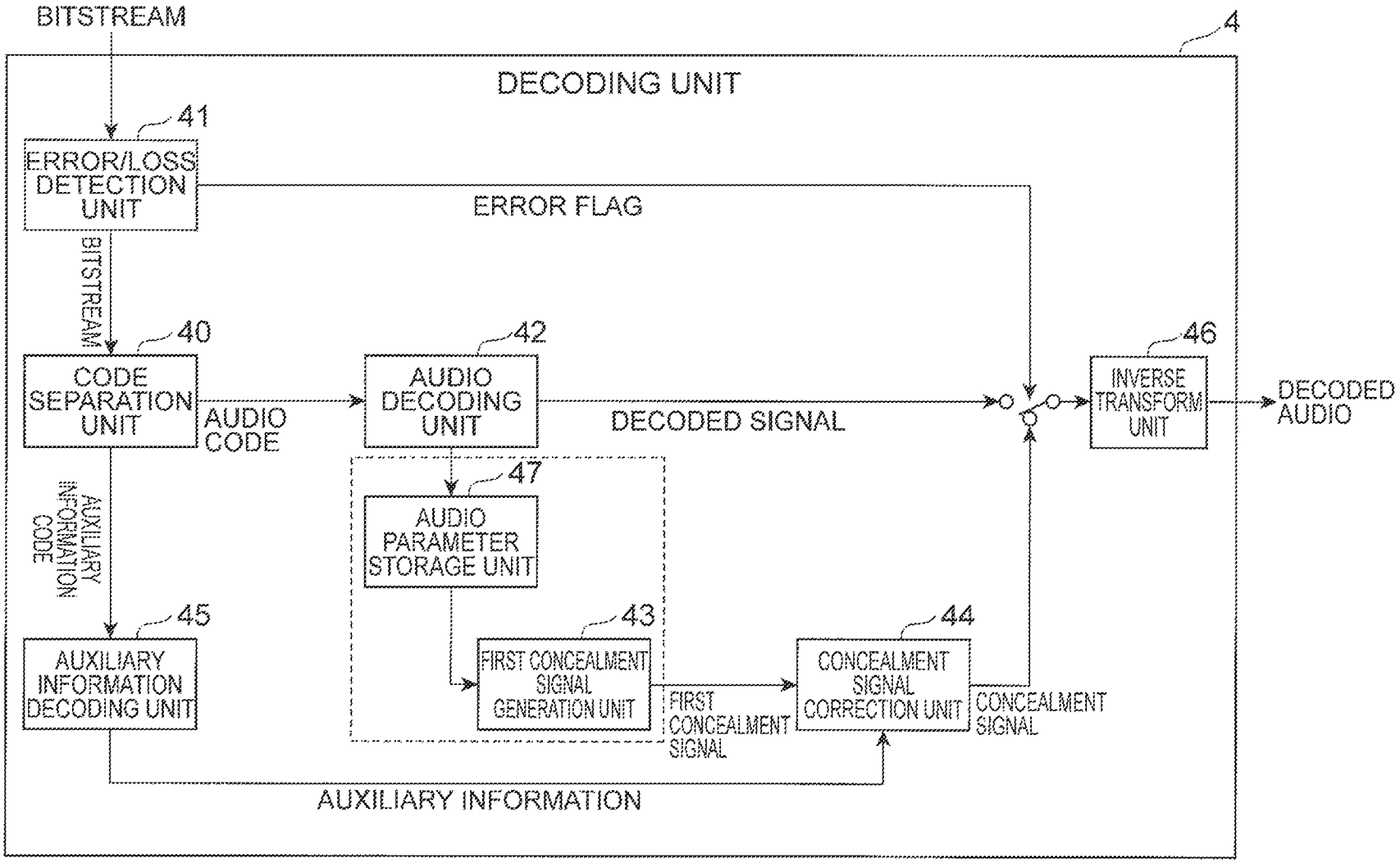
FIG. 19 is a drawing showing another configuration example of the decoding unit.

Incidentally, FIG. 19 shows a configuration diagram of a modification example of the decoding unit 4. The decoding unit 4 in FIG. 13 in the fourth embodiment described above was configured to feed the error flag to the audio decoding unit 42, the first concealment signal generation unit 43, the concealment signal correction unit 44, and the auxiliary information decoding unit 45, whereas the configuration in FIG. 19 omits these inputs. Even in the configuration with omission of these inputs, there is no input to the audio decoding unit 42 and the auxiliary information decoding unit 45 with the error flag being on and therefore the error flag can be determined to be on by the absence of the input. Namely, the state of the error flag can be determined, depending upon the presence/absence of the input to the audio decoding unit 42 and the auxiliary information decoding unit 45. The first concealment signal generation unit 43 and the concealment signal correction unit 44 can also determine the state of the error flag in the same manner. The decoding unit 4 in FIG. 13 is configured so that an audio parameter storage unit 47 shown in FIG. 19 is included in the first concealment signal generation unit 43, but the audio parameter storage unit 47 may be configured as a constituent element independent of the first concealment signal generation unit 43, as shown in FIG. 19. The function of the decoding unit 4 of the configuration in FIG. 19 is substantially the same as that of the decoding unit 4 in FIG. 13. The decoding unit 4 in the first, second, third, fifth, and sixth embodiments shown in FIG. 6 may also be configured so that the input of the error flag to the audio decoding unit 42, the first concealment signal generation unit 43, the concealment signal correction unit 44, and the auxiliary information decoding unit 45 is omitted and/or so that the audio parameter storage unit is a constituent element independent of the first concealment signal generation unit 43, as described above.

Seventh Embodiment

The seventh embodiment will describe an example in which the auxiliary information about a sudden change of power (which will be referred to hereinafter as "transient") to be used herein is a position of the transient in a frame as an auxiliary information encoding target, and a power of a subframe at the position of the transient.

(Configuration and Operation of Encoding Unit 1)

In the seventh embodiment the overall configuration of the encoding unit 1 is also as shown in FIG. 2 and the overall configuration of the decoding unit 4 is as shown in FIG. 6. In the seventh embodiment as well, the description about the overall configuration is omitted as in the second to sixth embodiments.

Figure 20:
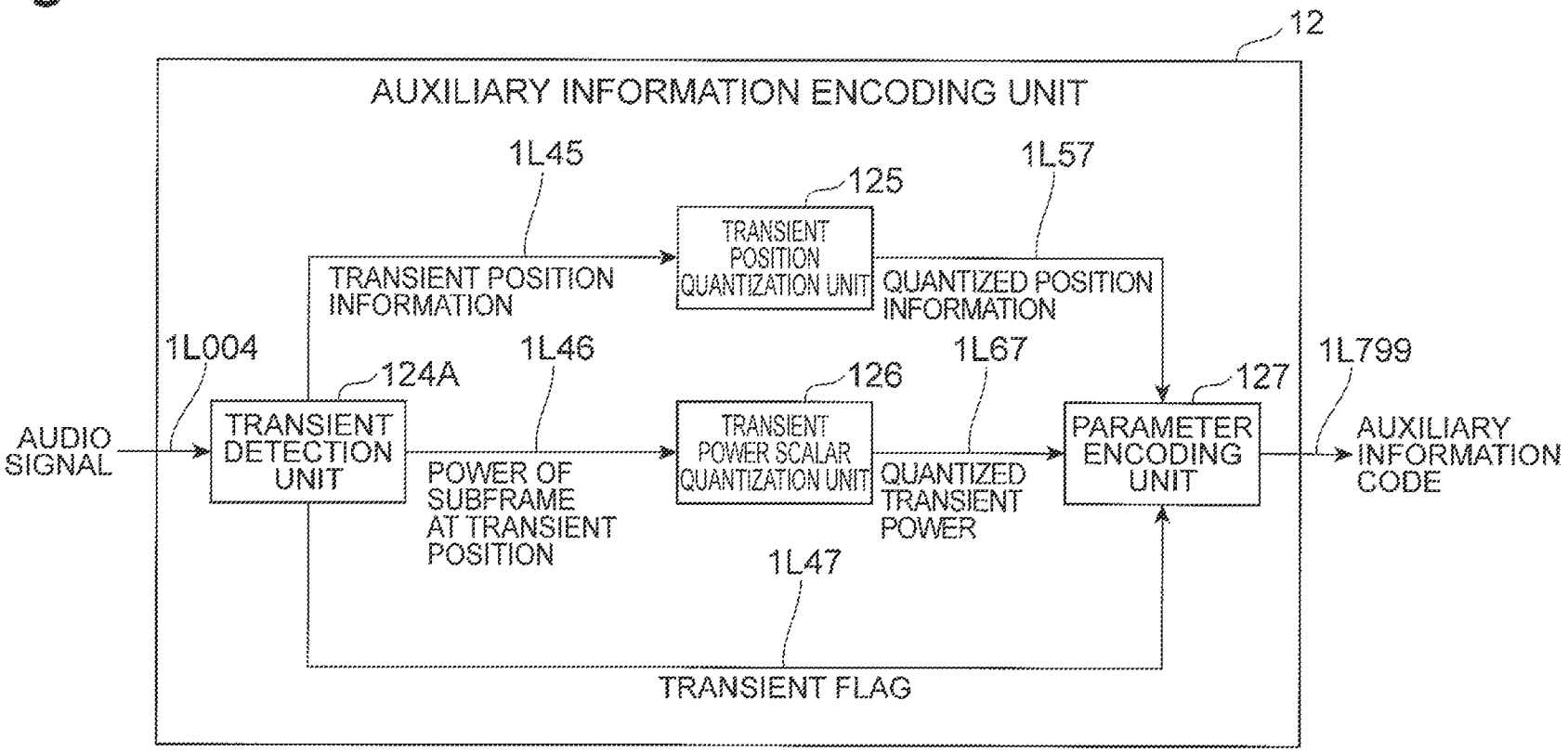
FIG. 20 is a configuration diagram of an example of the auxiliary information encoding unit in the seventh embodiment.

The auxiliary information encoding unit 12 will be described below in detail as a characteristic portion of the encoding unit 1 in the seventh embodiment. The auxiliary information encoding unit 12, as shown in FIG. 20, is provided with a transient detection unit 124A, a transient position quantization unit 125, a transient power scalar quantization unit 126, and a parameter encoding unit 127.

The operation of the auxiliary information encoding unit 12 of this configuration will be described based on FIG. 21. The transient detection unit 124A saves the audio signal for a predetermined period of time, and detects a transient using audio signals s(dT), s(1+dT), . . . , s((d+1)T−1) that is later by a predetermined number of frames (d frames in the present embodiment) than the encoding of the target signals s(0), s(1), . . . , s(T−1) out of the saved audio signal (step S7401 in FIG. 21). The auxiliary information encoding target frame may be a frame that is later by one or more frames than an audio encoding target frame or may be a frame that is earlier by one or more frames than an audio encoding target frame. The auxiliary information codes may be calculated from two or more frames selected from frames that are earlier or later by one or more frames than the audio encoding target frame.

Figure 41:
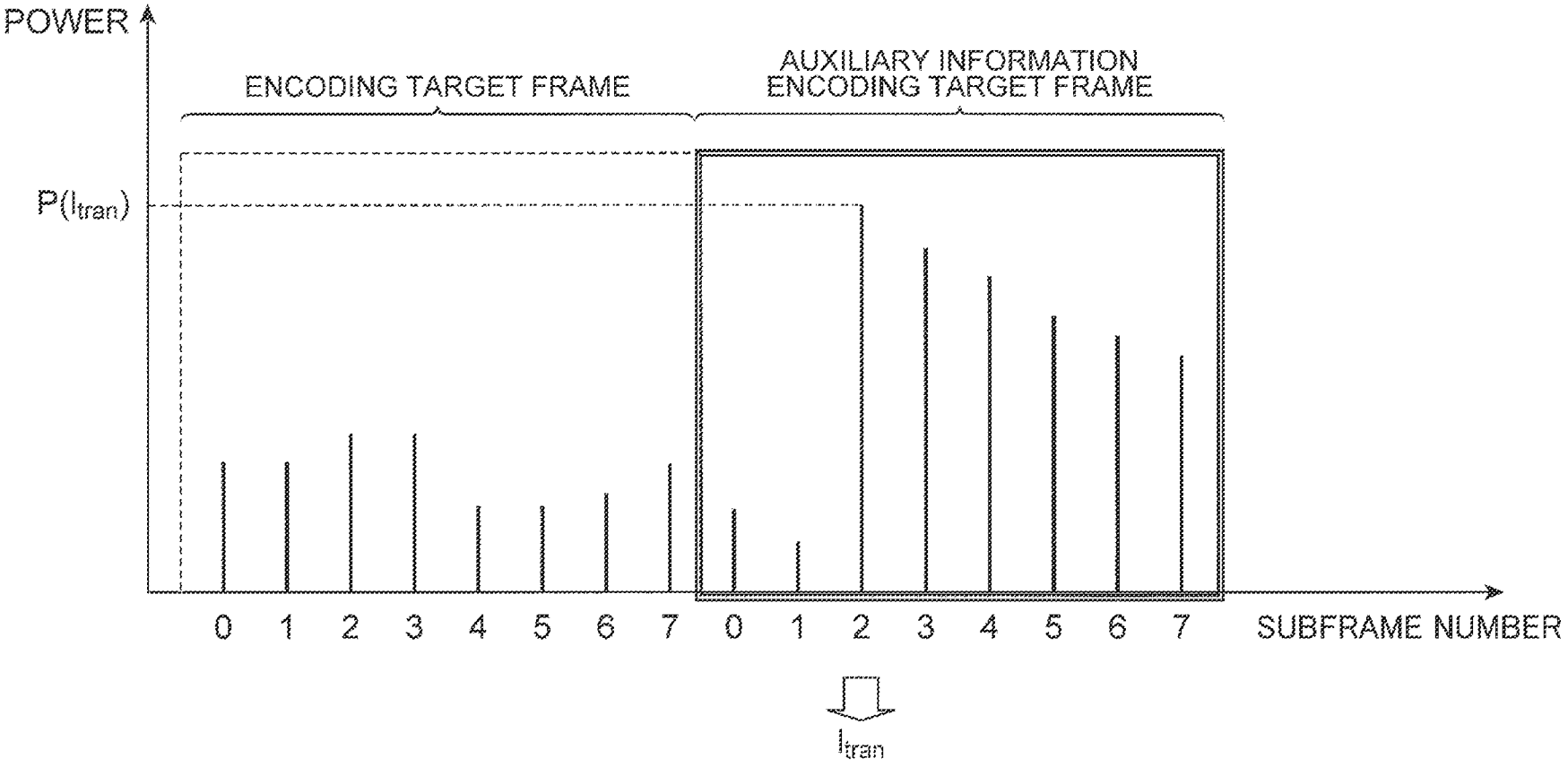
FIG. 41 is a diagram showing an example of output content from a transient detection unit.

A method for detection of the transient can be, for example, the method described in Section 7.2 in "ITU-T Recommendation G.719." The transient may also be detected using one of other standard technologies and non-standard technologies. In the above method described in Section 7.2, the power is calculated in each subframe and then a temporal change of each subframe is compared with a threshold to determine whether or not there is a transient. Calculated as a result of the transient detection are: a transient flag $F_{tran}$ indicative of whether a transient is contained in the auxiliary information encoding target frame, a position $l_{tran}$ of the transient, and a subframe power sequence P(l). When a power of a subframe at the position $l_{tran}$ of the transient is represented by $P(l_{tran})$ as shown in FIG. 41, the transient detection unit 124A outputs the position $l_{tran}$ of the transient through line 1L45, outputs the power $P(l_{tran})$ of the subframe at the position bran of the transient through line 1L46, and outputs the transient flag $F_{tran}$ through line 1L47. The transient detection unit 124A may be configured to output the position $l_{tran}$ of the transient and the subframe power sequence P(l) through line 1L46.

For example, when the transient detection is carried out by the method described in Section 7.2 in "ITU-T Recommendation G.719," the transient detection unit 124A is supposed to calculate the same parameter as the subframe power sequence calculated by the subframe power calculation unit 121 in FIG. 4. When the transient detection is carried out by other methods, the transient detection unit 124A also calculates and outputs the same parameter as the subframe power sequence calculated by the subframe power calculation unit 121 in FIG. 4.

When the transient flag $F_{tran}$ does not indicate a value for inclusion of a transient in a frame, a value indicative of a normal frame is entered in $F_{tran}$. In this case, the parameter encoding unit 127 encodes only the transient flag and outputs the encoded data as an auxiliary information code (step S7702 in FIG. 21).

Figure 21:
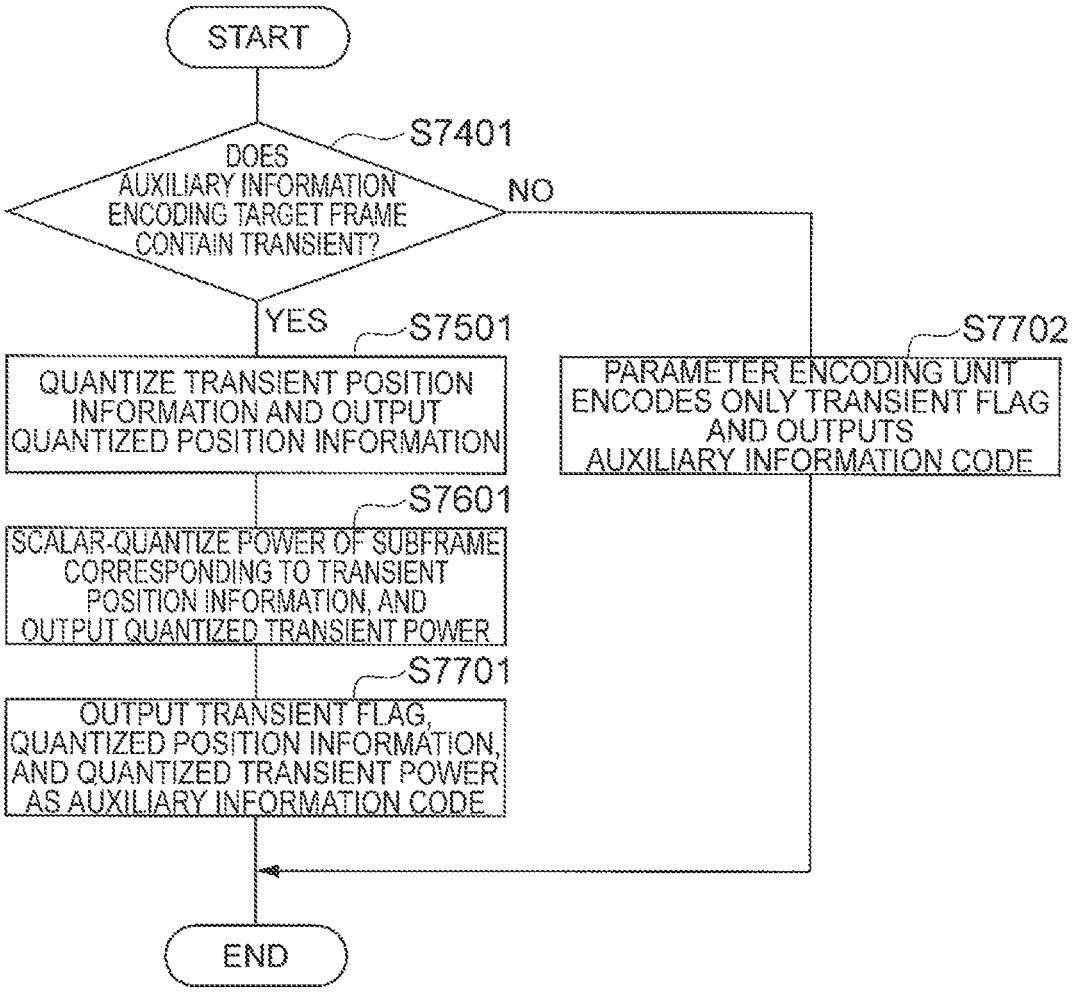
FIG. 21 is a flowchart of example processing by the auxiliary information encoding unit in FIG. 20.
Figure 42:
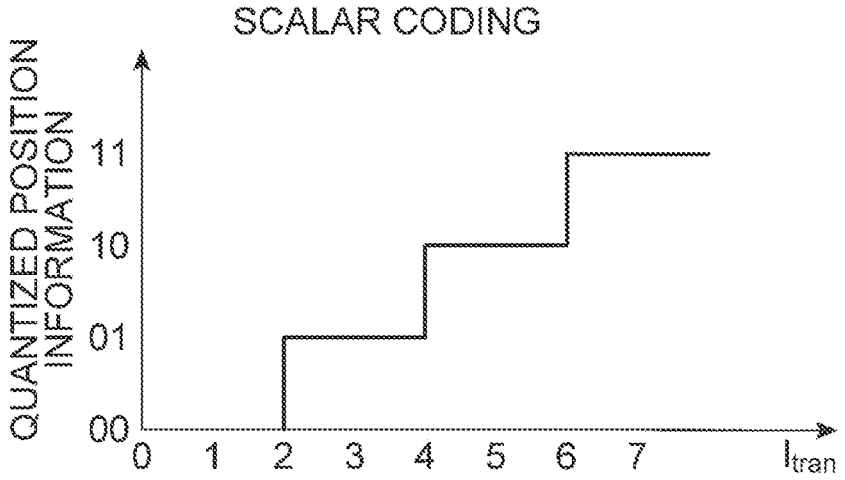
FIG. 42 is a drawing showing examples of scalar quantization methods for transient position information.

On the other hand, when the transient flag $F_{tran}$ indicates a value for inclusion of a transient in a frame, the transient position quantization unit 125 performs the scalar quantization of the position $l_{tran}$ of the transient by a predetermined bit count and outputs quantized position information (step S7501 in FIG. 21). The scalar quantization may be performed by a method of binary coding with $l_{tran}$ being regarded as a binary number, or by a method of providing predetermined positions with indexes, and performing binary encoding of an index at the closest position to $l_{tran}$, or by entropy coding such as Huffman coding, or by any other quantization method. FIG. 42(*a*) shows a schematic diagram of an example of transient position information encoding by the binary coding, and FIG. 42(*b*) a schematic diagram of an example of transient position information encoding by the scalar quantization. As a modification example, another available method is as follows: two or more subframe indexes are selected as "information indicative of a change of power," in addition to the position of the transient, and the two or more subframe indexes thus selected are encoded and transmitted. There are no particular restrictions on the method of encoding herein.

When the value for inclusion of a transient in a frame is set in the transient flag $F_{tran}$, the transient power scalar quantization unit 126 performs the scalar quantization of the power of the subframe corresponding to the position $l_{tran}$ of the transient and outputs the quantized transient power (step S7601 in FIG. 21). For example, in a case where the quantization is performed between 0 dB and 96 dB with use of a 6-bit linear encoder, the quantization is carried out according to the below formula. In this formula, C can be the value of 1.55 and ε can be the value of 0.001 or the like, but these constants may be changed according to the quantization bit count or the like.

$$I_E = \left\lfloor \frac{10\log(P(l_{tran}) + \varepsilon)}{C} \right\rfloor$$

According to the above formula, the power of the transient is quantized into an index ranging from 0 to 63. The quantization may be carried out using a codebook determined in advance by learning or the like, or any other quantization means may be applied. When the transient flag $F_{tran}$ does not indicate the value for inclusion of a transient in a frame, the value indicative of a normal frame is entered in $I_E$ in the above formula.

The parameter encoding unit 127 combines the transient flag, the quantized position information, and the quantized transient power together and outputs the auxiliary information code (step S7701 in FIG. 21). It is also possible to adopt a method in which the transient flag, the quantized position information, and the quantized transient power are regarded together as a vector and then the vector is encoded by vector quantization or by any other encoding method. There are no particular restrictions on the method of encoding.

(Configuration and Operation of Decoding Unit 4)

The overall configuration of the decoding unit 4 is as shown in FIG. 6 described in the first embodiment. The following will describe the configurations and operations of the auxiliary information decoding unit 45 and the concealment signal correction unit 44 which are characteristic configurations in the seventh embodiment. The first concealment signal generation unit 43 may generate the first concealment signal by an existing standard technique, for example, as described in Section 5.2 in TS26.402, in addition to the techniques described in the first to sixth embodiments, or may generate the first concealment signal by another concealment signal generation technique which is not a standard.

Figure 22:
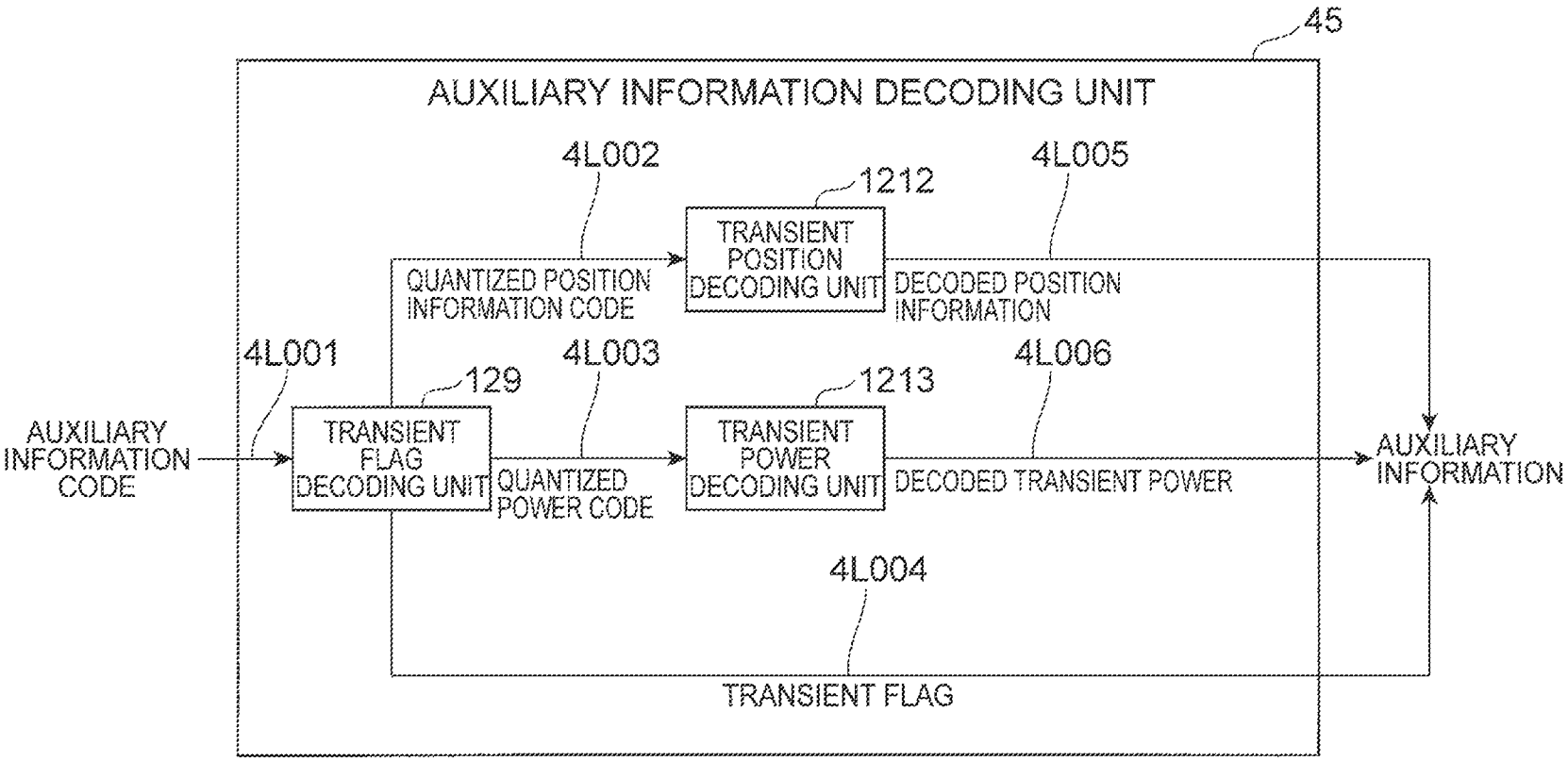
FIG. 22 is a configuration diagram of an example of the auxiliary information decoding unit in the seventh and eleventh embodiments.

The auxiliary information decoding unit 45, as shown in FIG. 22, is provided with a transient flag decoding unit 129, a transient position decoding unit 1212, and a transient power decoding unit 1213.

The operation of the auxiliary information decoding unit 45 of this configuration will be described based on FIG. 23. The auxiliary information decoding unit 45 decodes the auxiliary information code and determines whether the obtained transient flag $F_{tran}$ is on (indicative of a frame including a transient) or off (indicative of a frame including no transient) (step S7901 in FIG. 23).

Figure 23:
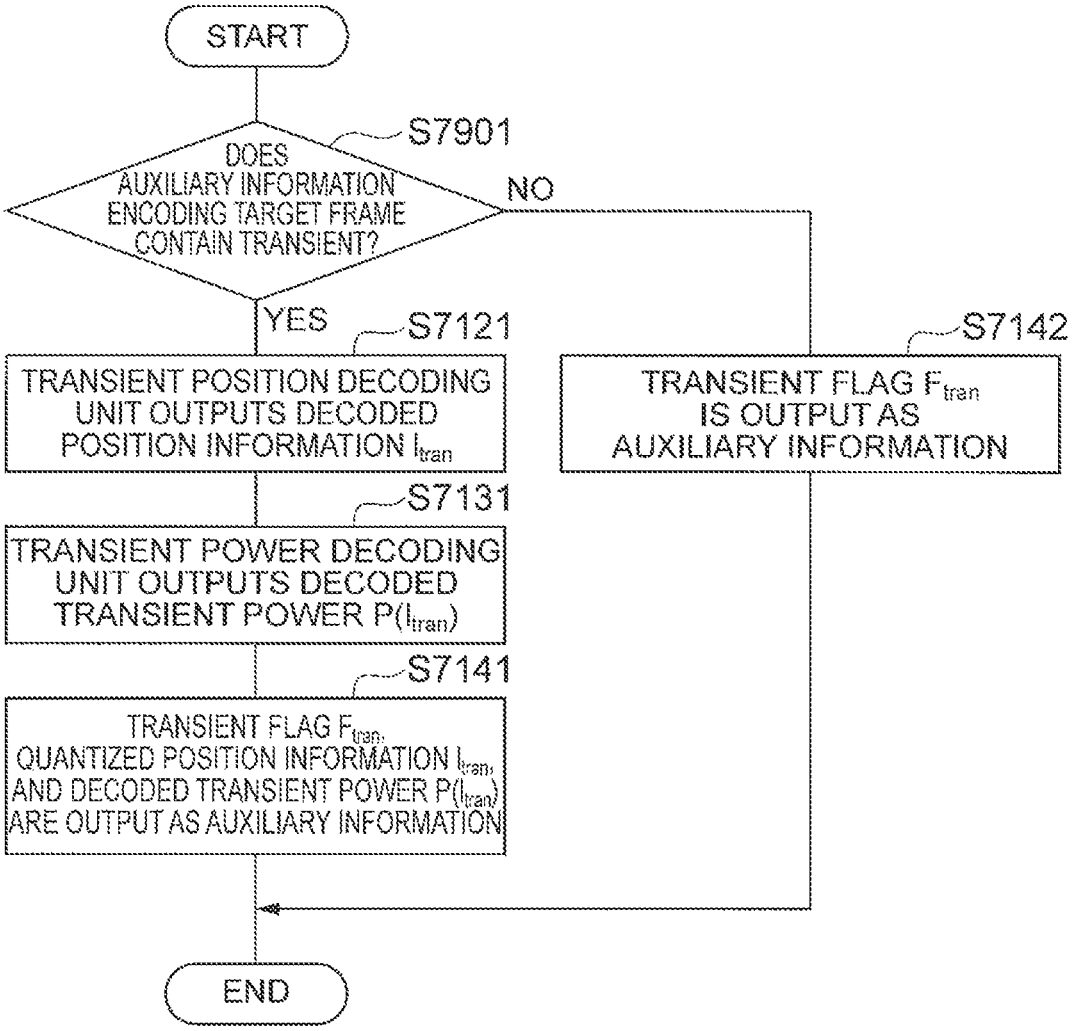
FIG. 23 is a flowchart of example processing by the auxiliary information decoding unit in FIG. 22.

When the transient flag $F_{tran}$ indicates a frame containing no transient, only the value of the transient flag $F_{tran}$ is output as auxiliary information (step S7142 in FIG. 23).

On the other hand, when the transient flag $F_{tran}$ indicates a frame including a transient, the auxiliary information decoding unit reads the quantized position information $l_{tran}$ out of the auxiliary information code, decodes it, and outputs the quantized position information (step S7121 in FIG. 23). Furthermore, the unit reads and decodes the quantized transient power $I_E$ from the auxiliary information code and outputs the decoded transient power (step S7131 in FIG. 23). For example, where the linear quantization as described above is used, the decoded transient power is obtained from the quantized transient power in accordance with the following formula.

$$\hat{P}_{tran} = 10^{C \cdot I_E/20}$$

Then the auxiliary information decoding unit 45 outputs the calculated transient flag $F_{tran}$, quantized position information, and decoded transient power as auxiliary information (step S7141 in FIG. 23).

Figure 24:
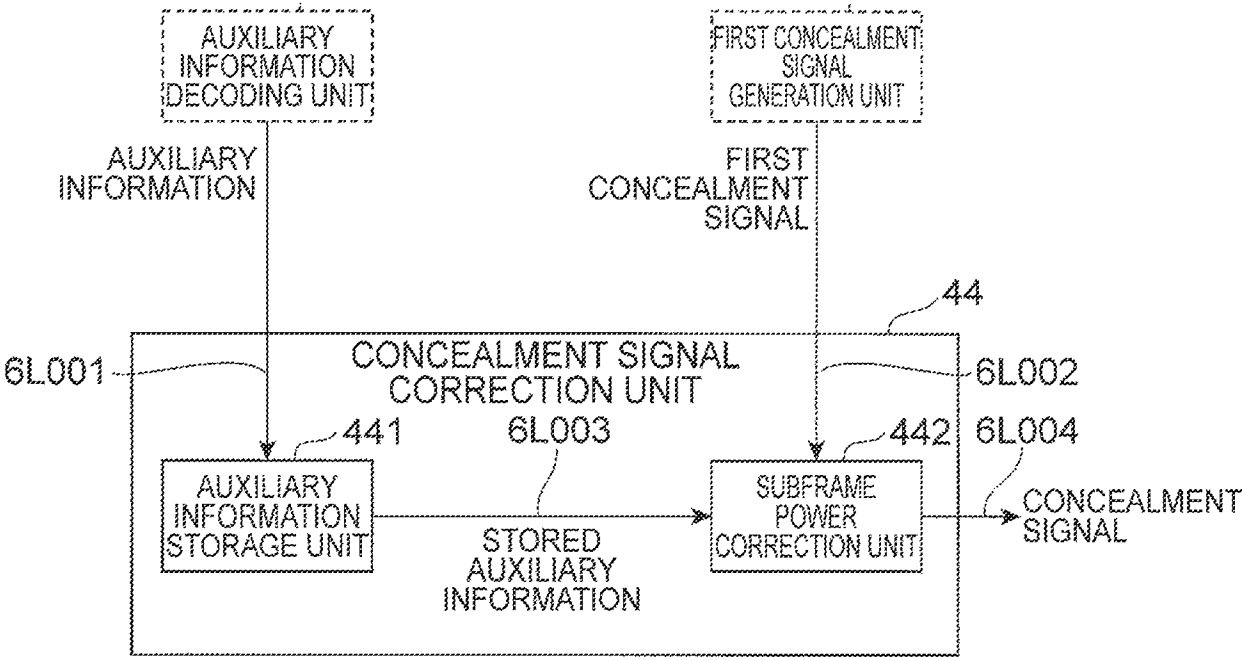
FIG. 24 is a configuration diagram of an example of the concealment signal correction unit in the seventh and eighth embodiments.

Next, the concealment signal correction unit 44 will be described. As shown in FIG. 24, the concealment signal correction unit 44 is provided with the auxiliary information storage unit 441 and the subframe power correction unit 442. The first to sixth embodiments showed the configuration in which the error flag was fed to the subframe power correction unit 442, whereas the concealment signal correction unit 44 in FIG. 24 is configured not to feed the error flag to the subframe power correction unit 442 and is further configured to determine the state of the error flag by the presence/absence of input of the first concealment signal from the first concealment signal generation unit 43. Namely, the error flag is determined to be off, with input of the first concealment signal from the first concealment signal generation unit 43; the error flag is determined to be on, without input of the first concealment signal from the first concealment signal generation unit 43. It is a matter of course that the concealment signal correction unit may be configured to perform the determination on the error flag by supplying the error flag to the auxiliary information storage unit 441 and the subframe power correction unit 442.

Figure 25:
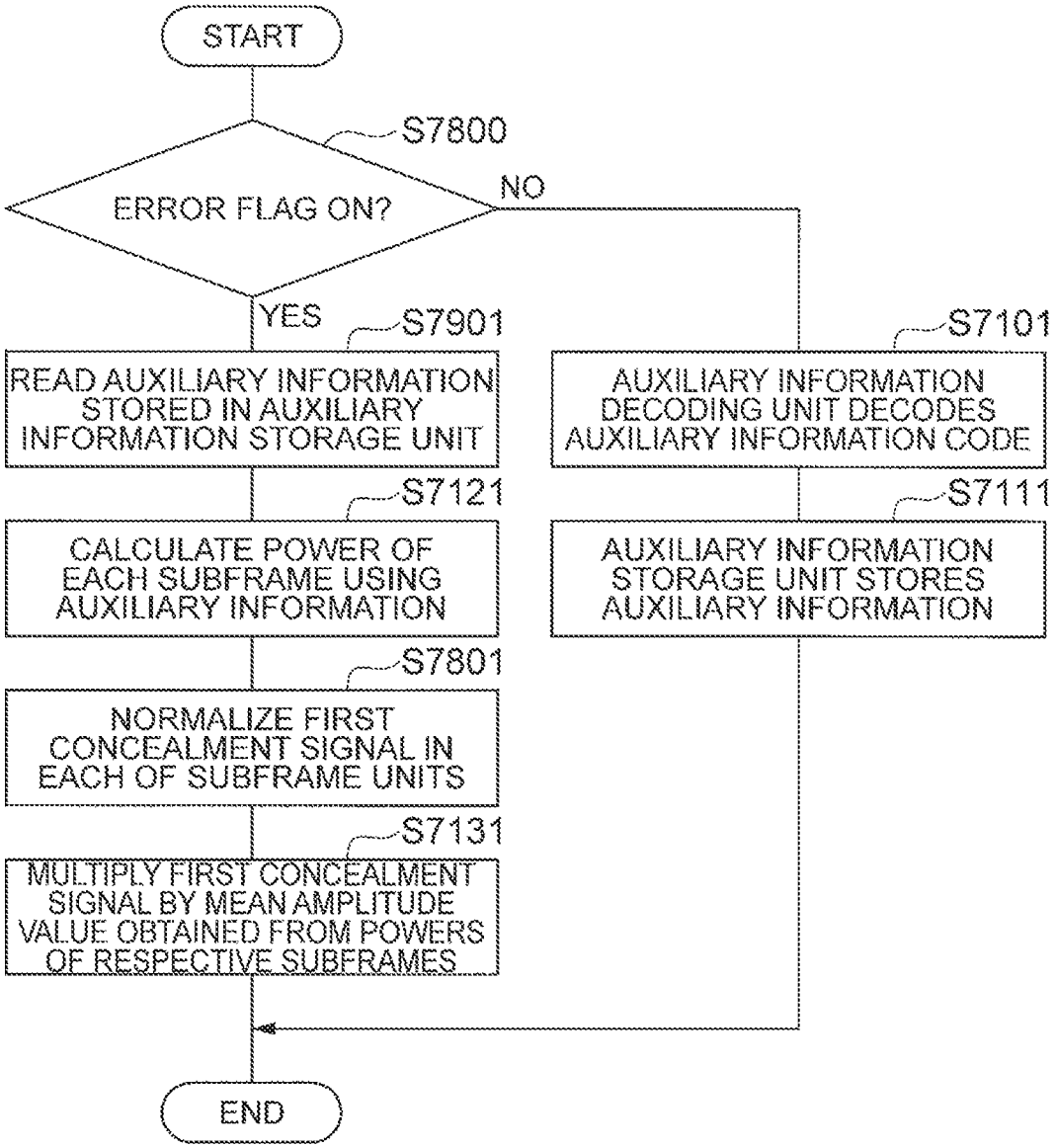
FIG. 25 is a flowchart of example processing by the concealment signal correction unit in the seventh embodiment.

The operation of the concealment signal correction unit 44 is as shown in the flowchart of FIG. 25. First, the state of the error flag is determined by the presence/absence of input of the first concealment signal from the first concealment signal generation unit 43 as described above (step S7800 in FIG. 25). When the error flag is off herein (to indicate no packet loss), the auxiliary information decoding unit 45 decodes the auxiliary information code and outputs the transient flag, the transient position information, and the decoded transient power through line 6L001 in FIG. 24 (step S7101 in FIG. 25). Then the auxiliary information storage unit 441 stores the transient flag, the transient position information, and the decoded transient power (step S7111 in FIG. 25).

On the other hand, when the error flag is on (to indicate a packet loss), the subframe power correction unit 442 reads the transient flag, quantized position information, and decoded transient power from the auxiliary information storage unit 441, and corrects the first concealment signal for a value of power of the first concealment signal z(K·l+k) in each subframe to obtain a concealment signal y(K·l+k) (provided that 0≤l≤L−1 and 0≤k≤K−1) (step S7901 in FIG. 25). Specifically, the subframe power correction unit 442 corrects the value of the power of the first concealment signal z(K·l+k) in accordance with the following procedure. First, the first concealment signal output from the first concealment signal generation unit 43 is fed through line 6L002 in FIG. 24 to the subframe power correction unit 442. Next, the subframe power correction unit 442 reads the transient flag $F_{tran}$, the transient position information $l_{tran}$, and the decoded transient power represented by $\hat{P}_{tran}$, from the auxiliary information storage unit 441.

Next, the subframe power correction unit 442 calculates a corrected power of each subframe from the transient position information $l_{tran}$ and the decoded transient power represented by $\hat{P}_{tran}$, which are read from the auxiliary information storage unit 441 (step S7121 in FIG. 25). Specifically, the calculation is carried out according to the following procedure. First, the power of each subframe is calculated according to the following formula.

$$P(m) = \left\{10\log10\left(\frac{1}{K}\sum_{k=0}^{K-1} z^2(K\cdot m+k)\right)\right.$$

Next, the subframe power correction unit calculates a difference between the power of the first concealment signal at the position of the transient and the decoded transient power (differential transient power).

$$\dot{P}_{tran}=P(l_{tran})-\hat{P}_{tran}$$

Then the subframe power correction unit corrects the power of the first concealment signal corresponding to each subframe after the position of the transient, using the foregoing differential transient power, to obtain a corrected concealment signal subframe power.

$$\hat{P}(m) = \begin{cases} P(m)(0 \le m < l_{tran}) \\ P(m) + \dot{P}_{tran}(l_{tran} \le m < L-1) \end{cases}$$

Next, after calculating the power of each subframe for the first concealment signal, the subframe power correction unit 442 normalizes each of the resulting powers (step S7801 in FIG. 25). The lengths of the respective subframes may be set to be unequal as in the second to sixth embodiments. The present embodiment will detail the case where the lengths of the respective subframes are equal.

$$z'(K\cdot l+k) = \frac{z(K\cdot l+k)}{\sqrt{\frac{1}{K}\sum_{k=0}^{K-1} z^2(K\cdot l+k)}}$$

Finally, the subframe power correction unit multiplies the normalized first concealment signal by the corrected concealment signal subframe power to calculate a concealment signal (step S7131 in FIG. 25).

$$y(K\cdot l+k)=10^{\hat{P}(m)/20}\cdot z'(K\cdot l+k)$$

As a modification example of step S7121 in FIG. 25, the method of calculating from the subframe power P(m) and the decoded transient power:

$\hat{P}_{tran}$, the corrected concealment signal subframe power:

$\hat{P}(m)$ may be a method as represented by the following formula.

$$\dot{P}_{trans} = P(l_{tran}) - \hat{P}_{tran}$$

$$P'(m) = \begin{cases} P(m)(0 \le m < l_{tran}) \\ P(m) + \dot{P}_{tran}(l_{tran} \le m < L-1) \end{cases}$$

Finally, a corrected concealment signal power is calculated using a predetermined prediction coefficient $a_p$. The prediction coefficient may be switched to another, depending upon properties of subframe power sequences.

$$\hat{P}(m)=\Sigma_{p=0}^{P} a_p\cdot P'(m-p)$$

Alternatively, smoothing may be carried out using a model determined in advance.

$$\hat{P}(m)=f(P'(0), \ldots ,P'(L-1))$$

The function f to be used herein may be, for example, a sigmoid function, a spline function, or the like and there are no particular restrictions thereon as long as smoothing can be implemented.

The seventh embodiment as described above can realize the high-accuracy packet loss concealment for the transient signal, using the indication information indicative of the presence/absence of a sudden change of power, the position of the transient in the frame as an auxiliary information encoding target, and the power of the subframe at the position of the transient, as the auxiliary information about the sudden change of power (transient).

Eighth Embodiment (Configuration and Operation of Encoding Unit 1)

Figure 26:
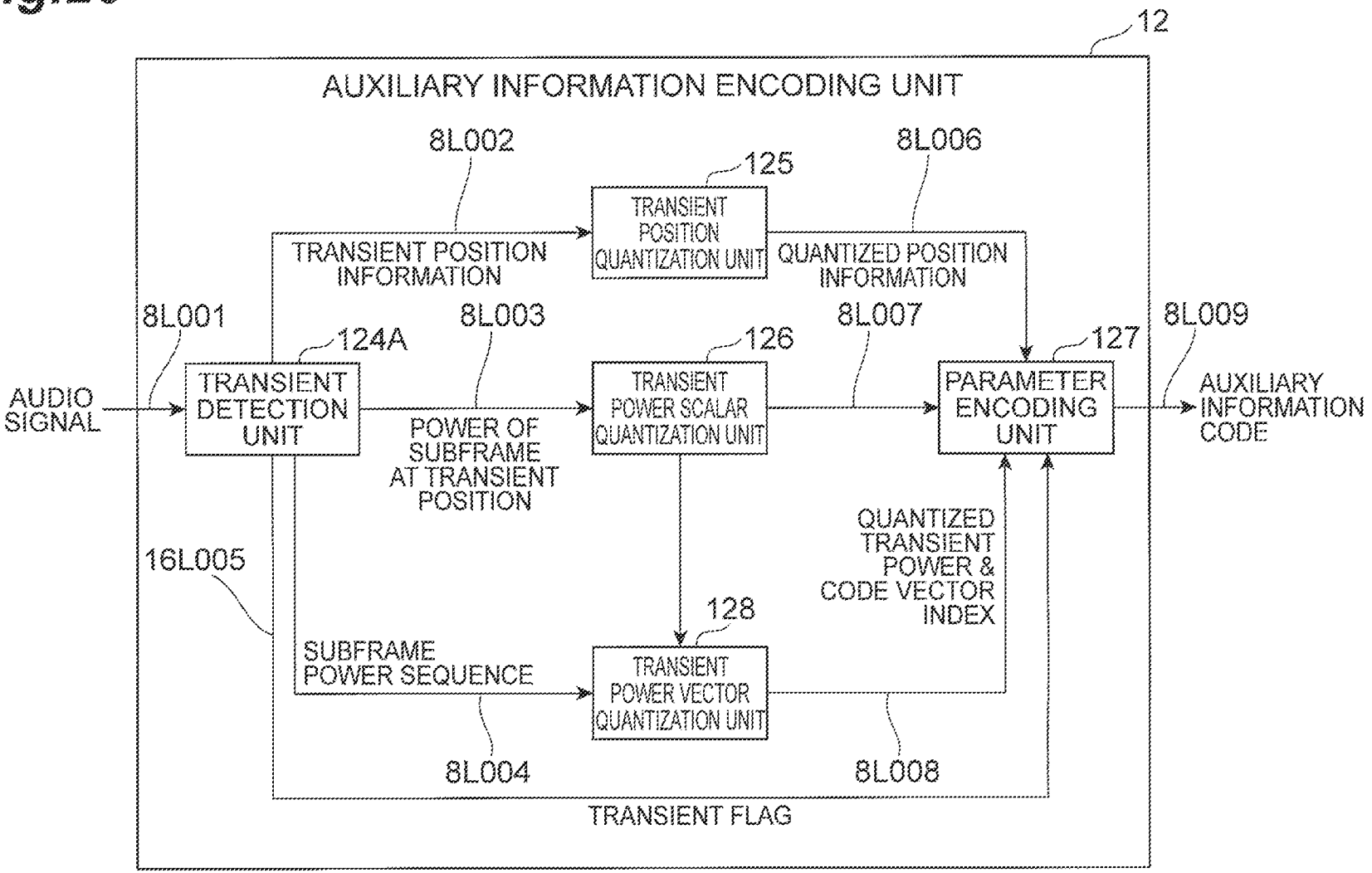
FIG. 26 is a configuration diagram of an example of the auxiliary information encoding unit in the eighth embodiment.

The auxiliary information encoding unit 12 in the eighth embodiment, as shown in FIG. 26, is provided with the transient detection unit 124A, the transient position quantization unit 125, the transient power scalar quantization unit 126, a transient power vector quantization unit 128, and the parameter encoding unit 127. The eighth embodiment is different in the provision of the transient power vector quantization unit 128, in addition to the transient power scalar quantization unit 126 in the seventh embodiment, and in the configuration and operation of the auxiliary information decoding unit 45, from the seventh embodiment.

Figure 27:
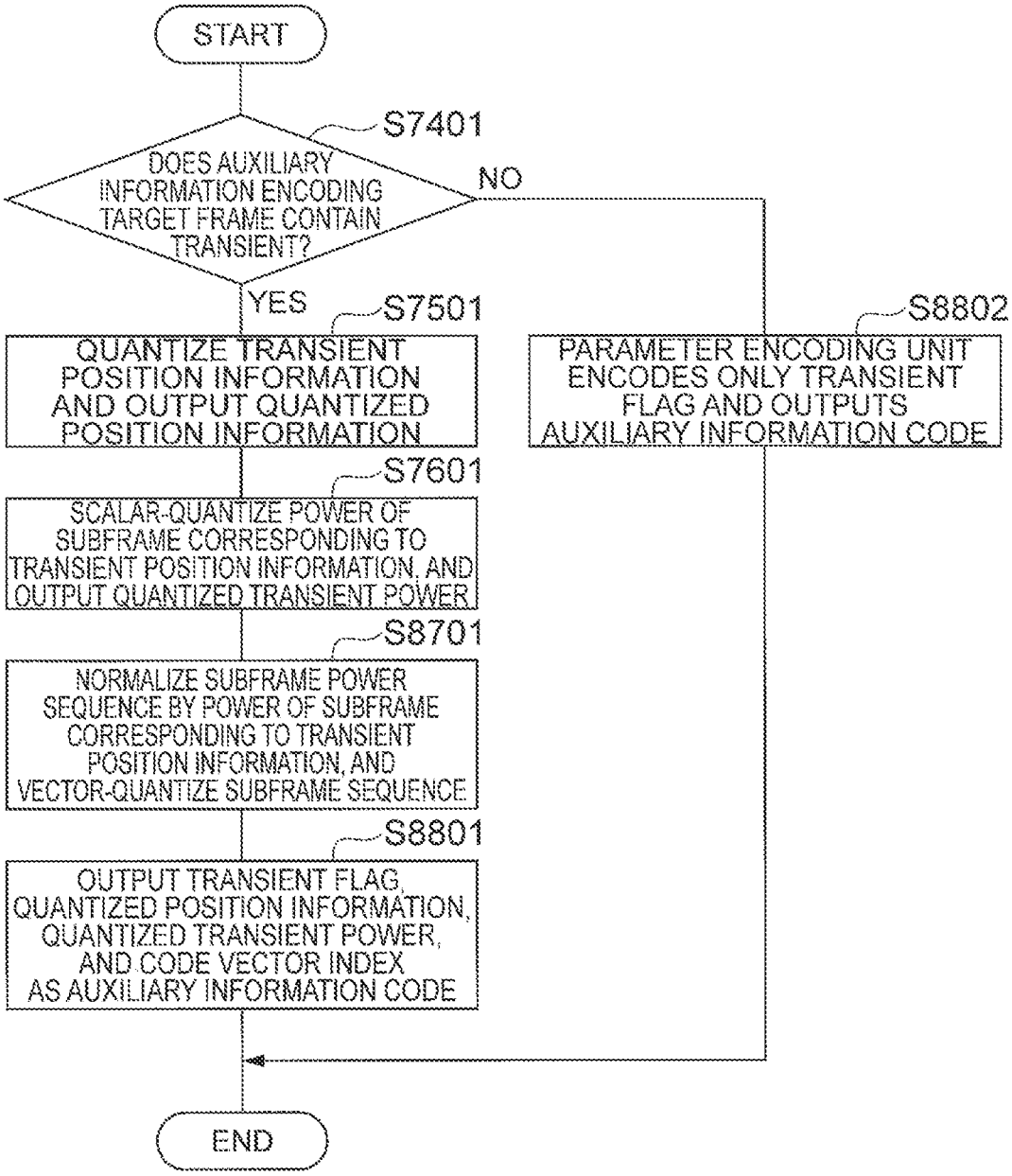
FIG. 27 is a flowchart of example processing by the auxiliary information encoding unit in FIG. 26.

The operation of the auxiliary information encoding unit 12 in the eighth embodiment is shown in FIG. 27. First, the transient detection unit 124A detects a transient in an auxiliary information encoding target frame (step S7401 in FIG. 27). A detection method of the transient is the same as in step S7401 in FIG. 21 in the seventh embodiment. The auxiliary information encoding target frame may be a frame later by one or more frames than the audio encoding target frame or a frame earlier by one or more frames than it. Furthermore, two or more frames may be selected from frames earlier or later by one or more frames than the audio encoding target frame, and the auxiliary information codes are calculated therefrom and used herein.

When a transient is detected, the following procedure is carried out. First, the transient position quantization unit 125 quantizes the transient position information (step S7501 in FIG. 27). A method of the quantization is the same as in step S7501 in FIG. 21 in the seventh embodiment.

Next, the transient power scalar quantization unit 126 performs the scalar quantization of the power of the subframe corresponding to the transient position and outputs the quantized transient power. The operation of the transient power scalar quantization unit 126 is the same as in the seventh embodiment (step S7601 in FIG. 27).

Next, the transient power vector quantization unit 128 normalizes the subframe power sequence, using the power of the subframe indicated by the quantized position information, and then performs vector quantization (step S8701 in FIG. 27).

$$\overline{P}(m) = \frac{P(m)}{P(l_{tran})}$$

The vector quantization is carried out according to the following formula.

$$J = \underset{i=0,\ldots,I-1}{\operatorname{argmin}} \sum_{l=0}^{L-1} (c_i(l) - \overline{P}(l + l_{tran} - L + 1))^2$$

The letter I represents the number of entries of straight lines or vectors in a codebook and the letter J represents an index of a selected straight line or vector (which will be referred to hereinafter as "code vector index"). $c_i(l)$ indicates the lth element of the ith code vector in the codebook.

Figure 28:
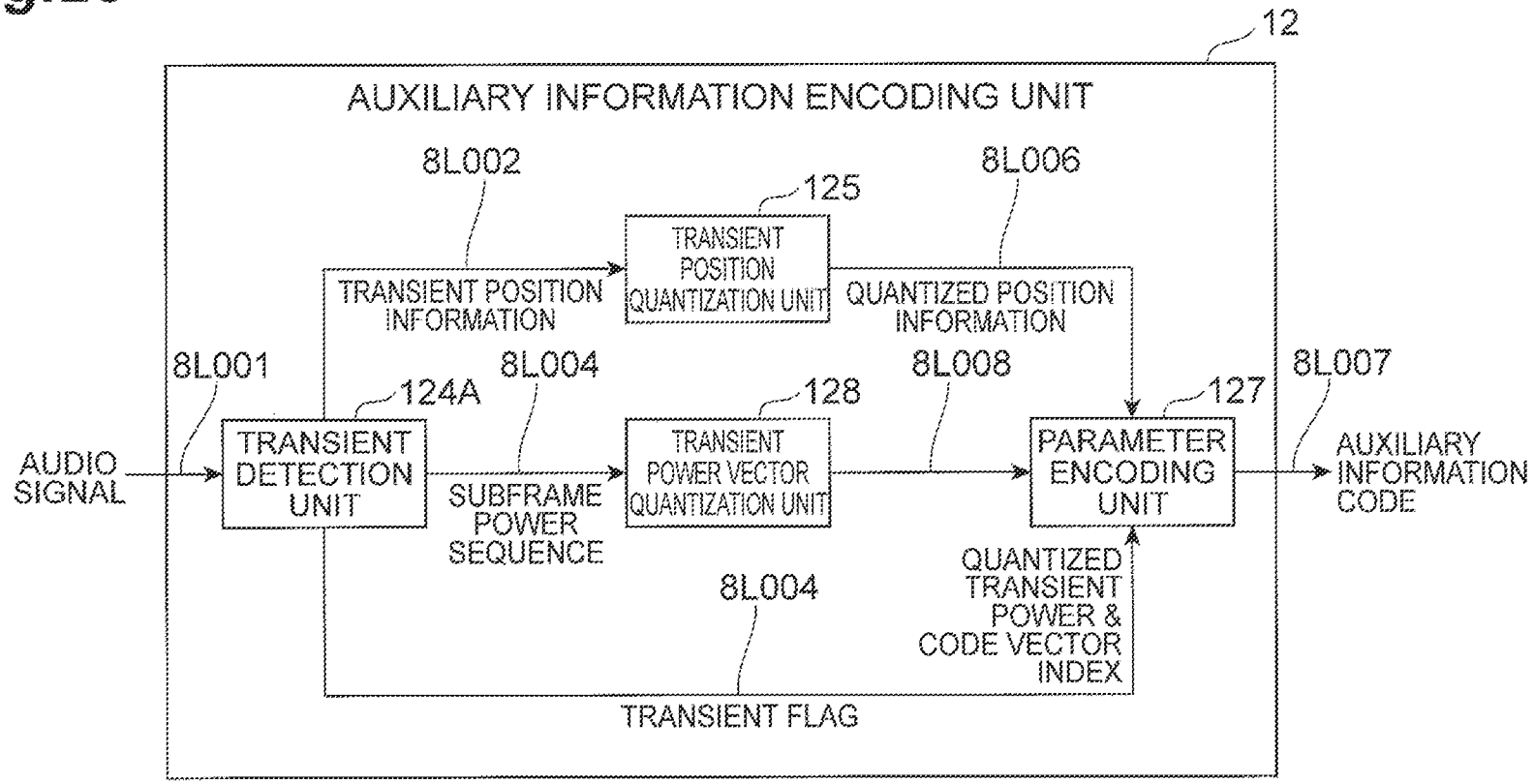
FIG. 28 is a configuration diagram showing a modification example of the auxiliary information encoding unit in the eighth embodiment.
Figure 29:
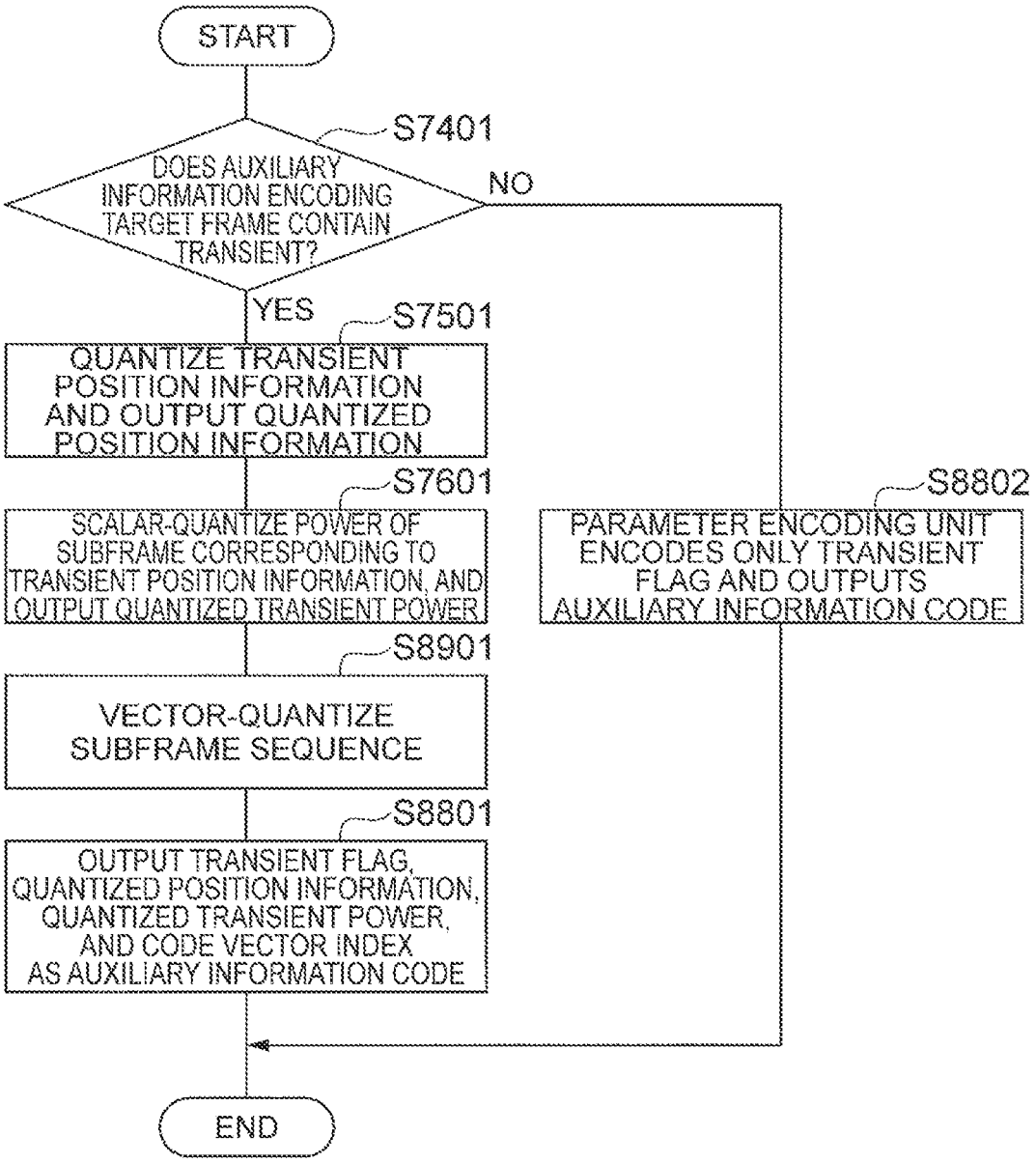
FIG. 29 is a flowchart of example processing by the auxiliary information encoding unit in FIG. 28.

The present embodiment showed the example of the vector quantization after the normalization of the subframe power sequence, whereas a modification example may adopt a configuration to perform the vector quantization without execution of the normalization as shown in FIG. 28. The operation of the auxiliary information encoding unit 12 in FIG. 28 is as shown in FIG. 29, and the vector quantization is carried out according to the following formula (step S8901 in FIG. 29), instead of S8701 in FIG. 27. The other is the same as in FIG. 27.

$$J = \underset{i=0,\ldots,I-1}{\operatorname{argmin}} \sum_{l=0}^{L-1} (c_i(l) - P(l + l_{tran} - L + 1))^2$$

Returning to FIG. 27, the parameter encoding unit 127 then outputs the transient flag, the quantized position information, the quantized transient power, and the code vector index as auxiliary information code (step S8801 in FIG. 27). The transient flag, the quantized position information, and the quantized transient power may be encoded by vector quantization or by another encoding method. There are no particular restrictions on the method of encoding. The auxiliary information may be encoded by variable length coding to encode the auxiliary information by a value of 2 or more bits only if the value of the transient flag indicates the existence of the transient, and to use only one bit indicative of the transient flag as auxiliary information if the value of the transient flag indicates the absence of the transient.

(Configuration and Operation of Decoding Unit 4)

Figure 30:
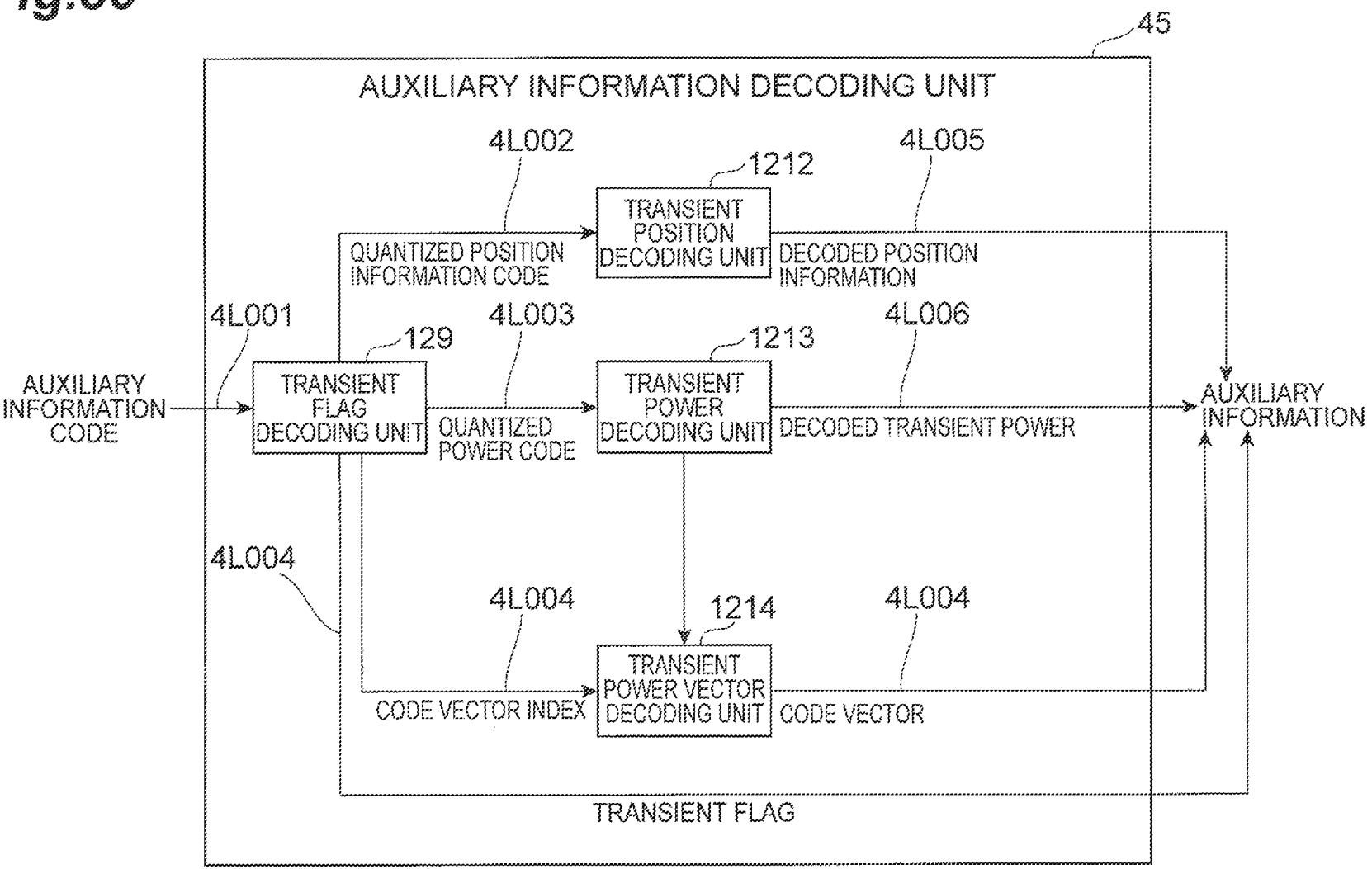
FIG. 30 is a configuration diagram of an example of the auxiliary information decoding unit in the eighth embodiment.

The eighth embodiment is different from the seventh embodiment, in the configuration and operation of the auxiliary information decoding unit 45 in FIG. 30 and in the operations of the auxiliary information storage unit 441 and the subframe power correction unit 442 in the concealment signal correction unit 44. As shown in FIG. 30, the auxiliary information decoding unit 45 is provided with the transient flag decoding unit 129, the transient position decoding unit 1212, the transient power decoding unit 1213, and a transient power vector decoding unit 1214.

Figure 31:
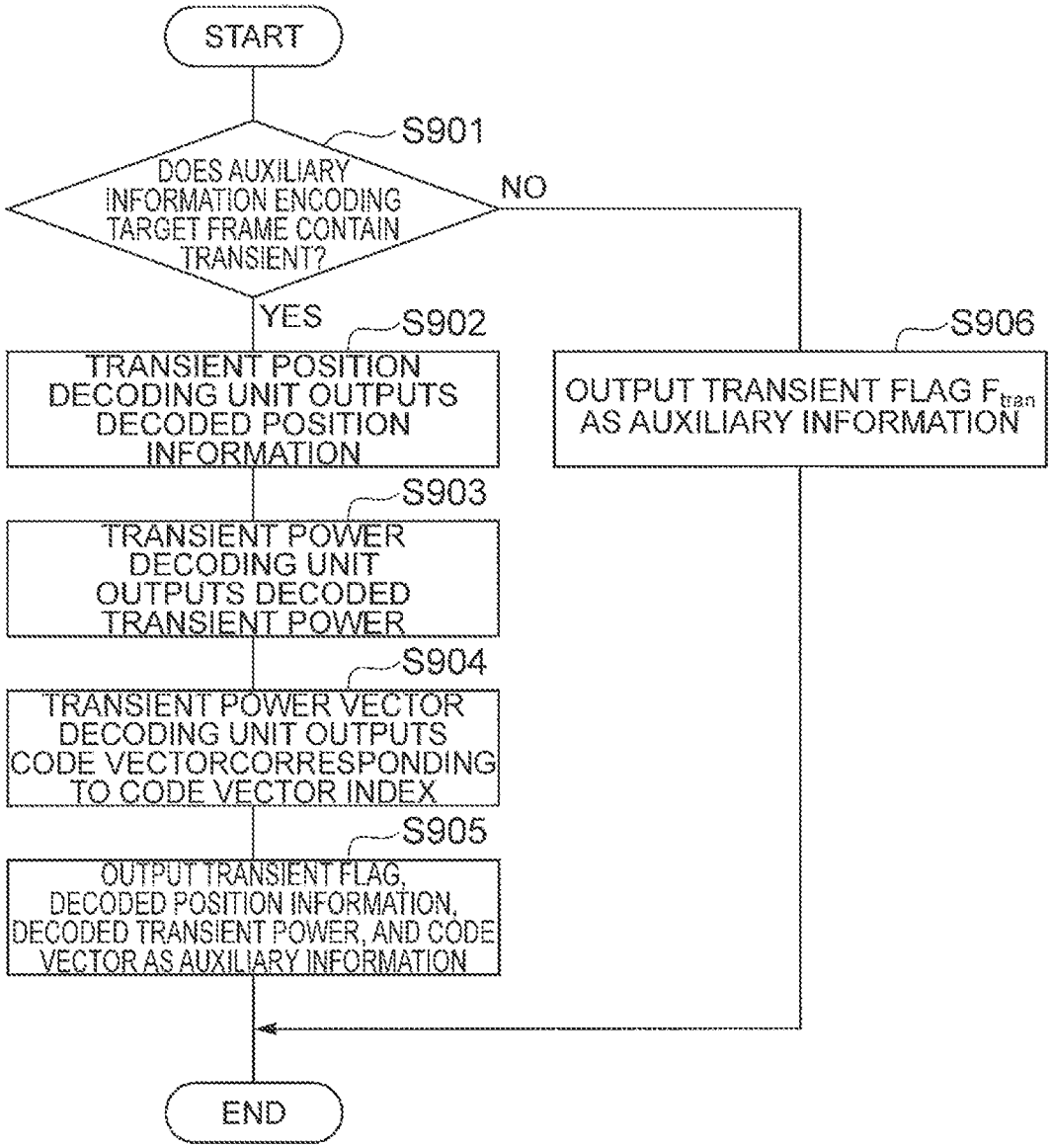
FIG. 31 is a flowchart of example processing by the auxiliary information decoding unit in FIG. 30.

The operation of the auxiliary information decoding unit 45 is shown in FIG. 31. The auxiliary information decoding unit 45 reads the transient flag $F_{tran}$, the quantized position information $l_{tran}$, the quantized transient power $I_E$, and the code vector index J from the auxiliary information code and determines the state of the transient flag $F_{tran}$ (step S901 in FIG. 31). When the value of the transient flag $F_{tran}$ indicates no transient, only the value of the transient flag $F_{tran}$ is output as auxiliary information (step S906 in FIG. 31), as in the seventh embodiment.

On the other hand, when the value of the transient flag $F_{tran}$ indicates a transient, the quantized position information $l_{tran}$ is decoded by the same method as in step S7121 in FIG. 23 in the seventh embodiment and the decoded position information is output (step S902 in FIG. 31).

Next, the decoded transient power is calculated from the quantized transient power by the same method as in step S7131 in FIG. 23 in the seventh embodiment (step S903 in FIG. 31).

A code vector $c_J(m)$ corresponding to the code vector index J is output (step S904 in FIG. 31).

Finally, the transient flag, decoded position information, decoded transient power, and code vector are output (step S905 in FIG. 31).

Next, the operation of the concealment signal correction unit 44 shown in FIG. 32 will be described with reference to the configuration of the concealment signal correction unit 44 shown in FIG. 24.

Figure 32:
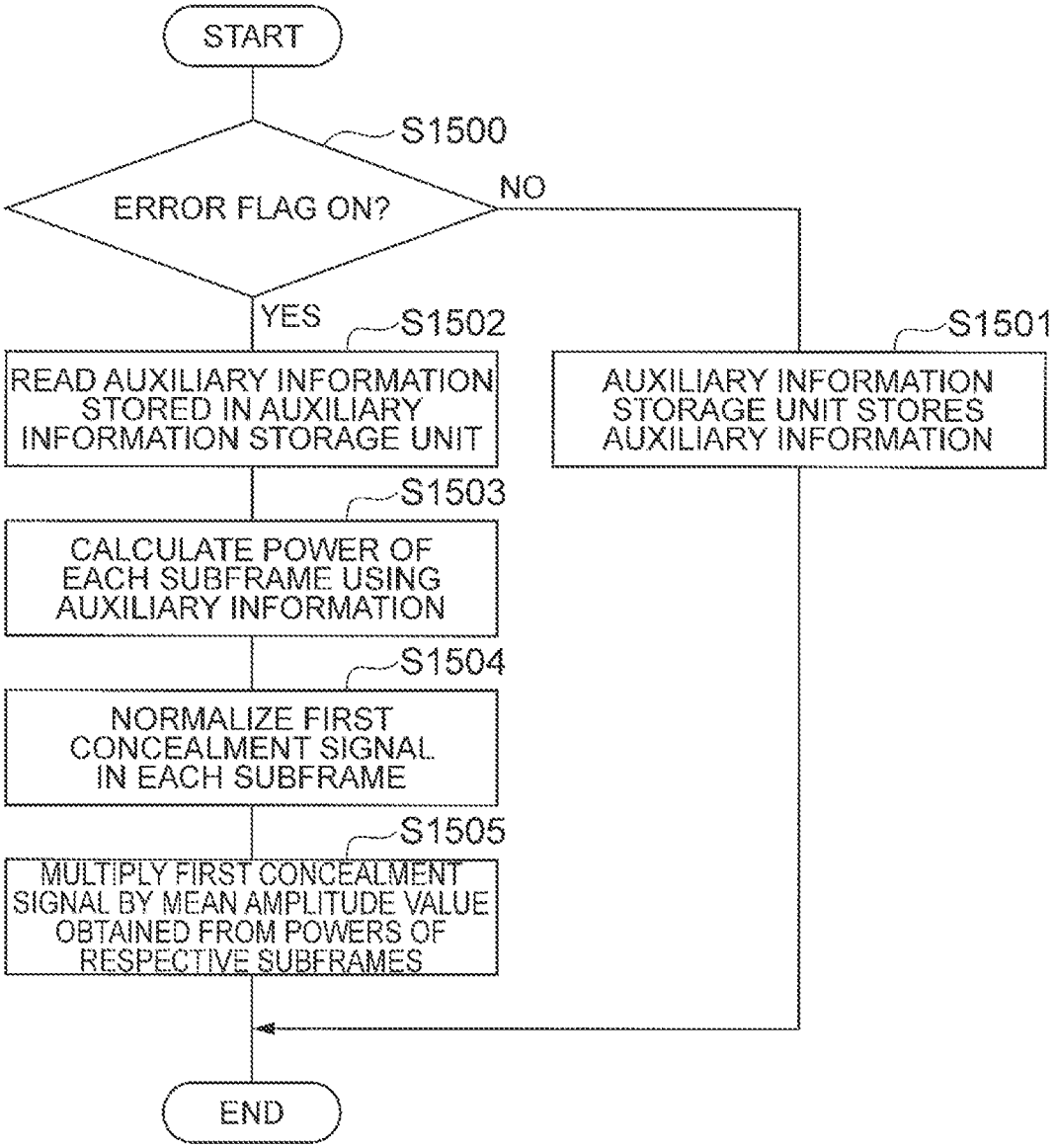
FIG. 32 is a flowchart of example processing by the concealment signal correction unit in the eighth embodiment.

First, the state of the error flag is determined (step S1500 in FIG. 32). For the determination on the state of the error flag, the value of the error flag entered from the outside may be read or it may be determined whether the first concealment signal from the first concealment signal generation unit 43 is fed to the subframe power correction unit 442. Specifically, the value of the error flag may be determined to indicate no packet loss (which is off), with input of the first concealment signal to the subframe power correction unit 442; the value of the error flag may be determined to indicate a packet loss (which is on), without input of the first concealment signal to the subframe power correction unit 442.

When the value of the error flag indicates no packet loss (off), the auxiliary information storage unit 441 stores the transient flag, decoded position information, decoded transient power, and code vector (step S1501 in FIG. 32).

On the other hand, when the value of the error flag indicates a packet loss (on), the subframe power correction unit 442 corrects the first concealment signal z(K·l+k) for a value of power of the first concealment signal in each subframe in accordance with the below-described formula to obtain the concealment signal y(K·l+k) (provided that 0≤l≤L−1 and 0≤k≤K−1). Specifically, the value of power of the first concealment signal is corrected in each subframe in accordance with the following procedure.

First, the correction unit reads the transient flag, decoded position information, decoded transient power, and code vector from the auxiliary information storage unit (step S1502 in FIG. 32).

Next, the power of each subframe is calculated using the auxiliary information (step S1503 in FIG. 32). In this step, first, the subframe power is calculated.

$$P(m) = \left\{10\log10\left(\frac{1}{K}\sum_{k=0}^{K-1} z^2(K\cdot m+k)\right)\right.$$

Next, the correction unit calculates the differential transient power which is the difference between the subframe power corresponding to the transient position and the decoded transient power.

$$\dot{P}_{tran}=P(l_{tran})-P_{tran}$$

Next, the corrected concealment signal subframe power is calculated using the differential transient power and the code vector.

$$\hat{P}(m) = \begin{cases} P_{trans}\cdot c_J(L-l_{tran}-1+m)(0\le m<l_{tran}) \\ P(m)+\dot{P}_{tran}(l_{tran}\le m<L-1) \end{cases}$$

The present embodiment shows the example of the vector quantization after the normalization of the values of the subframe power sequence on the encoder side, but it is also possible to adopt a method in which the vector quantization of the subframe power sequence is carried out without execution of the normalization. In the case without execution of the normalization, the corrected concealment signal subframe power is calculated as follows.

$$\hat{P}(m) = \begin{cases} c_J(L-l_{tran}-1+m)(0\le m<l_{tran}) \\ P(m)+\dot{P}_{tran}(l_{tran}\le m<L-1) \end{cases}$$

Next, the first concealment signal is normalized in each subframe (step S1504 in FIG. 32).

$$z'(K\cdot l+k) = \frac{z(K\cdot l+k)}{\sqrt{\frac{1}{K}\sum_{k=0}^{K-1} z^2(K\cdot l+k)}}$$

Finally, the normalized first concealment signal is multiplied by the corrected subframe power and the concealment signal is output (step S1505 in FIG. 32).

$$y(K\cdot l+k)=10^{\hat{P}(m)/20}\cdot z'(K\cdot l+k)$$

The eighth embodiment as described above can realize the high-accuracy packet loss concealment for the transient signal, further using the information obtained by the vector quantization of the transient power change, as the auxiliary information about the sudden change of power (transient).

Ninth Embodiment

The ninth embodiment will describe an example in which the processing as executed in the seventh and eighth embodiments is applied to signals resulting from a time-frequency transform. The auxiliary information encoding target frame may be a frame later by one or more frames than the audio encoding target frame or a frame earlier by one or more frames than it. The auxiliary information codes may be calculated from two or more frames selected from frames that are earlier or later by one or more frames than the audio encoding target frame, and used herein.

(Configuration and Operation of Encoding Unit 1)

The encoding unit 1 in the ninth embodiment has the same configuration as in FIG. 2 described in the first embodiment, and thus the detailed description of the entire unit will be omitted herein. The time-frequency transform is as described in the fourth embodiment and the signals after the transform into the frequency domain are denoted by V(k, l). The letter k herein is an index of a frequency bin (provided that 0≤k≤K−1) and l an index of a subframe (provided that 0≤l≤L−1).

The auxiliary information encoding unit will be described below in detail as a characteristic portion of the ninth embodiment. The auxiliary information encoding unit, as shown in FIG. 20, is provided with the transient detection unit 124A, transient position quantization unit 125, transient power scalar quantization unit 126, and parameter encoding unit 127. The ninth embodiment will describe an example using a position of a transient in a frame as an auxiliary information encoding target, and a power of at least one subband out of subbands resulting from division of the entire band into the subbands, out of powers in a subframe at the position of the transient, as auxiliary information about a sudden change of power (transient). In the encoding of the auxiliary information, the auxiliary information may be encoded by the vector quantization as executed in the eighth embodiment. The number of subbands to be encoded is not limited to one, but the same processing may be carried out for two or more subbands.

The transient detection unit 124A detects a transient, using the signals obtained by the transform into the frequency domain. The detection of transient may be carried out using the means used in the seventh embodiment, or using TS26.404 or the like which is the standard technology of transient detection for signals in the frequency domain, or using another transient detection technology for frequency-domain signals. The subband power sequence is calculated herein about values in a range ($K_s$≤k<$K_e$) in the frequency domain preliminarily determined in the transient detection. The signals in the frequency band to be used in the detection of transient may be signals in the entire band or only at least one specific subband may be used.

$$P(l) = 10\log_{10}\left(\frac{1}{K_e-K_s}\sum_{k=K_s}^{K_e-1} V^2(k,l)\right)$$

Concerning the method of encoding the transient position information, and, the value of the subband power corresponding to the transient position or the quantized value of the subband power corresponding to the transient position, the same method as in the seventh embodiment and the eighth embodiment can be applied to the subband power sequence calculated as described above. The subband power sequence to be encoded as auxiliary information may be calculated using the entire band or using only at least one specific subband. The subband power sequence to be encoded as auxiliary information may be a subband power sequence calculated for subbands used in the transient detection, or a subband power sequence calculated for subbands not used in the transient detection.

(Configuration and Operation of Decoding Unit 4)

The overall configuration of the decoding unit 4 is the same as in FIG. 6 described in the first embodiment. The below will describe the configurations and operations of the auxiliary information decoding unit 45 and the concealment signal correction unit 44 which are characteristic configurations in the eighth embodiment. The first concealment signal generation unit 43 may generate the first concealment signal, for example, by the existing standard technology as described in Section 5.2 in TS26.402, in addition to the means described in the first to sixth embodiments, or by another concealment signal generation technology which is not a standard.

When the error flag indicates a normal frame, the auxiliary information decoding unit 45 reads the transient flag $F_{tran}$, quantized position information $l_{tran}$, and quantized transient power $I_E$ from the auxiliary information code. In the case of the transient flag, quantized position information, and quantized transient power being encoded, the auxiliary information decoding unit 45 decodes the auxiliary information code by corresponding decoding means to obtain these parameters. For example, in the case using the linear quantization as described above, the decoded transient power is obtained from the quantized transient power in accordance with the following formula.

$$\hat{P}_{tran}=10^{C\cdot I_E/20}$$

Next, the operation of the concealment signal correction unit will be described. When the error flag indicates a packet loss, the subframe power correction unit 442 reads the auxiliary information from the auxiliary information storage unit 441 and corrects the first concealment signal Z(l, k) for a value of power of the first concealment signal in each subframe in accordance with the below formula to obtain the concealment signal Y(l, k). Specifically, it performs the correction in accordance with the below formula (provided that $0 \le l \le L-1$ and $0 \le k \le K-1$).

First, it reads the transient flag from the auxiliary information storage unit and determines the state of the transient. With indication of a transient, a power is obtained in each subframe as to the first concealment signal. The lengths of the respective subframes may be set to be unequal as in the second to sixth embodiments. The present embodiment will detail the case where the lengths of the respective subframes are equal.

$$P(m) = \left\{10\log10\left(\frac{1}{K_e - K_s}\sum_{k=K_s}^{K_e-1} Z^2(m, k)\right)\right.$$

Furthermore, the correction unit calculates the difference between the power of the first concealment signal at the position of the transient and the decoded transient power (differential transient power).

$$\dot{P}_{tran}=P(l_{tran})-\hat{P}_{tran}$$

Furthermore, it corrects the power of the first concealment signal corresponding to each subframe after the position of the transient, using the aforementioned differential transient power, to obtain the corrected concealment signal subframe power.

$$\hat{P}(m) = \begin{cases} P(m)(0 \le m < l_{tran}) \\ P(m) + \dot{P}_{tran}(l_{tran} \le m < L-1) \end{cases}$$

Next, the first concealment signal is normalized in each subframe.

$$Z'(l, k) = \frac{Z(l, k)}{\sqrt{\frac{1}{K_e - K_s}\sum_{k=K_s}^{K_e-1} Z^2(l, k)}}, (K_s \le k < K_e)$$

Finally, the normalized first concealment signal is multiplied by the corrected concealment signal subband power to calculate the concealment signal.

$$Y(l,k)=10^{\hat{P}(l)/20}\cdot Z'(l,k),(K_s \le k < K_e)$$

The smoothing as described in the seventh embodiment may be applied or the vector quantization as described in the eighth embodiment may be combined.

The concealment signal obtained finally is transformed into a signal in the time domain by the inverse transform unit 46 and the resulting concealment signal is output.

The ninth embodiment as described above allows the processing as executed in the seventh and eighth embodiments to be applied to the signals obtained by the time-frequency transform.

Tenth Embodiment

In the tenth embodiment, the encoder side outputs the auxiliary information code by the means in the seventh or eighth embodiment with the input signal being the transient signal, and conceals a packet loss signal with higher quality by the means in the first to third embodiments as to the part other than the transient signal. For the input signal expressed in the frequency domain, the method in the ninth embodiment may be used in the case of the transient and the methods in the fourth to sixth embodiments may be used in the case other than the transient.

(Operation and Configuration of Encoding Unit 1)

Figure 33:
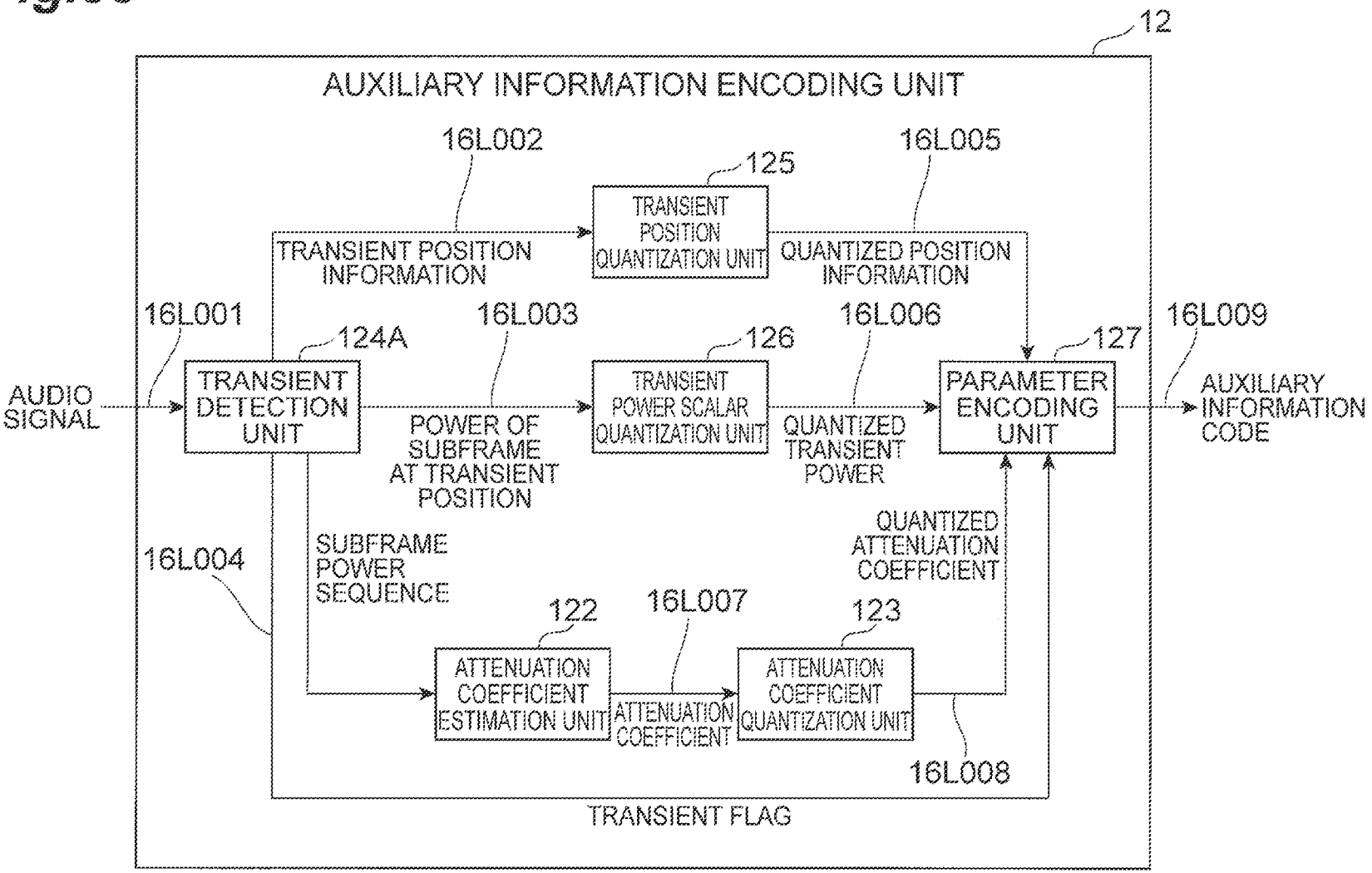
FIG. 33 is a configuration diagram of an example of the auxiliary information encoding unit in the tenth embodiment.

As shown in FIG. 33, the auxiliary information encoding unit 12 is provided with the attenuation coefficient estimation unit 122, attenuation coefficient quantization unit 123, transient detection unit 124A, transient position quantization unit 125, transient power scalar quantization unit 126, and parameter encoding unit 127. The operations of the individual constituent elements are the same as those described in the first, second, seventh, and eighth embodiments. The overall operation of the auxiliary information encoding unit 12 will be described below. The operation of the auxiliary information encoding unit 12 is shown in the flowchart of FIG. 34.

First, the transient detection unit 124A determines whether there is a transient in the input signal. The operation of the transient detection unit 124A is the same as in the seventh embodiment (step S1701 in FIG. 34). When there is no transient in the signal as an auxiliary information encoding target, the attenuation coefficient estimation unit 122 estimates the attenuation coefficient from the subframe power sequence by the same operation as in the first embodiment (step S1702 in FIG. 34).

Figure 34:
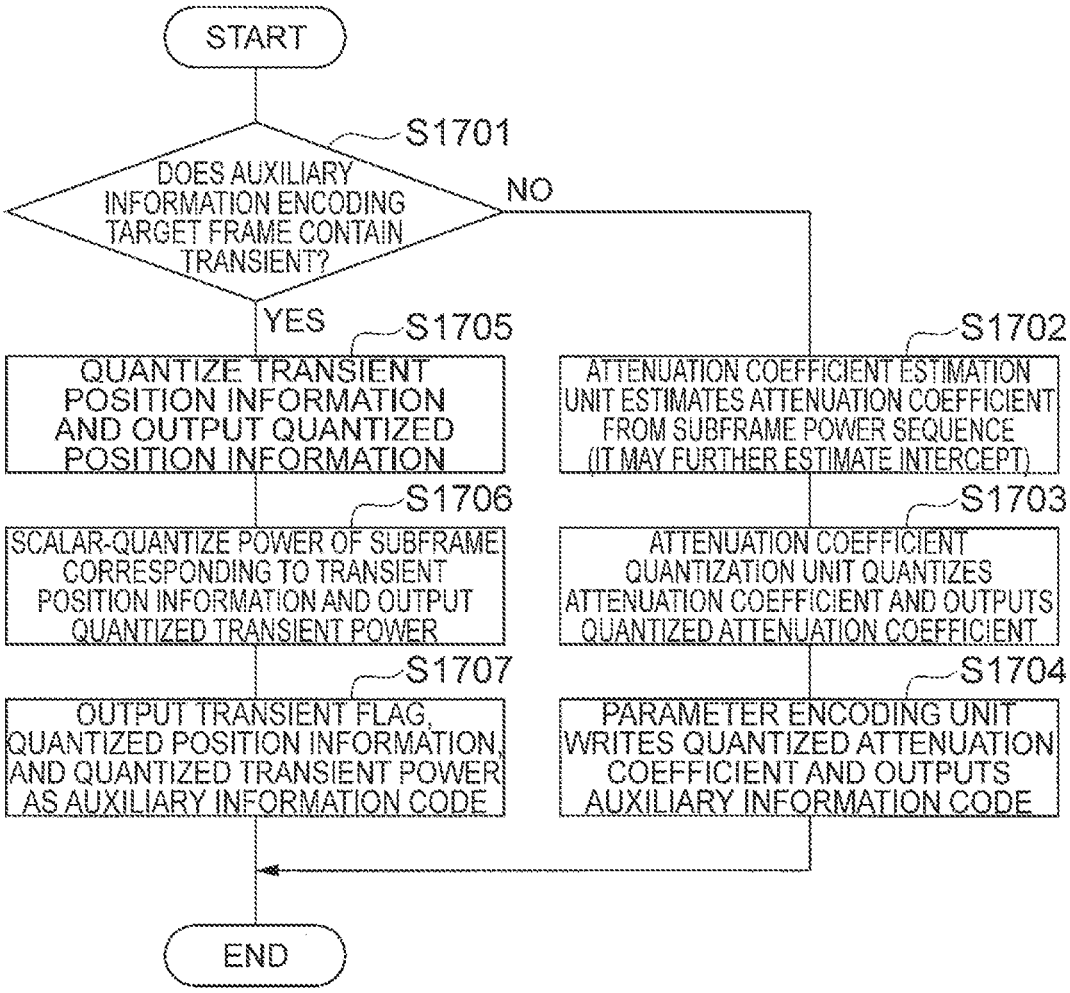
FIG. 34 is a flowchart of example processing by the auxiliary information encoding unit in FIG. 33.

Next, the attenuation coefficient quantization unit 123 quantizes the attenuation coefficient by the same operation as in the first embodiment, and outputs the quantized attenuation coefficient (step S1703 in FIG. 34).

Next, the parameter encoding unit 127 outputs the quantized attenuation coefficient as an auxiliary information code (step S1704 in FIG. 34).

The operations of the transient position quantization unit 125 and the transient power scalar quantization unit 126 with the signal as an auxiliary information encoding target containing a transient are the same as in the seventh embodiment (steps S1705-S1706 in FIG. 34).

Next, when the transient flag indicates the value for inclusion of a transient in the auxiliary information encoding target frame, the parameter encoding unit 127 encodes the transient flag, transient position information, and quantized transient power and outputs the auxiliary information code (step S1707 in FIG. 34).

(Operation and Configuration of Decoding Unit 4)

The overall configuration of the tenth embodiment is also the same as in the first embodiment to the ninth embodiment and therefore the operations of the auxiliary information decoding unit 45 and the concealment signal correction unit 44 being the major differences will be described below.

Figure 35:
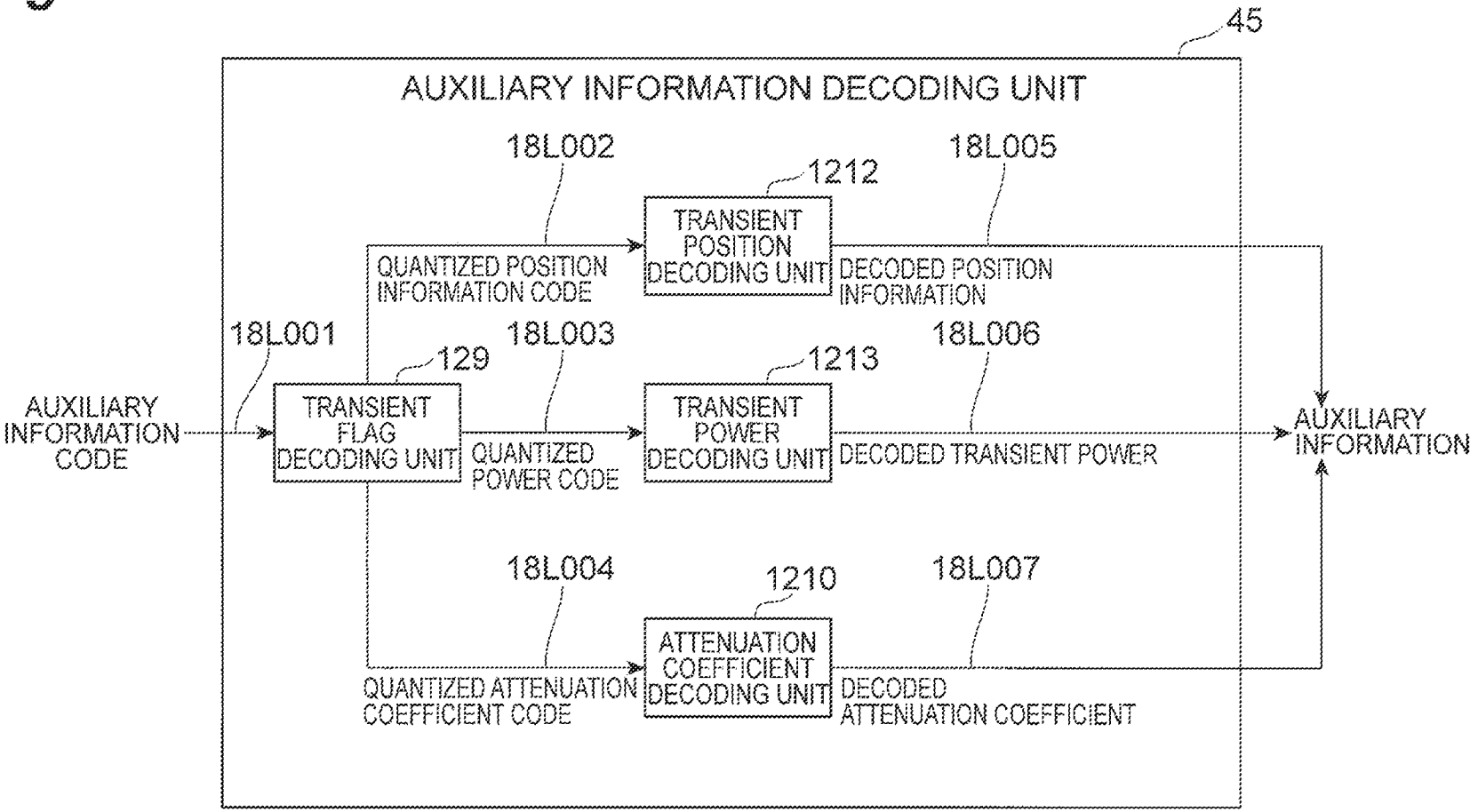
FIG. 35 is a configuration diagram of an example of the auxiliary information decoding unit in the tenth embodiment.

The auxiliary information decoding unit 45, as shown in FIG. 35, is provided with the transient flag decoding unit 129, attenuation coefficient decoding unit 1210, transient position decoding unit 1212, and transient power decoding unit 1213. The operation of the auxiliary information decoding unit 45 will be described below. The flowchart to show the flow of operation is as shown in FIG. 36.

Figure 36:
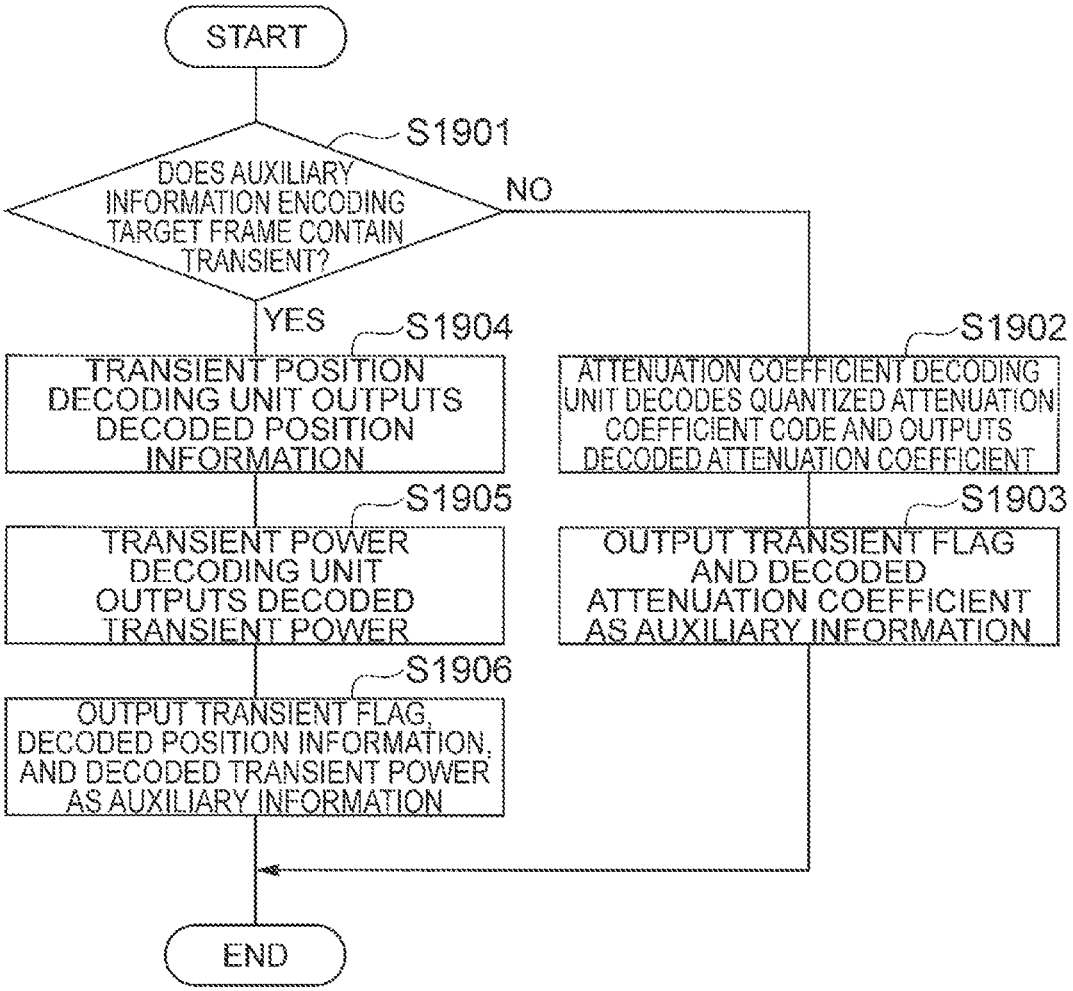
FIG. 36 is a flowchart of example processing by the auxiliary information decoding unit in FIG. 35.

The transient flag decoding unit 129 reads the transient flag from the auxiliary information code and determines whether the auxiliary information code corresponds to a transient signal (step S1901 in FIG. 36).

When the transient flag indicates that the auxiliary information code does not correspond to a transient, the attenuation coefficient decoding unit 1210 reads the quantized attenuation coefficient code from the auxiliary information code, decodes the quantized attenuation coefficient code, and outputs the resulting decoded attenuation coefficient and transient flag as auxiliary information (steps S1902-S1903 in FIG. 36). The basic operation of the attenuation coefficient decoding unit 1210 is the same as the calculation of the attenuation coefficient in the auxiliary information decoding unit in the first embodiment.

On the other hand, when the transient flag indicates that the auxiliary information code corresponds to a transient, the transient position decoding unit 1212 decodes the quantized transient position information and outputs the resulting transient position information (which will be referred to hereinafter as "decoded position information") (step S1904 in FIG. 36), and the transient power decoding unit 1213 decodes the encoded quantized power and outputs the resulting decoded transient power (step S1905 in FIG. 36), thereby outputting the transient flag, the decoded position information, and the decoded transient power as auxiliary information (step S1906 in FIG. 36). The operations of the transient position decoding unit 1212 and the transient power decoding unit 1213 are the same as in the seventh embodiment.

Figure 37:
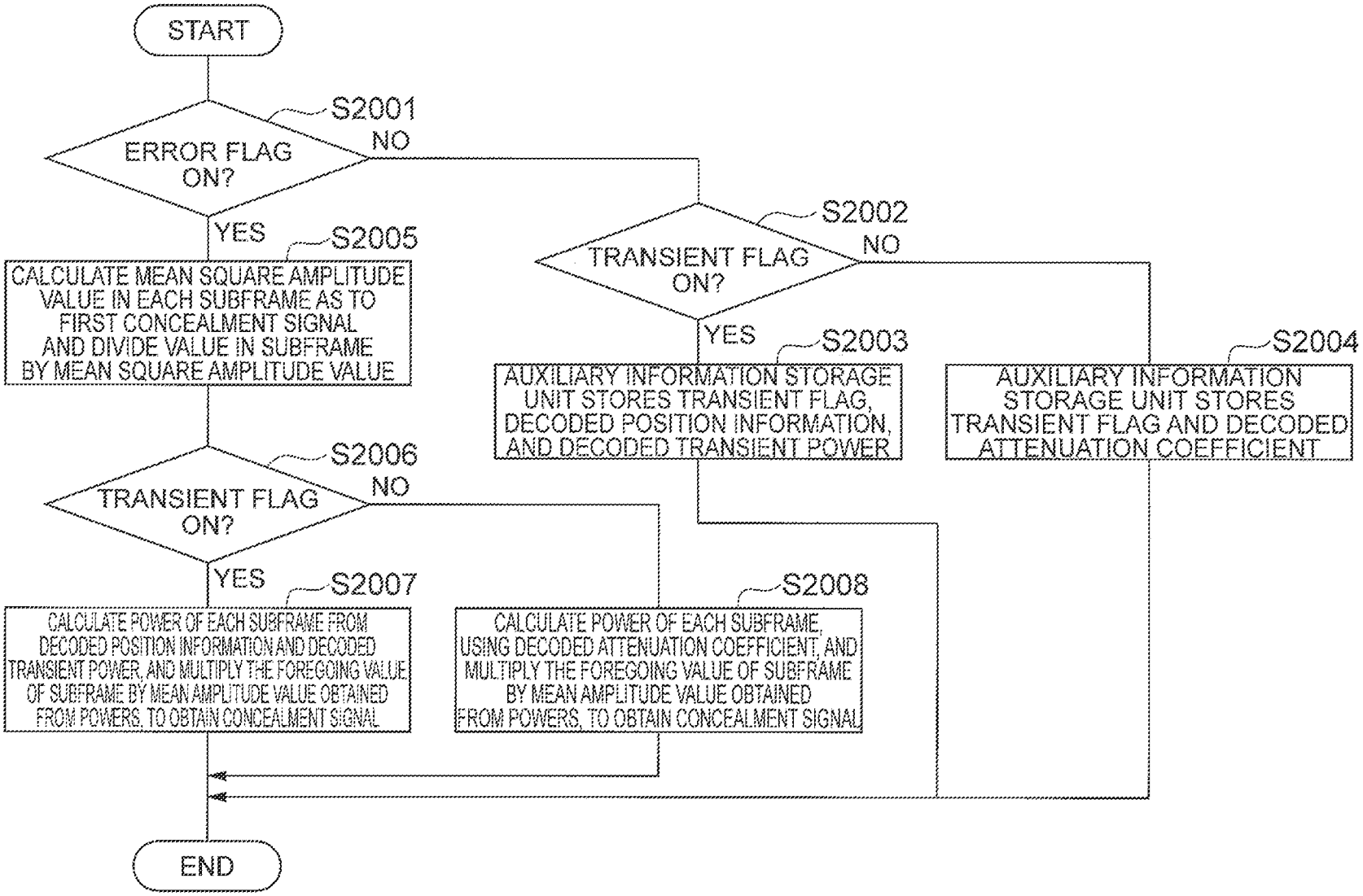
FIG. 37 is a flowchart of example processing by the concealment signal correction unit in the tenth embodiment.

The flowchart to show the flow of the operation by the concealment signal correction unit 44 in FIG. 24 is as shown in FIG. 37. The operation of the concealment signal correction unit 44 will be described below.

With reference to the error flag, the unit determines whether the packet contains an error (step S2001 in FIG. 37). When the error flag indicates a normal frame, the auxiliary information storage unit 441 refers to the value of the transient flag (step S2002 in FIG. 37) and, in the case of a transient, it stores the transient flag, decoded position information, and decoded transient power (step S2003 in FIG. 37). On the other hand, when there is no transient, it stores the transient flag and decoded attenuation coefficient (step S2004 in FIG. 37).

On the other hand, when the error flag indicates a packet loss, the subframe power correction unit 442 normalizes the first concealment signal (step S2005 in FIG. 37). The method of normalization is the same as the normalization of the first concealment signal in the seventh embodiment.

Next, the subframe power correction unit 442 reads the transient flag from the auxiliary information storage unit 441 and determines the value of the transient flag (step S2006 in FIG. 37). When the transient flag shows the value indicative of a transient, the subframe power correction unit 442 reads the decoded position information and decoded transient power from the auxiliary information storage unit 441, calculates powers of respective subframes from these decoded position information and decoded transient power, and multiplies the value of the subframe obtained in step S2005, by a mean amplitude value calculated from the foregoing powers, to obtain the concealment signal (step S2007 in FIG. 37).

On the other hand, when the transient flag shows no transient, the subframe power correction unit 442 reads the decoded attenuation coefficient from the auxiliary information storage unit 441 and calculates the subframe power sequence from the decoded attenuation coefficient by the same method as the method described in the first embodiment. Next, the subframe power correction unit 442 calculates a gain from the calculated subframe power sequence and multiplies the normalized first concealment signal by the obtained gain to obtain the concealment signal (step S2008 in FIG. 37).

The technique of the tenth embodiment described above may be applied to the input signal resulting from the transform into the frequency domain. In applying the technique to the input signal resulting from the transform into the frequency domain, the calculation and encoding of auxiliary information may be carried out for at least one subband.

In the tenth embodiment as described above, the encoder side can output the auxiliary information code by the means in the seventh or eighth embodiment with the input signal being a transient signal, and conceal a packet loss signal with higher quality with the use of the means in the first to third embodiments for the part other than the transient signal as well.

Eleventh Embodiment

Figure 38:
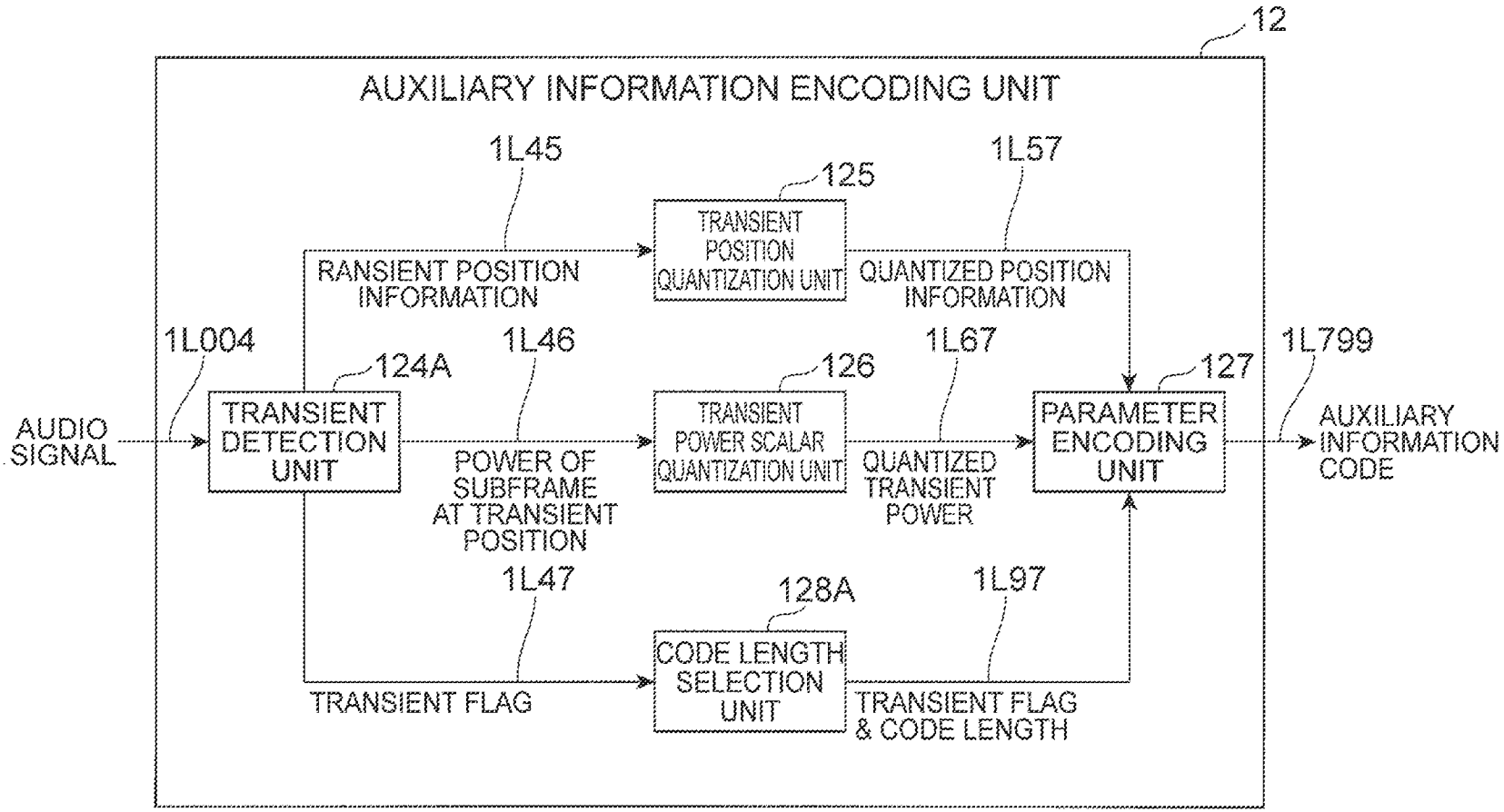
FIG. 38 is a configuration diagram of an example of the auxiliary information encoding unit in the eleventh embodiment.

As shown in FIG. 38, a code length selection unit 128A is added to the auxiliary information encoding unit 12, whereby the auxiliary information is encoded by a value of 2 or more bits only if the value of the transient flag is the value indicating the existence of a transient and whereby the auxiliary information is encoded by only one bit indicative of the transient flag if the value of the transient flag is the value indicative of the absence of a transient. The auxiliary information may be encoded by the variable length coding as described above, or may be always encoded by the same bit count so as to fill zeros as many as the same bit count as the transient position information and the quantized transient power in the absence of a transient as well, or any other information may be encoded instead to form the auxiliary information code.

It is a matter of course that the configuration wherein the auxiliary information encoding unit is provided with the code length selection unit to make the code length of auxiliary information variable as in the present embodiment can be applied to all of the first embodiment to the tenth embodiment.

The below will describe the configuration and operation in the case where the code length selection unit is added to the configuration of the seventh embodiment to allow the variable code length. The auxiliary information encoding unit 12, as shown in FIG. 38, is provided with the transient detection unit 124A, transient position quantization unit 125, transient power scalar quantization unit 126, parameter encoding unit 127, and code length selection unit 128A.

The operation of the auxiliary information encoding unit 12 will be described based on FIG. 39. The transient detection unit 124A performs the detection of transient by the same operation as in the seventh embodiment (step S2201 in FIG. 39).

Figure 39:
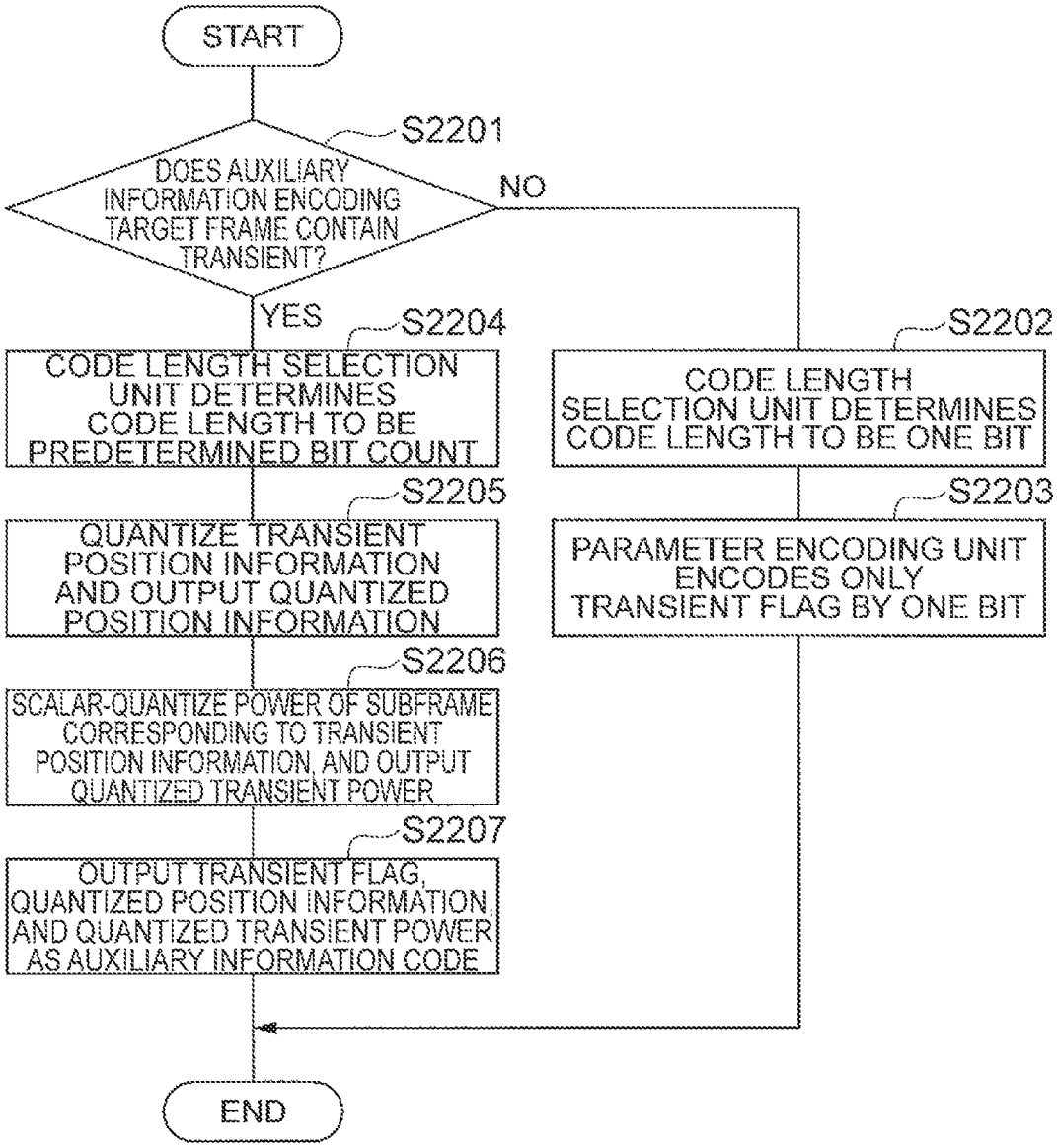
FIG. 39 is a flowchart of example processing by the auxiliary information encoding unit in FIG. 38.

When the transient flag $F_{tran}$ indicates the value for inclusion of a transient in a frame, the code length selection unit 128A outputs a predetermined bit count larger than one bit (step S2204 in FIG. 39).

The transient position quantization unit 125 scalar-quantizes the position $l_{tran}$ of the transient by the predetermined bit count and outputs the quantized position information (step S2205 in FIG. 39). The operation of the transient position quantization unit 125 is the same as in the seventh embodiment.

Next, the transient power scalar quantization unit 126 performs the scalar quantization of the power of the subframe corresponding to the position $l_{tran}$ of the transient and outputs the quantized transient power (step S2206 in FIG. 39). The operation of the transient power scalar quantization unit 126 is the same as in the seventh embodiment.

The parameter encoding unit 127 outputs the transient flag, quantized position information, and quantized transient power together as an auxiliary information code (step S2207 in FIG. 39). At this time, the total length of the auxiliary information code is the value determined in step S2204 in FIG. 39.

On the other hand, when it is determined in step S2201 that the transient flag $F_{tran}$ does not show the value for inclusion of a transient in a frame, the code length selection unit 128A determines the code length to be one bit (step S2202 in FIG. 39). Next, the parameter encoding unit 127 encodes only the transient flag by one bit and outputs it (step S2203 in FIG. 39).

(Configuration and Operation of Decoding Unit 4)

The auxiliary information decoding unit 45, as shown in FIG. 22, is provided with the transient flag decoding unit 129, transient position decoding unit 1212, and transient power decoding unit 1213, as in the seventh embodiment.

The operation of the auxiliary information decoding unit 45 of this configuration will be described based on FIG. 40. The auxiliary information decoding unit 45 decodes the auxiliary information code and determines whether the resulting transient flag $F_{tran}$ is on (to indicate a frame containing a transient) or off (to indicate a frame containing no transient) (step S2401 in FIG. 40).

Figure 40:
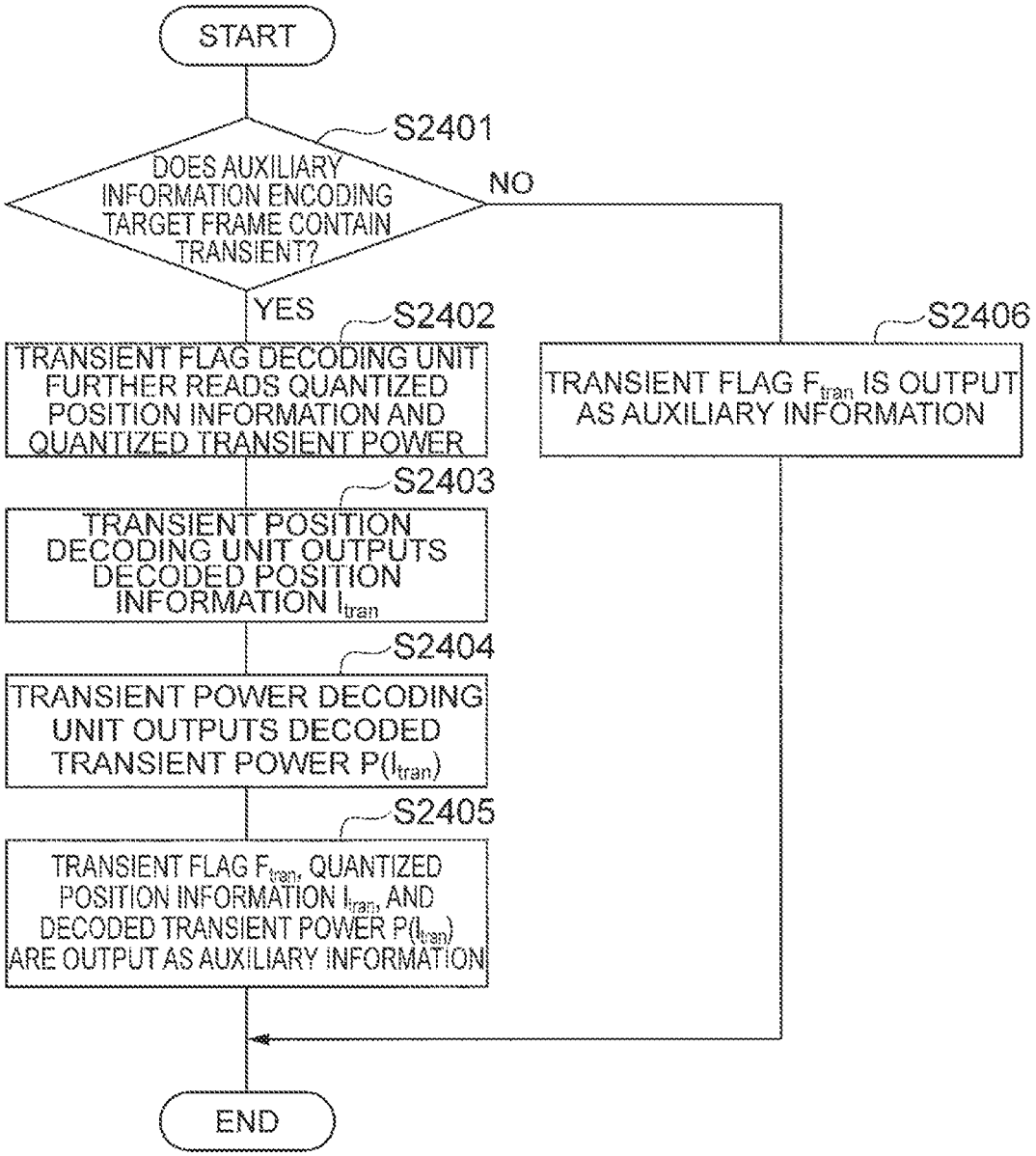
FIG. 40 is a flowchart of example processing by the auxiliary information decoding unit in the eleventh embodiment.

When the transient flag $F_{tran}$ shows a frame containing a transient, the transient flag decoding unit 129 further reads the quantized position information from the auxiliary information code and outputs the information to the transient position decoding unit 1212, and it further reads the quantized transient power $I_E$ from the auxiliary information code and outputs the power to the transient power decoding unit 1213 (step S2402 in FIG. 40).

Next, the transient position decoding unit 1212 decodes the quantized position information and outputs the resulting decoded position information $l_{tran}$ (step S2403 in FIG. 40). Furthermore, the transient power decoding unit 1213 decodes the quantized transient power $I_E$ and outputs the resulting decoded transient power $P(l_{tran})$ (step S2404 in FIG. 40).

This operation results in outputting the transient flag $F_{tran}$, decoded position information $l_{tran}$, and decoded transient power $P(l_{tran})$ as auxiliary information (step S2405 in FIG. 40). The steps S2403 to S2405 in FIG. 40 are the same as in the seventh embodiment.

On the other hand, when the transient flag $F_{tran}$ shows a frame containing no transient, only the transient flag $F_{tran}$ is output as auxiliary information (step S2406 in FIG. 40).

The operation of the concealment signal correction unit 44 (FIG. 24) is the same as in the seventh embodiment.

The eleventh embodiment as described above allows the code length of the auxiliary information to be made variable.

Twelfth Embodiment

The twelfth embodiment will describe a modification example of the seventh embodiment. The present embodiment will describe an example in which only the quantized transient power is transmitted as auxiliary information.

(Configuration and Operation of Encoding Unit 1)

Figure 43:
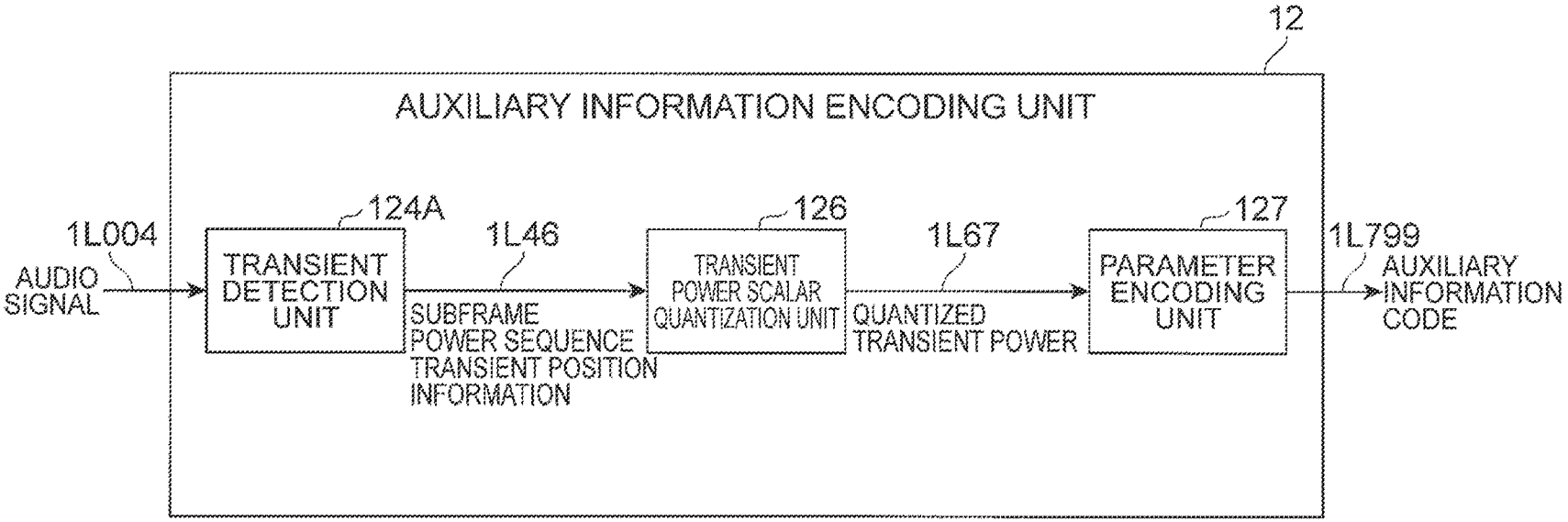
FIG. 43 is a configuration diagram of an example of the auxiliary information encoding unit in the twelfth embodiment.

The configuration of the encoding unit 1 is the same as in the first embodiment. The below will describe the configuration and operation of the auxiliary information encoding unit 12 which is a characteristic configuration in the present embodiment. The configuration of the auxiliary information encoding unit 12, as shown in FIG. 43, is provided with the transient detection unit 124A, transient power scalar quantization unit 126, and parameter encoding unit 127.

The transient detection unit 124A outputs the subframe power sequence by the same processing as in the seventh embodiment. The position of the transient may be determined to be a position where the subframe power exceeds a predetermined threshold, or a position where a ratio of subframe power to power of an immediately-preceding subframe becomes maximum. It may also be such a position that a dispersion of subframe powers for a fixed period of time stored in a buffer is calculated and the resulting dispersion becomes maximum at the position.

Next, the transient power scalar quantization unit 126 quantizes the subframe power at the transient position by the same method as in the seventh embodiment and outputs the quantized transient power to the parameter encoding unit 127.

Then the parameter encoding unit 127 encodes only the quantized transient power to generate the auxiliary information code.

(Configuration and Operation of Decoding Unit 4)

The overall configuration of the decoding unit 4 is the same as in the first embodiment (as shown in FIG. 6). The below will describe the configuration and operation of the auxiliary information decoding unit 45 which is a characteristic configuration in the present embodiment. The first concealment signal generation unit 43 generates the first concealment signal by the same method as in the seventh embodiment.

Figure 44:
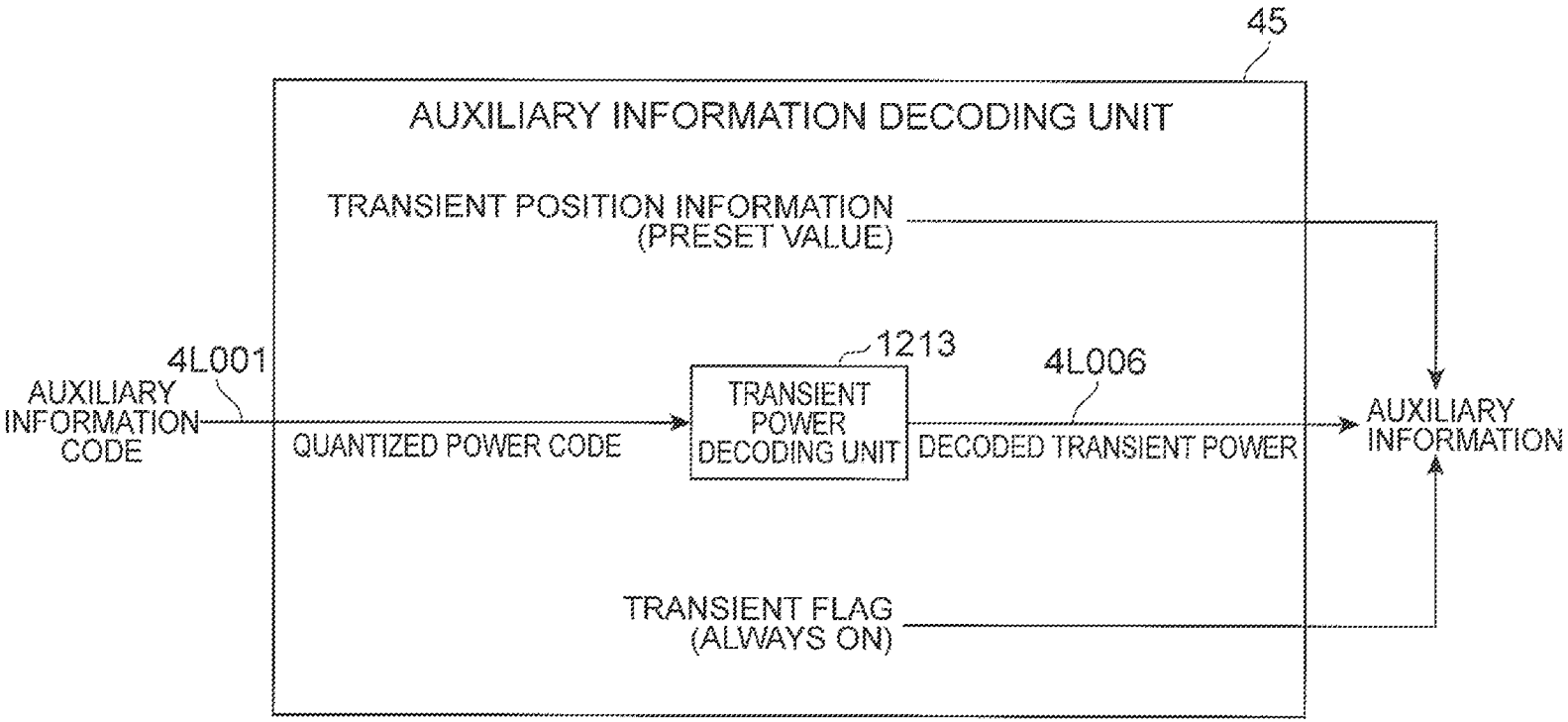
FIG. 44 is a configuration diagram of an example of the auxiliary information decoding unit in the twelfth embodiment.

The configuration of the auxiliary information decoding unit 45 in the present embodiment is as shown in FIG. 44. In the present embodiment, the auxiliary information code transmitted from the encoding unit 1 does not contain the transient flag and the quantized position information. Then, in the present embodiment the transient flag is always set to the value of on and a predetermined value $l_{const}$ is always set as the transient position information. The transient power decoding unit 1213 decodes the auxiliary information code (quantized power code) containing only the quantized transient power by the same processing as in the seventh embodiment and outputs the decoded transient power.

The concealment signal correction unit 44 in FIG. 6 processes the foregoing transient flag, transient position information, and output decoded transient power as auxiliary information.

As described above, it is feasible to realize the embodiment to transmit only the quantized transient power as the auxiliary information, while achieving the same effect as the seventh embodiment.

Thirteenth Embodiment

The thirteenth embodiment will describe another modification example of the seventh embodiment. The present embodiment will describe an example in which only the transient flag and the quantized transient power are transmitted as auxiliary information.

(Configuration and Operation of Encoding Unit 1)

Figure 45:
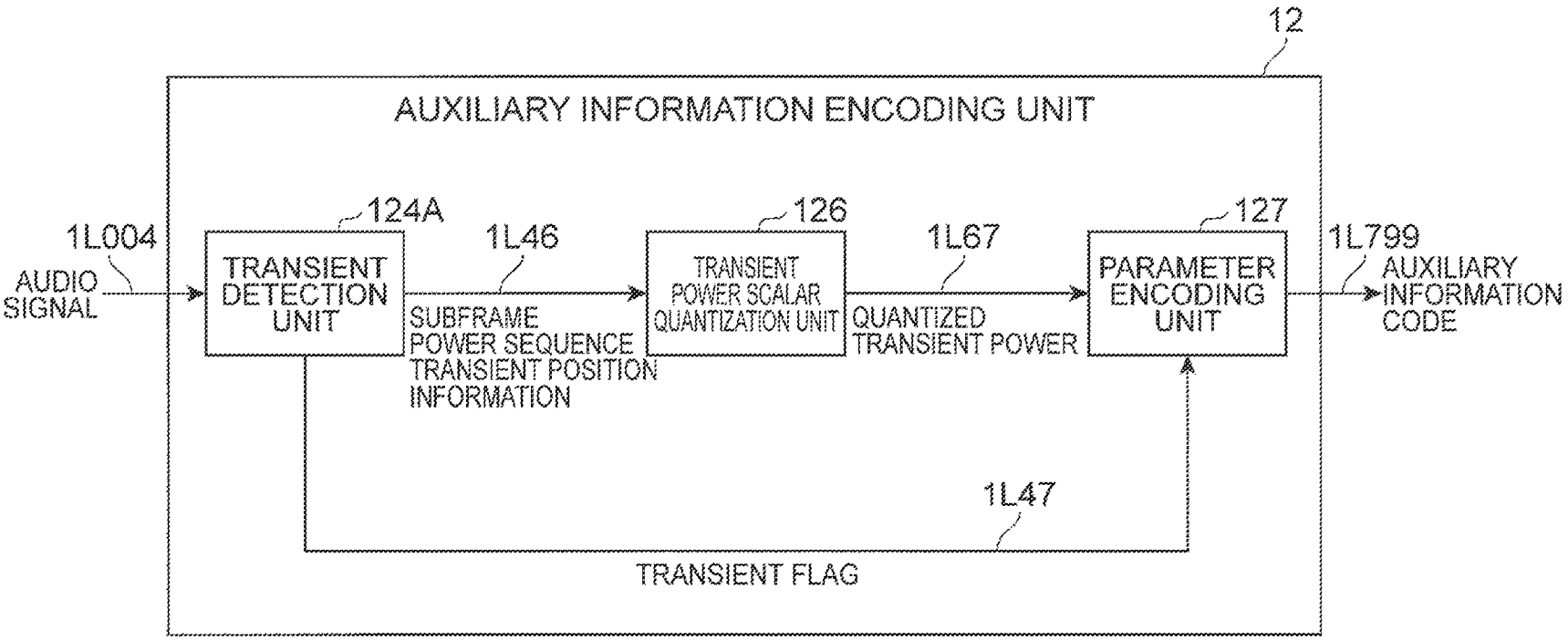
FIG. 45 is a configuration diagram of an example of the auxiliary information encoding unit in the thirteenth embodiment.

The below will describe the configuration and operation of the auxiliary information encoding unit 12 which is a characteristic configuration in the present embodiment. The configuration of the auxiliary information encoding unit 12, as shown in FIG. 45, is provided with the transient detection unit 124A, transient power scalar quantization unit 126, and parameter encoding unit 127.

The operations of the transient detection unit 124A and the transient power scalar quantization unit 126 are the same as in the seventh embodiment.

The parameter encoding unit 127 encodes the transient flag and the quantized transient power together to generate the auxiliary information code. When the value of the transient flag is off, the parameter encoding unit 127 does not enter the quantized transient power in the auxiliary information code, as in the seventh embodiment.

(Configuration and Operation of Decoding Unit 4)

Figure 46:
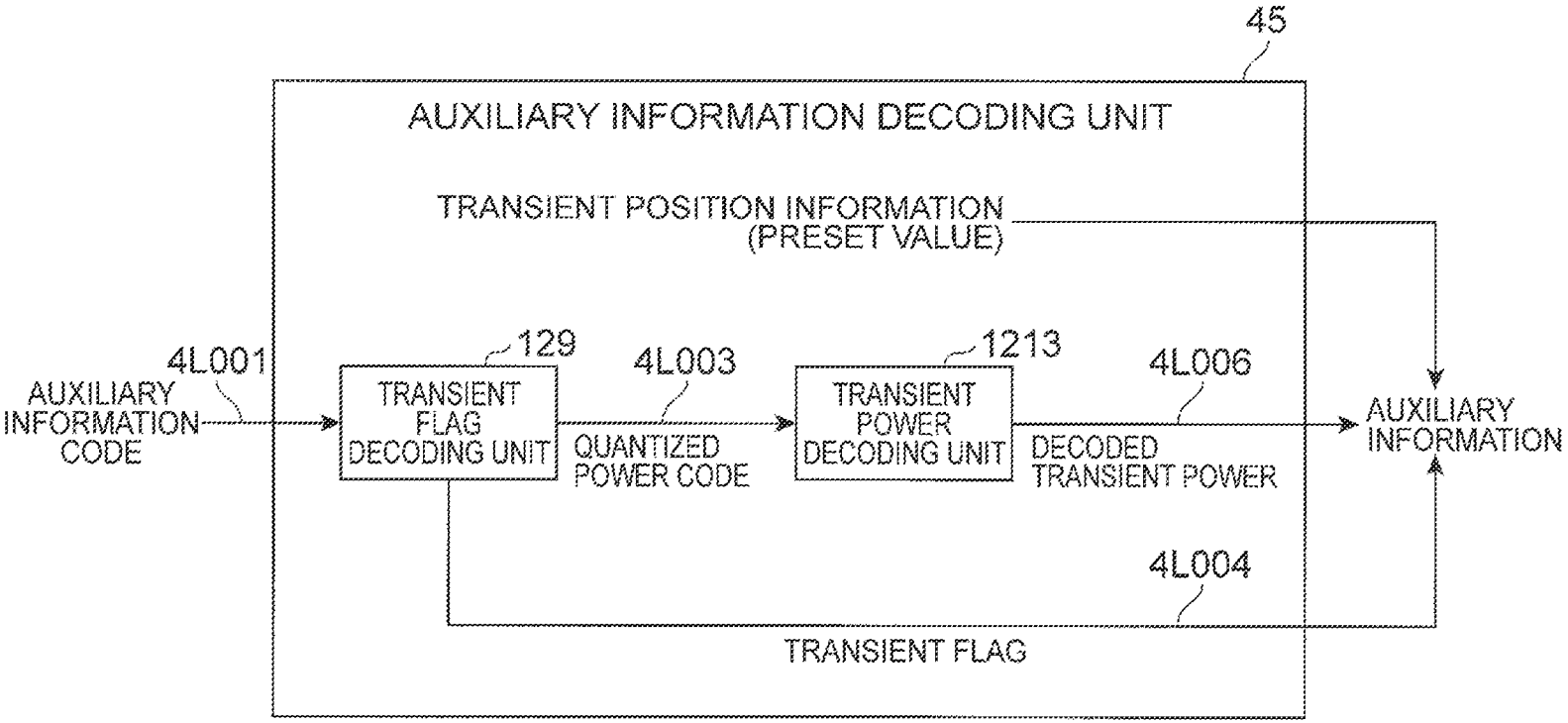
FIG. 46 is a configuration diagram of an example of the auxiliary information decoding unit in the thirteenth embodiment.

The overall configuration of the decoding unit 4 is the same as in the first embodiment (as shown in FIG. 6). The below will describe the configuration and operation of the auxiliary information decoding unit 45 which is a characteristic configuration in the present embodiment. The configuration of the auxiliary information decoding unit 45 in the present embodiment is as shown in FIG. 46.

The operation of the transient flag decoding unit 129 and the operation of the transient power decoding unit 1213 are the same as in the seventh embodiment. In the present embodiment, the predetermined value $l_{const}$ is always set in the transient position information, as in the twelfth embodiment.

As described above, it is feasible to realize the embodiment to transmit only the transient flag and the quantized transient power as the auxiliary information, while achieving the same effect as the seventh embodiment.

Fourteenth Embodiment

In the fourteenth embodiment, the subframe at the transient position is divided into subbands and a power of at least one subband is quantized as auxiliary information. In the quantization of the power of at least one subband, at least one subband among one or more subbands is defined as "core subband." Next, for a subband except for the core subband, a difference between a power of the subband (the subband except for the core subband) and a power of the core subband is calculated and the power of the core subband and the foregoing difference are quantized as auxiliary information. The power of the core subband may be contained in the auxiliary information or, may not be contained in the auxiliary information while a value contained in the audio code itself may be used instead.

(Configuration and Operation of Encoding Unit 1)

The encoding unit 1 in the present embodiment has the same configuration as in FIG. 10 described in the first embodiment, and the detailed description of the entire unit is omitted herein. The time-frequency transform is as described in the fourth embodiment. The signal after the transform into the frequency domain is denoted by V(k, l). The letter k herein represents an index of a frequency bin (provided that $0 \le k \le K-1$) and l an index of a subframe (provided that $0 \le l \le L-1$). The time-frequency transform unit 10 supplies both of the signal V(k, l) after the transform into the frequency domain and the audio signal before the time-frequency transform to the auxiliary information encoding unit 12.

Figure 47:
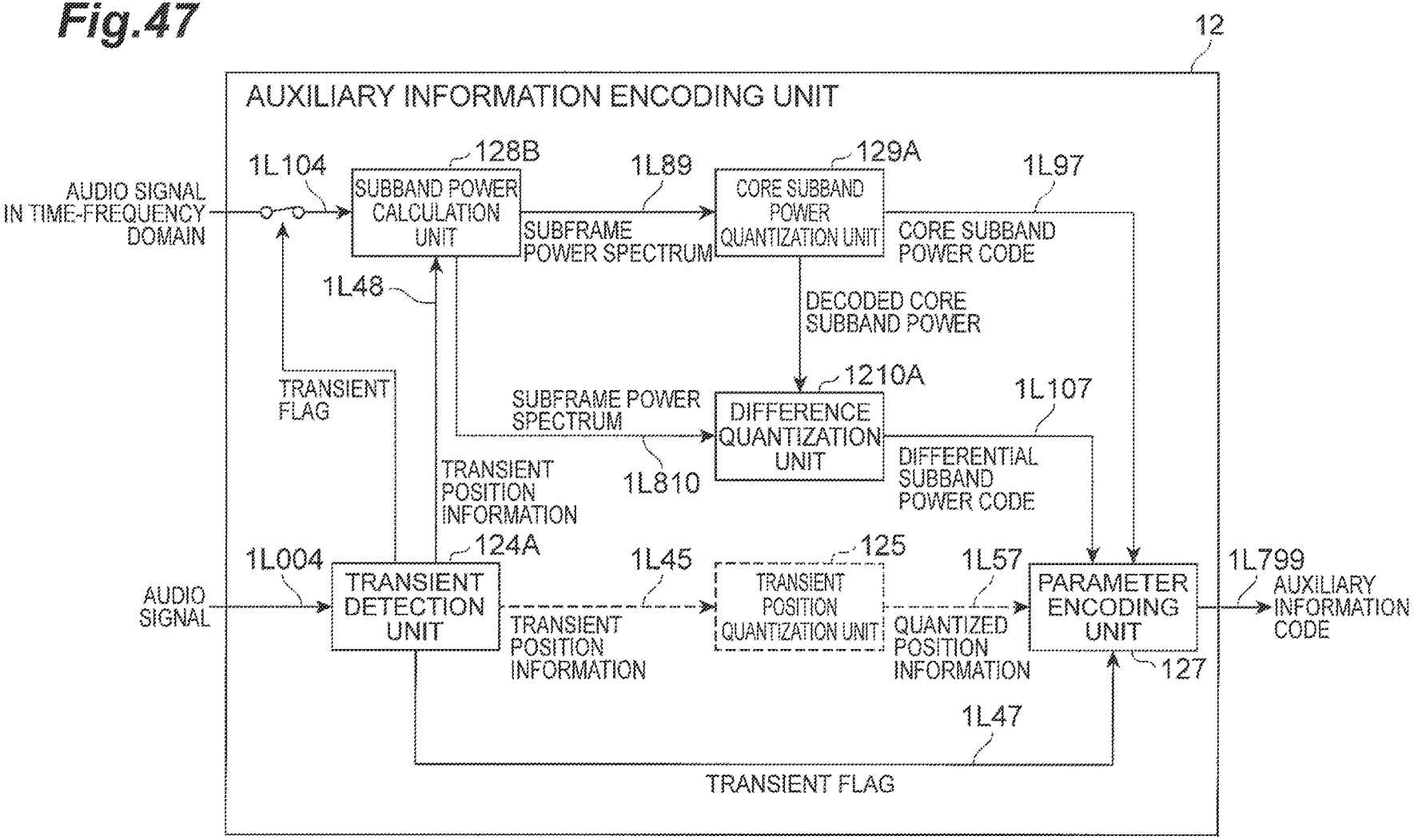
FIG. 47 is a configuration diagram of an example of the auxiliary information encoding unit in the fourteenth embodiment.

The configuration of the auxiliary information encoding unit 12 in the present embodiment is shown in FIG. 47. The auxiliary information encoding unit 12 is provided with the transient detection unit 124A, a subband power calculation unit 128B, a core subband power quantization unit 129A, a difference quantization unit 1210A, and the parameter encoding unit 127. Furthermore, it may be configured including the transient position quantization unit 125, but the below will describe the configuration without the transient position quantization unit 125.

The operation of the transient detection unit 124A is the same as in the seventh embodiment.

The subband power calculation unit 128B calculates subband powers of the subframe corresponding to the transient position, in accordance with the formula below. $P^{(i)}(l_{tran})$ represents the power of the ith subband at the transient position. Furthermore, $K_s^{(i)}$ and $K_e^{(i)}$ represent an index of the first frequency bin of the ith subband and an index of the last frequency bin of the ith subband, respectively.

$$P^{(i)}(l_{tran}) = 10\log_{10}\left(\frac{1}{K_e^{(i)} - K_s^{(i)}} \sum_{k=K_s^{(i)}}^{K_e^{(i)}-1} V^2(k, l_{tran})\right)$$

The core subband power quantization unit 129A defines a predetermined $i_{core}$-th subband as a core subband, quantizes the power of the core subband defined as follows:

$P^{(i_{core})}(l_{tran})$, and outputs a core subband power code. The quantization may be quantization using a predetermined quantization codebook or quantization by entropy coding using the Huffman coding or the like. In another method, J subbands of not less than one subband preliminarily determined as follows:

$(i_{core}^{(1)} \ldots i_{core}^{J})$ are defined as core subbands, and an average of powers of the J subbands is defined as a power of the core subbands. It is also possible to adopt a maximum, a minimum, or the median of the J subbands as a power of the core subbands.

Furthermore, the core subband power quantization unit 129A decodes the core subband power code and outputs the decoded core subband power denoted as follows.

$\hat{P}^{(i_{core})}(l_{tran})$

The difference quantization unit 1210A calculates a differential subband power sequence expressed as follows:

$\hat{P}^{(i)}(l_{tran})$ in accordance with the formula below, quantizes the sequence, and outputs the differential subband power code. The quantization may be quantization using a predetermined quantization codebook, quantization by entropy coding using the Huffman coding or the like, or quantization by the vector quantization if the differential subband power sequence has two or more subbands.

$$\hat{P}^{(i)}(l_{tran})=P^{(i)}(l_{tran})-\hat{P}^{(i_{core})}(l_{tran})$$

The parameter encoding unit 127 encodes the transient flag, core subband power code, and differential subband power code together and outputs the auxiliary information code. However, if the value of the transient flag is off, the core subband power code and the differential subband power code are not contained in the auxiliary information code.

(Configuration and Operation of Decoding Unit 4)

Figure 48:
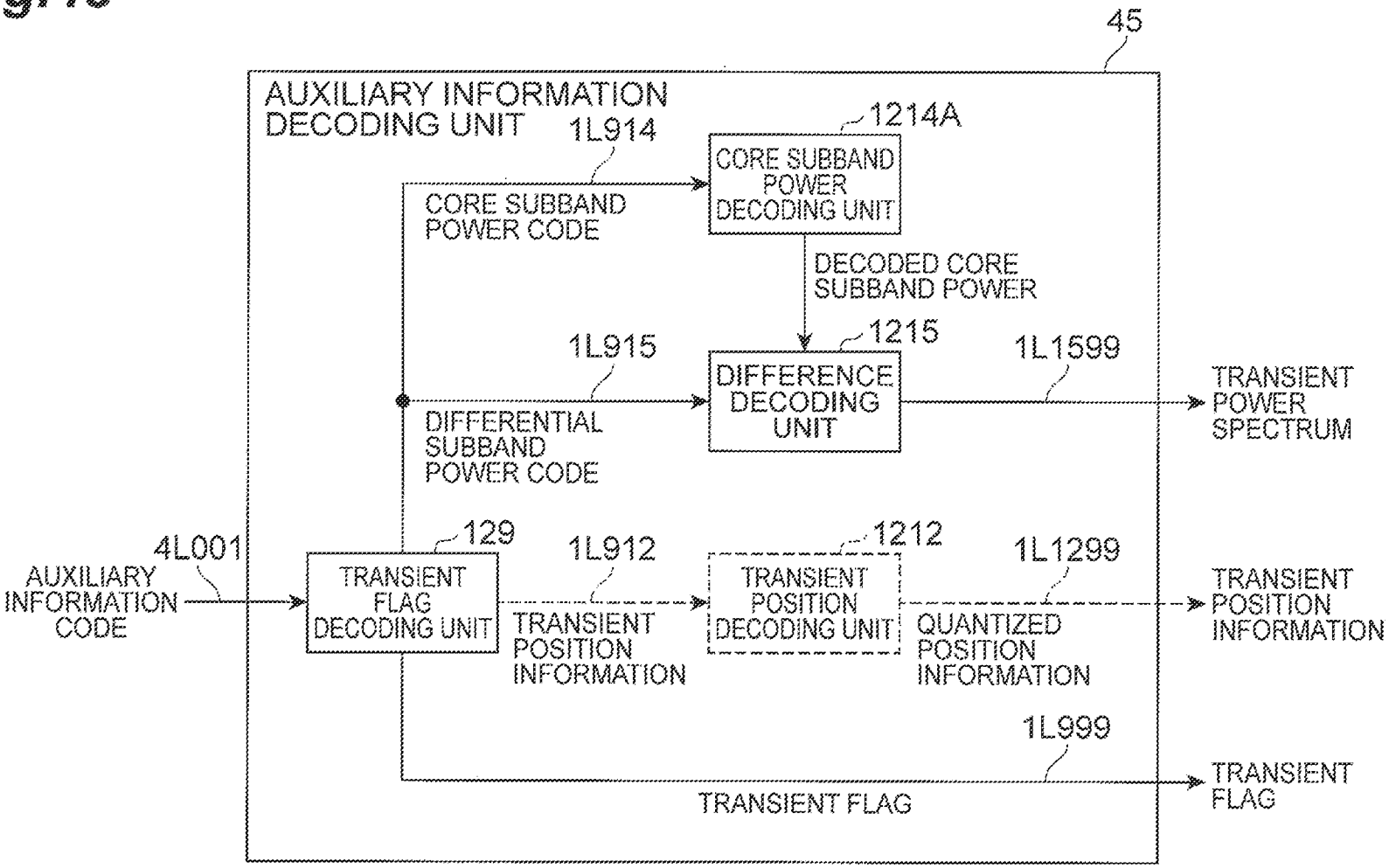
FIG. 48 is a configuration diagram of an example of the auxiliary information decoding unit in the fourteenth embodiment.

The configuration of the auxiliary information decoding unit 45 in the present embodiment is shown in FIG. 48. The auxiliary information decoding unit 45 is provided with the transient flag decoding unit 129, a core subband power decoding unit 1214A, and a difference decoding unit 1215. Furthermore, it may have a configuration including the transient position decoding unit 1212, but the below will describe the configuration without the transient position decoding unit 1212.

The operation of the transient flag decoding unit 129 is the same as in the seventh embodiment.

The core subband power decoding unit 1214A decodes the quantized core subband power and outputs the decoded core subband power expressed as follows.

$\hat{P}^{(i_{core})}(l_{tran})$

The difference decoding unit 1215 decodes the differential subband power code and outputs the decoded differential subband power sequence expressed as follows.

$\tilde{P}^{(i)}(l_{tran})$

Furthermore, the difference decoding unit 1215 adds the decoded differential subband power sequence and the decoded core subband power in accordance with the formula $$\hat{P}^{(i)}(l_{tran})=\tilde{P}^{(i)}(l_{tran})+\hat{P}^{(i_{core})}(l_{tran})$$

to calculate a transient power spectrum expressed as follows.

$\hat{P}^{(i)}(l_{tran})$

Next, the operation of the subframe power correction unit 442 (FIG. 24) in the present embodiment will be described. The auxiliary information storage unit 441 stores the transient flag and the transient power spectrum obtained by the forgoing auxiliary information decoding unit 45, as auxiliary information, and the subframe power correction unit 442 reads the transient flag and the transient power spectrum from the auxiliary information storage unit 441, and corrects the first concealment signal $z(K\cdot l+k)$ for a value of power thereof in each subframe to obtain the concealment signal $y(K\cdot l+k)$. Specifically, it performs the correction in accordance with the following procedure (provided that $0\le l\le L-1$ and $0\le k\le K-1$).

First, the first concealment signal output from the first concealment signal generation unit 43 is fed to the subframe power correction unit 442. Furthermore, the transient flag and the transient power spectrum stored in the auxiliary information storage unit 441 are fed to the subframe power correction unit 442.

Next, the subframe power correction unit 442 sets a predetermined value in the transient position information $l_{tran}$.

Next, the subframe power correction unit 442 calculates the subband power sequence in accordance with the formula below.

$$\hat{P}^{(i)}(l_{tran}) = 10\log_{10}\left(\frac{1}{K_e^{(i)}-K_s^{(i)}}\sum_{k=K_s^{(i)}}^{K_e^{(i)}-1} Z^2(k, l_{tran})\right)$$

Next, the subframe power correction unit 442 calculates a difference between the subband power sequence of the first concealment signal at the position of the transient and the transient power spectrum (differential transient power) in accordance with the formula below.

$$\overline{P}^{(i)}(l)=\hat{P}^{(i)}(l)-\hat{P}^{(i)}(l_{tran})$$

Next, the subframe power correction unit 442 corrects the power of the first concealment signal corresponding to each subframe after the position of the transient, using the differential transient power, to obtain a corrected concealment signal subframe power.

Finally, the subframe power correction unit 442 multiplies the first concealment signal by the corrected concealment signal subframe power in accordance with the formula below for all the subbands i, to calculate the concealment signal. However, $K_s^{(i)}\le k<K_e^{(i)}$ and $l\ge l_{tran}$.

$$y(k,l)=10^{\overline{P}^{(i)}(l)/20}\cdot z(k,l)$$

By making use of the difference between the power of the core subband and the power of each subband except for the core subband as auxiliary information, as described above, it is feasible to realize the high-accuracy packet loss concealment for the transient signal.

The present embodiment described the configurations without the transient position quantization unit 125 in the auxiliary information encoding unit 12 in FIG. 47 and without the transient position decoding unit 1212 in the auxiliary information decoding unit 45 in FIG. 48, but it is also possible to adopt the configurations including them.

Fifteenth Embodiment

The fifteenth embodiment will describe a case without the core subband power quantization unit 129A in FIG. 47 and without the core subband power decoding unit 1214A in FIG. 48 in the fourteenth embodiment.

(Configuration and Operation of Encoding Unit 1)

The encoding unit 1 in the present embodiment has the same configuration as in FIG. 10 described in the first embodiment and thus the detailed description of the entire unit is omitted herein. The time-frequency transform is the same as in the fourteenth embodiment.

The audio encoding unit 11 is configured to perform calculation and quantization of power of the audio signal to calculate the core subband power code, and enter it in the audio code. In output of the core subband power code, a power of a frame or at least one subframe obtained in the time domain may be quantized, a power of a frame or at least one subframe obtained in the frequency domain may be quantized, or a power of at least one subsample of a signal resulting from transform into QMF domain may be quantized. In the quantization in the frequency domain and in the QMF domain, a power calculated for at least one subband may be quantized.

Figure 49:
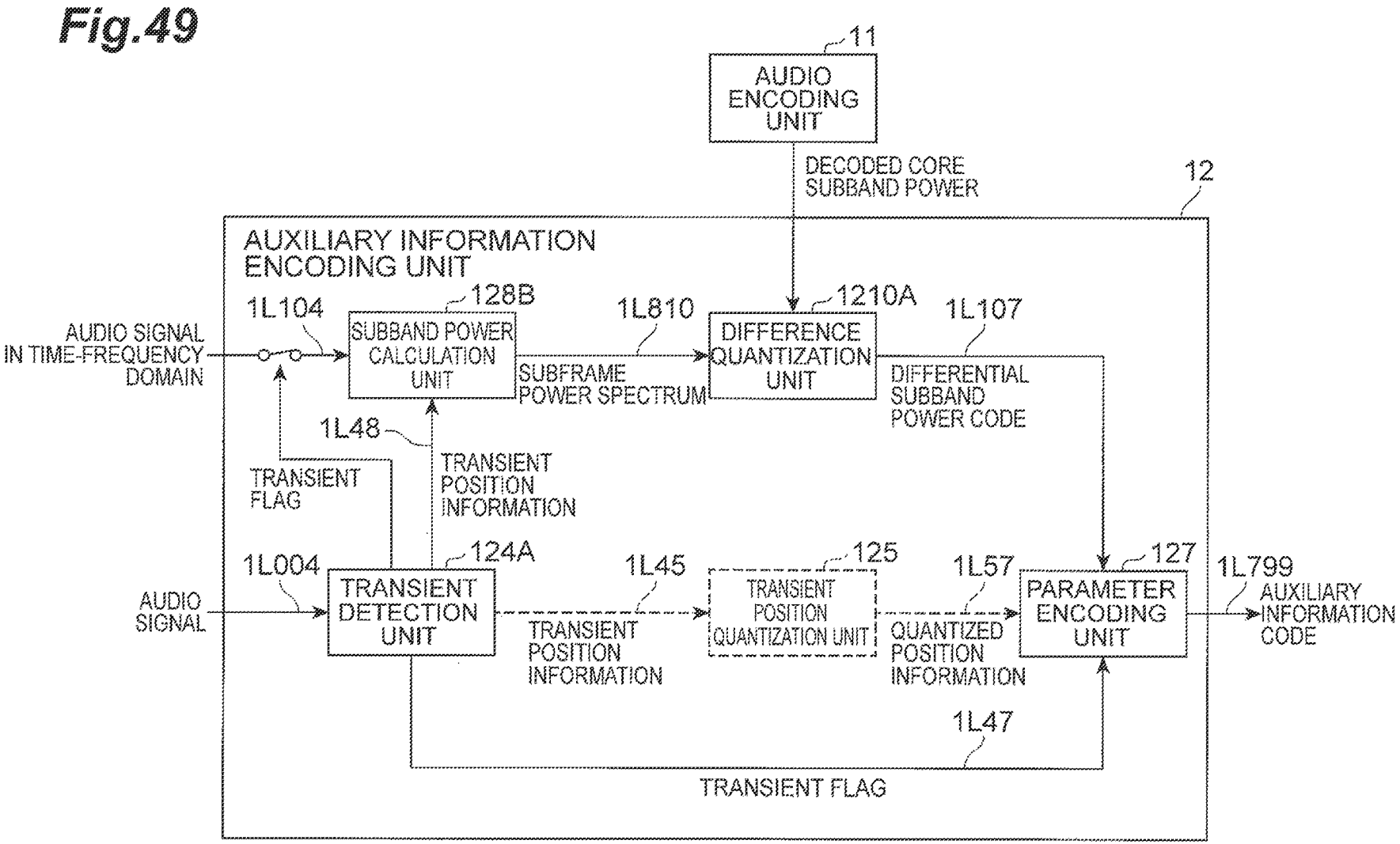
FIG. 49 is a configuration diagram of example of the auxiliary information encoding unit in the fifteenth embodiment.

The configuration of the auxiliary information encoding unit 12 in the present embodiment is shown in FIG. 49. The auxiliary information encoding unit 12 is provided with the transient detection unit 124A, subband power calculation unit 128B, difference quantization unit 1210A, and parameter encoding unit 127. Furthermore, it may have a configuration including the transient position quantization unit 125, but the below will describe the configuration without the transient position quantization unit 125.

The operation of the transient detection unit 124A is the same as in the seventh embodiment and the subband power calculation unit 128B is the same as in the fourteenth embodiment.

The audio encoding unit 11 feeds the decoded core subband power $P_{core}$ obtained by decoding the code about the power included in the audio code, to the difference quantization unit 1210A.

The difference quantization unit 1210A calculates the differential subband power sequence expressed as follows:

$\dot{P}^{(i)}(l_{tran})$ in accordance with the formula below, quantizes the sequence, and outputs the resulting differential subband power code. The quantization may be quantization using a predetermined quantization codebook, quantization by entropy coding using the Huffman coding or the like, or quantization by vector quantization if the differential subband power sequence has two or more subbands.

$$\dot{P}^{(i)}(l_{tran})=P^{(i)}(l_{tran})-P_{core}$$

The parameter encoding unit 127 is the same as in the fourteenth embodiment.

(Configuration and Operation of Decoding Unit 4)

Figure 50:
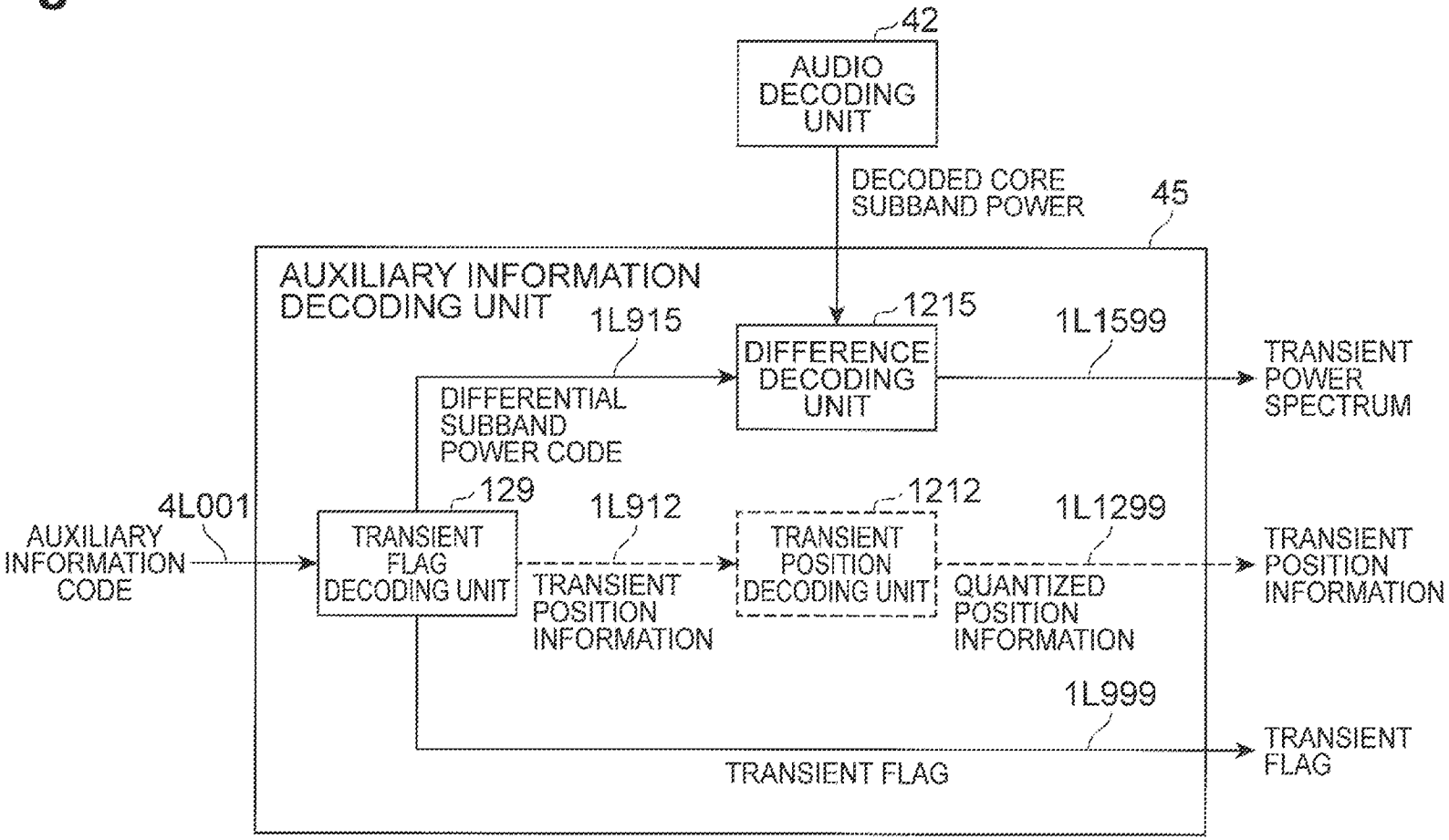
FIG. 50 is a configuration diagram of an example of the auxiliary information decoding unit in the fifteenth embodiment.

The configuration of the auxiliary information decoding unit 45 in the present embodiment is shown in FIG. 50. The auxiliary information decoding unit 45 is provided with the transient flag decoding unit 129 and the difference decoding unit 1215. Furthermore, it may have a configuration including the transient position decoding unit 1212, but the below will describe the configuration without the transient position decoding unit 1212.

The operation of the transient flag decoding unit 129 is the same as in the seventh embodiment.

The audio decoding unit 42 decodes the code about the power included in the audio code and feeds the resulting decoded core subband power $P_{core}$ to the difference decoding unit 1215. If $P_{core}$ is a value obtained in a domain different from the signal V(k, l) after the transform into the frequency domain, e.g., a value in the time domain, an offset is added to express $P_{core}$ in the same unit, and then $P_{core}$ is fed to the difference decoding unit 1215.

The difference decoding unit 1215 decodes the differential subband power code and outputs the decoded differential subband power sequence expressed as follows.

$\tilde{P}^{(i)}(l_{tran})$

Furthermore, the difference decoding unit 1215 adds the decoded differential subband power sequence and the decoded core subband power to calculate the transient power spectrum expressed as follows:

$\hat{P}^{(i)}(l_{tran})$, in accordance with the formula below.

$$\hat{P}^{(i)}(l_{tran})=\tilde{P}^{(i)}(l_{tran})+P_{core}$$

The operation of the subframe power correction unit 442 in FIG. 24 is the same as in the fourteenth embodiment.

As described above, it is feasible to realize the embodiment without the core subband power quantization unit 129A in FIG. 47 and without the core subband power decoding unit 1214A in FIG. 48 in the fourteenth embodiment, while achieving the same effect as the fourteenth embodiment.

The present embodiment described the configurations without the transient position quantization unit 125 in the auxiliary information encoding unit 12 in FIG. 49 and without the transient position decoding unit 1212 in the auxiliary information decoding unit 45 in FIG. 50, but it is also possible to adopt the configurations including them.

[Audio Encoding Program and Audio Decoding Program]

First, an audio encoding program for enabling a computer to operate as at least part of the audio encoding device will be described.

Figure 15:
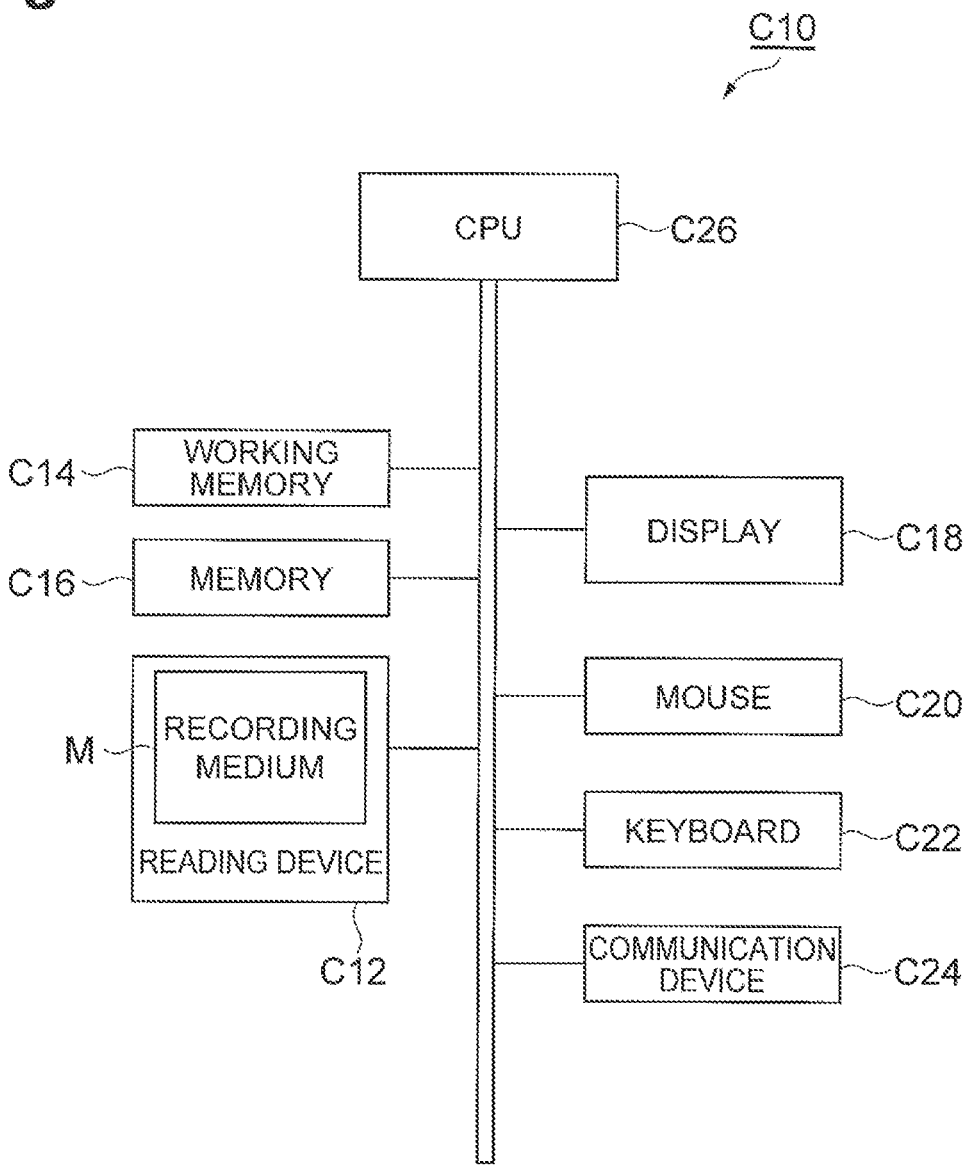
FIG. 15 is an example of a hardware configuration diagram of a computer.
Figure 16:
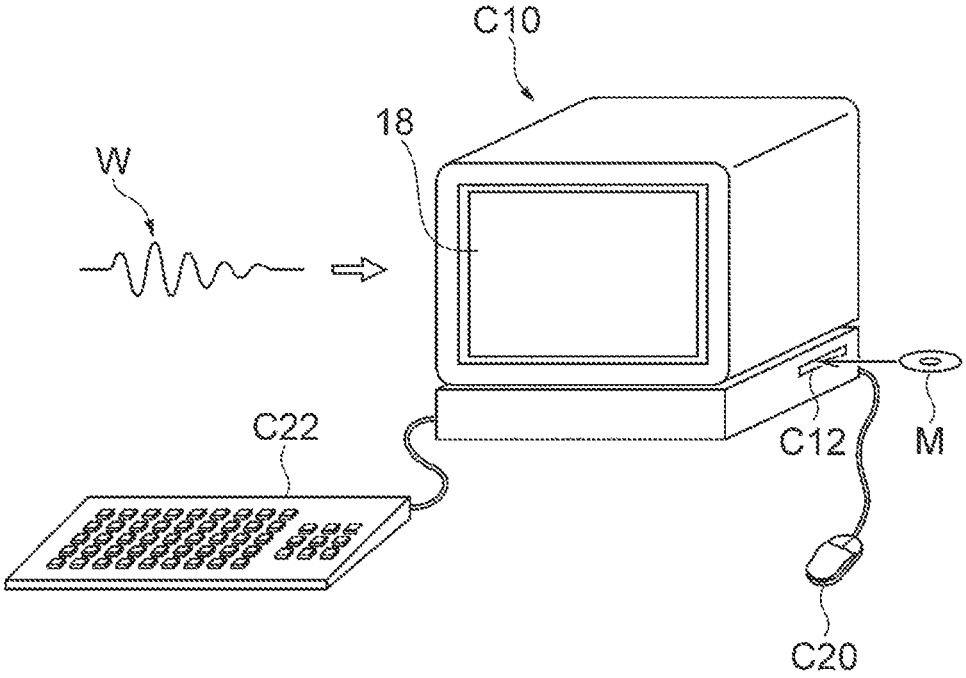
FIG. 16 is an example of an appearance diagram of the computer.
Figure 17:
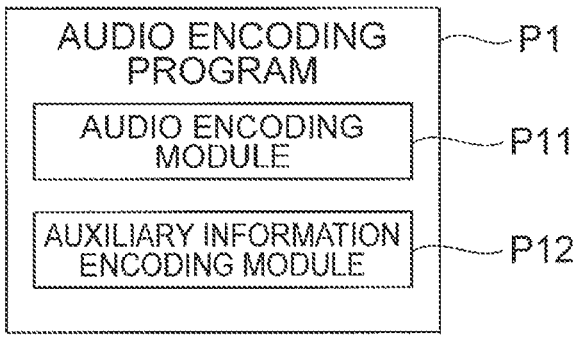
FIG. 17 is a drawing showing an example of a configuration of an audio encoding program.

FIG. 17 is a drawing showing an example configuration of an audio encoding program according to an embodiment. FIG. 15 is an example hardware configuration diagram of a computer according to an embodiment. FIG. 16 is an appearance diagram of an example of the computer according to an embodiment. The audio encoding program P1 shown in FIG. 17 can cause the computer C10 shown in FIG. 15 and FIG. 16, to operate as the encoding unit 1. It is noted that the computer C10 described in the present specification can be any information processing device, or devices, such as a cell phone, a portable information terminal, or a portable personal computer, without having to be limited to the computer as shown in FIGS. 15 and 16, and can be operated in accordance with at least a part of the audio packet error concealment system.

The audio encoding program P1 can be provided as stored in a recording medium M or computer readable storage medium, which is a non-transitory device since it is not a signal transmission device, but is instead a data storage device. The recording medium M can be, for example, a recording medium such as a flexible disk, CD-ROM, DVD, or ROM, or a semiconductor memory or the like.

As shown in FIG. 15, the computer C10 is provided with a reading device C12 such as a flexible disk drive unit, CD-ROM drive unit, or DVD drive unit. The computer 30 may also include memory, such as a working memory C14, and a memory C16 to store data, such as at least part of the program stored in the recording medium M. The memory may be a computer readable storage medium, that is non-transitory such that data is stored in the computer readable storage medium, not transmitted as a signal to another location via the computer readable data storage medium. The working memory C14 and memory C16 may be one or more computer readable medium, and can include a solid-state memory such as a memory card or other package that houses one or more non-volatile read-only memories. Further, the computer readable medium can be a random access memory or other volatile re-writable memory. Additionally or alternatively, the computer-readable medium can include a magneto-optical or optical medium, such as a disk or tapes or any other storage device to capture carrier wave signals such as a signal communicated over a transmission medium. A digital file attachment to an e-mail, stored in a storage device, or other self-contained information archive or set of archives may be considered a distribution medium that is a tangible storage medium. Accordingly, the embodiments are considered to include any one or more of a computer-readable medium or a distribution medium and other equivalents and successor media, in which data or instructions may be stored. In addition, the computer C10 may have a user interface that includes a display C18, a mouse C20 and a keyboard C22 as input devices, a touch screen display, a microphone for receipt of voice commands, a sensor, or any other mechanism or device that allows a user to interface with the computer C10. In addition, the computer 30 may include a communication device C24 to perform transmission/reception of data or the like, and a central processing unit (CPU) C26 to control execution of the program. The communication device C24 may include a communication port such as a universal serial bus port (USB), Bluetooth port, an infrared communication port, a network interface, or any other type of communication port that allows communication with an external device, such as another computer or memory device, or a network. The processor C26 may be one or more one or more general processors, digital signal processors, application specific integrated circuits, field programmable gate arrays, digital circuits, analog circuits, combinations thereof, and/or other now known or later developed devices for analyzing and processing data.

When the recording medium M is set in the reading device C12, the computer C10 becomes accessible to the audio encoding program P1, if stored partially or completely in the recording medium M, through the reading device C12 and can operate at least part of the audio encoding device according to the audio packet error concealment system, based on the audio encoding program P1. In other examples, the recording medium C10 can provide enablement or initialization of encoding program P1 or decoding program P2, which may be partially or completely stored elsewhere, such as in at least one of the working memory C14 and the memory C16. In still other examples, the encoding program P1 or decoding program P2 may be stored in other than recording medium M.

As shown in the example of FIG. 16, the audio encoding program P1 may be a program provided as a computer data signal W superimposed on a carrier wave, through a network. In this case, the computer C10 stores the audio encoding program P1 received by the communication device C24, into the memory C16 and then can execute the audio encoding program P1.

As shown in FIG. 17, the audio encoding program P1 is provided with an audio encoding module P11 and an auxiliary information encoding module P12. These audio encoding module P11 and auxiliary information encoding module P12 cause the computer C10 to execute with at least some similar functions as those included in the aforementioned audio encoding unit 11 and auxiliary information encoding unit 12. According to this audio encoding program P1, the computer C10 can operate as at least a portion of the audio encoding device according to the audio packet error concealment system.

Figure 18:
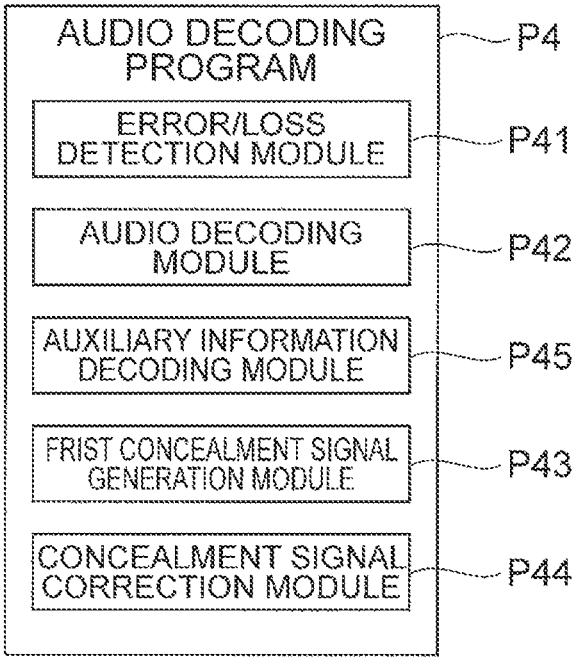
FIG. 18 is a drawing showing an example of configuration of an audio decoding program.

Next, an audio decoding program for enabling a computer to operate as at least part of the audio decoding device according to the audio packet error concealment system will be described. FIG. 18 is a drawing showing a n example configuration of an audio decoding program according to an embodiment.

The audio decoding program P4 shown in FIG. 18 can be used in the computer shown in FIGS. 15 and 16. The audio decoding program P4 can be provided in the same manner as the audio encoding program P1.

As shown in the example of FIG. 18, the audio decoding program P4 is provided with an error/loss detection module P41, an audio decoding module P42, an auxiliary information decoding module P45, a first concealment signal generation module P43, and a concealment signal correction module P44. The error/loss detection module P41, audio decoding module P42, auxiliary information decoding module P45, first concealment signal generation module P43, and concealment signal correction module P44 cause the computer C10 to execute with at least some similar functions as those included in the aforementioned error/loss detection unit 41, audio decoding unit 42, auxiliary information decoding unit 45, first concealment signal generation unit 43, and concealment signal correction unit 44, respectively. According to this audio decoding program P4, the computer C10 can operate as at least a portion of the audio decoding device according to the audio packet error concealment system.

The various embodiments described above allow the effective auxiliary information about the part where power changes suddenly, to be sent from the encoder side to the decoder side, and realize the high-accuracy packet loss concealment for the signal with the sudden temporal change of power (transient signal), for which the packet loss concealment was difficult by the conventional technologies, so as to reduce degradation of subjective quality with occurrence of a packet loss.

REFERENCE SIGNS LIST

1: encoding unit; 2: packet configuration unit; 3: packet separation unit; 4: decoding unit; 10: time-frequency transform unit; 11: audio encoding unit; 12: auxiliary information encoding unit; 13: code multiplexing unit; 40: code separation unit; 41: error/loss detection unit; 42: audio decoding unit; 43: first concealment signal generation unit; 44: concealment signal correction unit; 45: auxiliary information decoding unit; 46: inverse transform unit; 47: audio parameter storage unit; 121: subframe power calculation unit; 122: attenuation coefficient estimation unit; 123: attenuation coefficient quantization unit; 124: subframe power vector quantization unit; 124A: transient detection unit; 125: transient position quantization unit; 126: transient power scalar quantization unit; 127: parameter encoding unit; 128: transient power vector quantization unit; 128A: code length selection unit; 128B: subband power calculation unit; 129: transient flag decoding unit; 129A: core subband power quantization unit; 1210: attenuation coefficient decoding unit; 1210A: difference quantization unit; 1212: transient position decoding unit; 1213: transient power decoding unit; 1214: transient power vector decoding unit; 1214A: core subband power decoding unit; 1215: difference decoding unit; 431: decoding coefficient storage unit; 432: stored decoding coefficient repetition unit; 441: auxiliary information storage unit; 442: subframe power correction unit; C10: computer; C12: reading device; C14: working memory; C16: memory; C18: display; C20: mouse; C22: keyboard; C24: communication device; C26: CPU; M: recording medium; W: computer data signal; P1: audio encoding program; P11: audio encoding module; P12: auxiliary information encoding module; P4: audio decoding program; P41: error/loss detection module; P42: audio decoding module; P43: first concealment signal generation module; P44: concealment signal correction module; P45: auxiliary information decoding module.

The invention claimed is:

1. An audio encoding device for encoding an audio signal consisting of a plurality of frames, the audio encoding device comprising:

an audio encoding unit for encoding the audio signal; and an auxiliary information encoding unit for estimating and encoding auxiliary information about a temporal change of power of the audio signal, the auxiliary information being used in packet loss concealment in decoding of the audio signal, wherein the auxiliary information encoding unit estimates and encodes a flag of sudden change of power of an audio signal of a frame different than the current encoded frame by the audio encoding unit, as the auxiliary information, when the flag indicates a predetermined mode, the auxiliary information encoding unit further estimates and encodes quantized transient power at a position of the sudden change of the frame different than the current encoded frame, as the auxiliary information, wherein the auxiliary information contains only the flag and the quantized transient power, and when the flag does not indicate the predetermined mode, the auxiliary information encoding unit does not include the quantized transient power in the auxiliary information.

2. An audio encoding method executed by an audio encoding device for encoding an audio signal consisting of a plurality of frames, the audio encoding method comprising:

an audio encoding step of encoding the audio signal; and an auxiliary information encoding step of estimating and encoding auxiliary information about a temporal change of power of the audio signal, the auxiliary information being used in packet loss concealment in decoding of the audio signal, wherein in the auxiliary information encoding step, the audio encoding device estimates and encodes a flag of sudden change of power of an audio signal of a frame different than the current encoded frame by the audio encoding step, as the auxiliary information, when the flag indicates a predetermined mode, the audio encoding device further estimates and encodes quantized transient power at a position of the sudden change of the frame different than the current encoded frame, as the auxiliary information, wherein the auxiliary information contains only the flag and the quantized transient power, and when the flag does not indicate the predetermined mode, the audio encoding device does not include the quantized transient power in the auxiliary information.

* * * * *